US011673143B2

(12) United States Patent
Latchireddi et al.

(10) Patent No.: US 11,673,143 B2
(45) **Date of Patent: *Jun. 13, 2023**

(54) PULP LIFTER

(71) Applicant: EEMS HOLDING LLC, West Jordan, UT (US)

(72) Inventors: Sanjeeva Latchireddi, Salt Lake City, UT (US); Seethapathi Rao Latchireddi, Salt Lake City, UT (US)

(73) Assignee: EEMS Holding LLC, West Jordan, UT (US)

( * ) Notice: Subject to any disclaimer, the term of this patent is extended or adjusted under 35 U.S.C. 154(b) by 36 days.

This patent is subject to a terminal disclaimer.

(21) Appl. No.: 16/889,723

(22) Filed: Jun. 1, 2020

(65) Prior Publication Data

US 2020/0298247 A1 Sep. 24, 2020

Related U.S. Application Data

(63) Continuation of application No. 15/359,614, filed on Nov. 22, 2016, now Pat. No. 10,668,477.

(60) Provisional application No. 62/258,465, filed on Nov. 22, 2015.

(51) Int. Cl.
*B02C 17/18* (2006.01)

(52) U.S. Cl.
CPC ..... *B02C 17/1855* (2013.01)

(58) Field of Classification Search
CPC ..... B02C 17/00; B02C 17/002; B02C 17/10; B02C 17/1855; B02C 17/1825
See application file for complete search history.

(56) References Cited

U.S. PATENT DOCUMENTS

| | | | | |
|---|---|---|---|---|
| 7,566,071 | B2 * | 7/2009 | Tsujimoto | B60R 21/2037 280/731 |
| 8,109,457 | B2 * | 2/2012 | Latchireddi | B02C 17/1855 241/70 |
| 8,128,014 | B2 * | 3/2012 | Allenius | B02C 17/1855 241/70 |

* cited by examiner

*Primary Examiner* — Matthew Katcoff
(74) *Attorney, Agent, or Firm* — Wilding Law PLLC; David Wilding

(57) ABSTRACT

A pulp lifter has a leading edge and a trailing edge with respect to rotation of a rotary grinding mill, and includes a first wall bounding an interior space and a second wall dividing the interior space into first and second regions. The first wall includes an inner edge wall section and a radially outer wall section. The second wall includes a guide that extends substantially from the radially outer wall section to a trailing edge of the inner edge wall section. The guide is configured such that the second end of the guide does not extend to a radially inner edge of the pulp lifter. The first and second walls form at least one inlet opening at the leading edge providing access to the second section and an outlet opening for discharge of slurry from the second section at the radially inner edge and the trailing edge.

20 Claims, 43 Drawing Sheets

A-A
PRIOR ART

PULP LIFTER

RELATED APPLICATIONS

This application claims the benefit of and hereby incorporates by reference U.S. Provisional Patent Application Ser. No. 62/258,465, entitled "Pulp Lifter", filed Nov. 22, 2015 and Non-Provisional patent application Ser. No. 15/359,614, entitled "Pulp Lifter", filed Nov. 22, 2016, granted on Jun. 2, 2020 at U.S. Pat. No. 10,668,477.

BACKGROUND

The subject matter of this disclosure relates to apparatus for discharging material from a rotary mill that is used for grinding or comminution. Unless otherwise indicated herein, the approaches described in this section are not prior art to the claims in this disclosure and are not admitted to be prior art by inclusion in this section.

FIGS. 1A and 1B show a rotary grinding mill 1 that contains material 2 to be ground therein with the aid of grinding media. The mill 1 is arranged to rotate around a rotation axis 3. The mill has a feed trunnion 4 and a discharge trunnion 5 by which the mill is supported on bearings (not shown) to a mechanical ground. The material 2 to be ground in the mill is fed into a grinding chamber of the mill 1 through the feed trunnion 4. Water is advantageously also fed into the mill 1 in order to create a wet grinding in the mill 1. Balls of a hard substance (not shown; e.g., steel balls) may be added to the grinding chamber to improve or accelerate the crushing or grinding of the material. Between the grinding chamber and the discharge trunnion 5 of the mill 1, a framework 6 is installed inside the mill 1 and supported to the body 7 of the mill 1. The framework 6 supports a pulp lifter assembly that comprises guide members 8, 9 and a discharge cone 10. The pulp lifter assembly directs the ground material from the grinding chamber to the discharge trunnion 5 of the mill 1. As illustrated in FIG. 1B, the pulp lifter assembly comprises several sequential pulp lifters 11. Each pulp lifter 11 is attached to a grate or screen 12 having holes 13 through which the ground material 2 passes and enters a slurry pocket of the pulp lifter. As illustrated in FIG. 1A, at least one pulp lifter 11 is at least partly immersed into the material 2 at a time during the operation of the mill 1. The pulp lifter 11 has a substantially rectangular or trapezoidal external shape so that two external sides or edges 21 of the pulp lifter 11 are essentially parallel and two other external sides or edges 22 are convergent to each other. The pulp lifter 11 is installed in the mill 1 so that the longer external side of the two parallel sides 21 is radially outward of the shorter of the two parallel sides and is close to the body 7 of the mill 1.

FIG. 2 shows a perspective view of some of the main components of a rotary grinding mill 31. The body 7 (FIGS. 1A-1B) includes a feed end plate 34, a grinder chamber or shell 37, and discharge end plate 36, which provides an enclosure to contain the material 2 (FIGS. 1A-1B) during the grinding or milling process. The material (not shown) to be ground in the mill is fed into a grinding chamber 37 of the mill 31 through the feed trunnion 4 (FIGS. 1A-1B) on the feed end plate 34. Each pulp lifter 11 (FIGS. 1A-1B) in the pulp lifter assembly 41 is attached to a grate 12 (FIGS. 1A-1B) in the grate assembly 42. Each grate has holes 13 (FIGS. 1A-1B) through which the ground material passes and enters a slurry pocket of the pulp lifter. The pulp lifter assembly directs the ground material from the slurry pocket to the discharge trunnion 35 on the discharge end plate 36 of the mill 31.

FIGS. 3A-3C illustrate two pulp lifters 11A, 11B partially connected to each other. Each pulp lifter 11 has a first section 15 and a second section 16 separated by a wall 23. The grate or screen 12 with screening holes 13 is installed in front of the first section 15 of the pulp lifter 11 in the proceeding direction 19 of the material. Between the first section 15 of the pulp lifter 11B and the second section 16 of the pulp lifter 11A there is an opening 17. The second section 16 of each pulp lifter 11 is provided with a guide member 18, which extends from a point in the vicinity of the radially outer end of the leading edge 22 of the pulp lifter (with respect to the direction of rotation 25 of the mill) to a point in the vicinity of the radially inner end of the trailing edge 22 of the pulp lifter. As shown in the drawings, the guide member is constructed so that at least the part starting from the inlet of the second section is curved over at least 25% of the total length of the guide member. The outer end of the guide member (or the leading end in the direction of rotation of the mill) is directed tangentially of the mill whereas the inner or trailing end is directed essentially towards the rotating axis 3 of the mill 1.

During the operation of the mill 1, referring back to FIGS. 1A-1B and 3A-3C, the mill 1 is rotated around its rotation axis 3 and the pulp lifters 11 are one after another immersed into the ground or comminuted material 2. While a given pulp lifter (such as the pulp lifter 11A) is immersed, some of the material 2 flows through the sieve or screen 12 into the first section 15 of the pulp lifter 11A. As the mill 1 continues to rotate, the first section 15 is step by step lifted from its immersed state, and the material in the first section 15 of the pulp lifter 11A flows downward into the second section 16 of the pulp lifter 11B through the opening 17. Owing to the guide member 18 in the second section 16 of the pulp lifter 11B the material flow is directed towards the center of the mill 1 and further by means of the guide members 8, 9 and 10 into the discharge trunnion 5 of the mill 1 and to the further processing of the material 2.

As the pulp lifter 11A rises, material that is in the radially outer region of the first section 15 flows downwards (see the arrow 19 in FIG. 3B) into the second section 16 of the pulp lifter 11B through the opening 17 and is directed towards the central axis of the mill by the guide member. As the pulp lifters continue to rise, the material in the section 16 of the pulp lifter 11B is further directed towards the central axis and is discharged from the pulp lifter onto the guide members 8 and 9, which direct the material onto the cone 10. The material is unable to accumulate or collect in the outer lower corner region of the section 16.

The mill shown in FIGS. 1A-3C rotates in the counter clockwise direction 20 as seen in FIG. 1B. Let us consider the situation where the pulp lifter 11A is at the 6 o'clock position (directly below the axis of rotation of the mill). In this case, several holes 13 in the grate 12 are immersed in the slurry and slurry enters the first section 15 of the pulp lifter 11A. Slurry also flows through the opening 17 into the second section 16 of the pulp lifter 11B, but cannot enter the lower rear (outer trailing) corner region of the second section because that region is blocked by the guide member 18. As the mill rotates from the 6 o'clock position towards the 3 o'clock position, the orientation of the pulp lifter 11A changes and some of the holes in the forward rows are exposed above the slurry while at least the radially outermost hole of the trailing row remains immersed. Since the slurry on the upstream side of the grate and the slurry in the first section 15 are in communication, pressure equilibrium between the upstream side of the grate and the first section is attained if the slurry in the first section of the pulp lifter flows downwards as the pulp lifter 11A rises, so that the free surface of the slurry in the pulp lifter tends to remain always lower than the free surface of the slurry on the upstream side of the grate keeping the flow gradient across the grate. In case the mill is fed more material 2 than the designed capacity of the pulp lifters, there is a possibility that some slurry will flow back out of the first section to the upstream side of the grate, but because the opening 17 is much larger than the holes 13 the major effect will be that the equilibrating flow will pass through the opening 17 into the second section 16 of the pulp lifter 11B. Further, because of the curved shape of the guide member, the lowest point in the available space in the second section 16 of the pulp lifter 11B, i.e. the space that is not blocked by the guide member 18, will move radially inwards, towards the central axis of the mill, as the mill rotates from the 6 o'clock position towards the 3 o'clock position instead of remaining in the lower outer corner of the second section. Depending on the depth of the slurry on the upstream side of the grate, some of the slurry in the second section may overflow the radially inner end of the guide member 18 and move towards the guide cone 10. In any event, when the pulp lifter 11A reaches the 3 o'clock position substantially all the slurry will have passed into the second section of the pulp lifter 11B and much of the slurry will have moved from the pulp lifter 11B towards the guide cone and as the pulp lifter reaches the 12 o'clock position, slurry will fall downward from the pulp lifter onto the guide cone 10.

FIG. 4 illustrates an implementation of the pulp lifter that is shown more schematically in FIGS. 3A-3C. Viewing the pulp lifter along the axis of rotation of the mill, the pulp lifter has a continuous back wall 24, an inner edge wall 25 formed with a discharge opening (not shown), and a leading edge wall 26. The pulp lifter is open at its front side. An intermediate wall 23 is spaced from the back wall 24 and is connected to the back wall by the guide 18. The guide 18 and the intermediate wall 23 separate the first section 15 of the pulp lifter from the second section 16. The leading edge wall 26 is formed with transfer openings 17. The grate (not shown) is attached to the pulp lifter using fasteners that engage holes 27 in the leading edge wall. When multiple pulp lifters are installed in a grinding mill, the first section 15 of the leading pulp lifter communicates with the second section 16 of the following pulp lifter through the transfer openings 17 in the leading edge wall 26 of the following pulp lifter. In operation, slurry enters the first section 15 of a pulp lifter through the holes in the grate as the lifter passes through the 6 o'clock position. As the pulp lifter rotates towards the 3 o'clock position, the pulp lifter rises relative to the following pulp lifter and slurry in the first section 15 of the leading pulp lifter flows through the transfer openings 17 into the second section 16 of the following pulp lifter. As the pulp lifters continue to rotate, the slurry in the second section of the following pulp lifter flows along the guide 18 and flows through the opening in the inner edge wall 25 towards the cone 10, as explained above. The configuration of the guide 18 is somewhat different in FIG. 4 from FIGS. 3A-3C, in that the radially outer end of the guide is not tangential to the periphery of the mill, but the essential function of the guide, preventing comminuted material from remaining against the peripheral wall of the mill as the pulp lifter rotates from the 6 o'clock position towards the 3 o'clock position, is the same.

FIGS. 5A and 5B illustrate another pulp lifter. The pulp lifter shown in FIGS. 5A and 5B is similar to that shown in FIG. 4 except that the intermediate wall 23 is not coextensive with the back wall 24 but extends only over the second section 16 of the pulp lifter. Thus, the space between the back wall and the intermediate wall that is not available to slurry in the lifter shown in FIG. 4 because of the guide 18 is part of the first section in the lifter shown in FIGS. 5A and 5B.

Consequently, the area available for transfer of slurry from the first section 15 to the second section 16 via the transfer opening 17 is greater in the case of FIGS. 5A and 5B than in the case of FIG. 4. In addition, it will be appreciated that when multiple pulp lifters as shown in FIG. 4 are installed, the trailing edge wall 28 of the leading pulp lifter partially blocks the transfer openings 17 of the following pulp lifter, and only the portion forward of the dashed line 29 shown in FIG. 4 is available for flow of slurry. In the case of FIGS. 5A and 5B, for a pulp lifter of similar size the transfer openings 17 of the following pulp lifter are of greater effective area because they are not partially blocked by the leading pulp lifter (e.g., trailing edge wall 28).

The use of the guide 18 in the pulp lifters shown in the drawings is advantageous for several reasons. First, the transfer of slurry from the first section 15 to the second section 16 through the transfer opening prevents flowback through the grate from the second section as the pulp lifter rises from the 6 o'clock position to the 3 o'clock position. Second, by preventing accumulation of material in the outer trailing area of the pulp lifter, the guide 18 ensures that there is minimal carryover of pebbles and slurry as the mill rotates.

The pulp lifter assembly described in U.S. Pat. No. 7,566,017, which is incorporated by reference in its entirety, includes a pulp lifter structure that comprises an outer pulp lifter, an inner pulp lifter, and a discharger. Referring to FIGS. 6A-9, in which the pulp lifter structure is oriented so that it rotates in the counter clockwise direction when viewed along the axis of rotation of the mill from the feed trunnion, the outer pulp lifter has a leading wall 102, a radially outer wall 104, a radially inner wall 106, an axially downstream wall 108, and an intermediate wall 110 that is generally parallel to and spaced from the axially downstream wall 108 and is connected to the axially downstream wall by a curved guide 112. The walls 102-110 and the guide 112 define an inlet chamber 115 that is open towards the viewer and to the right of the figure. The leading wall 102 is formed with a transfer opening 117 (FIG. 6B) that provides access to an outlet chamber 116 defined between the intermediate wall 110 and the axially downstream wall 108 and bounded by the guide 112. The radially inner wall is formed with an outlet opening 119. Multiple outer pulp lifters as shown in FIGS. 6A and 6B are attached to the axially downstream wall of the mill in an annular array. The inlet chamber 115 of a leading pulp lifter communicates with the outlet chamber 116 of a following pulp lifter via the transfer opening 117 in the wall 102 of the following pulp lifter.

Referring to FIG. 7, inner pulp lifters 120 are attached to the axially downstream wall of the body of the mill in an annular array inward of the outer pulp lifters 100. There is one inner pulp lifter 120 for each two adjacent outer pulp lifters 100. Each inner pulp lifter 120 comprises an axially downstream wall 122 and two radial walls 124, the radial walls 124 being aligned respectively with the leading walls 102 of two adjacent outer pulp lifters 100. Each two adjacent radial walls 124 of an inner pulp lifter define a channel 126 into which the outlet opening of an outer pulp lifter debouches. Similarly, the following radial wall 124 of a leading inner pulp lifter and the leading radial wall of a following inner pulp lifter define a channel into which the outlet opening 119 of an outer pulp lifter debouches.

The pulp lifter structure further comprises dischargers 130 (FIGS. 8 and 9) that are attached to the axially downstream wall of the mill in an annular array inward of the inner pulp lifters 120. Each discharger has an axially downstream wall 132 and two radial walls 134 and 136 projecting from the wall 132. Each discharger defines a discharge channel between its two radial walls 134, 136, and each two adjacent dischargers define a discharge channel between the following wall 136 of the leading discharger and the leading wall 134 of the following discharger. It will be noted from FIG. 8 that the leading wall 134 is radially shorter than the following wall 136. The channel defined between the two walls 134, 136 of the discharger, and the channel defined between the wall 134 of the leading discharger and the wall 136 of the following discharger, open into a discharge space defined between the wall 136 of the leading discharger and the wall 136 of the following discharger. The axially downstream wall 132 of the following discharger is formed with an opening 138 that communicates with the discharge space defined between the following wall 136 of the following discharger and the wall 136 of the leading discharger.

Referring to FIG. 9, a center liner 140 is attached to the inner pulp lifter 120 and a grate plate 150 is attached to the outer pulp lifter 100. The grate plates 150 collectively form the grate of the grinding mill.

In operation, as the mill rotates and an outer pulp lifter approaches the 6 o'clock position, slurry (which may include pebbles) enters the inlet chamber through the openings 152 in the grate plate. As the outer pulp lifter moves towards the 9 o'clock position, the outer pulp lifter rises relative to the following pulp lifter and slurry in the inlet chamber 115 of the leading pulp lifter flows through the transfer opening 117 in the leading wall of the following outer pulp lifter and enters the outlet chamber 116 of that pulp lifter. As the mill continues to rotate, the slurry in the outlet chamber of the outer pulp lifter flows along the guide 112 and flows through the opening 119 in the radially inner wall 106 into the channel 126 of the inner pulp lifter, and ultimately into the discharger 130. Most of the slurry leaves the discharger through the opening 138 and moves towards the guide cone (not shown).

The speed with which particles in the pulp lifter move towards the dischargers 130 influences the efficiency of the pulp lifter structure, in that higher velocity particles are likely to reach the discharge space by the time that the discharger attains the 12 o'clock position, whereas lower velocity particles are more likely to be impeded by friction against the trailing wall that bounds the discharge channel of the inner pulp lifter or discharger 130, so that the particles do not reach the discharge space by the time the discharger attains the 12 o'clock position, and are more likely to be carried over and remain in the pulp lifter structure during the next revolution of the mill.

The velocity that is attained by particles moving towards the discharger 130 depends on the curvature of the guide 112 and the angular extent of the guide about the axis of rotation of the pulp lifter structure. For larger values of the curvature of the guide, a particle moves with greater velocity radially inward along the guide as the pulp lifter rises. Similarly, for larger values of the angular extent of the guide about the axis of rotation of the pulp lifter, the particle is subject to the influence of the guide over a greater proportion of the revolution of the pulp lifter. However, ease of fabrication of the components of the pulp lifter structure, and ease of assembly, are facilitated if the pulp lifter has a smaller angular extent about the axis of rotation. The pulp lifter structure described with reference to FIGS. 6A-9 is designed such that there are 32 individual pulp lifters distributed about the axis of rotation of the mill. Consequently the guide 112 of each pulp lifter has an angular extent of 11.25°. It would be desirable to increase the angular extent of the guide if this could be achieved without adversely affecting the manufacturability of the pulp lifter structure.

The pulp lifter assembly described in U.S. Pat. No. 8,109,457, which is incorporated by reference in its entirety, includes a annular pulp lifter structure that comprises an outer pulp lifter, an inner pulp lifter, and a discharger, that similar to FIGS. 6A-9 but with a different inner pulp lifter design.

FIGS. 10-13 illustrate a pulp lifter assembly that comprises an annular array of outer pulp lifters 200, similar to the pulp lifters 100 shown in FIGS. 8 and 9, and a circular arrangement of inner dischargers 230, similar to the dischargers 130 shown in FIGS. 8 and 9. In operation, the pulp lifter assembly rotates in the counter clockwise direction 202. Each inner discharger 230 defines a discharge channel between its two radial walls 234, 236, and each leading discharger and the adjacent following discharger define a discharge channel between the wall 236 of the leading discharger and the wall 234 of the following discharger. As in the case of FIG. 8, the wall 234 of the following discharger is radially shorter than the wall 236 of the leading discharger. The channel defined between the two walls 234, 236 of a following discharger 230, and the channel defined between the wall 234 of the following discharger and the wall 236 of the adjacent leading discharger, open into a discharge space defined between the wall 236 of the leading discharger and the wall 236 of the following discharger. The axially downstream wall (or back wall) 232 of the following discharger is formed with an opening (not shown in FIGS. 10-13 but similar to the opening 138 shown in FIG. 8) that communicates with the discharge space defined between the wall 236 of the following discharger and the wall 236 of the leading discharger. The two radial walls 234, 236 of each inner discharger 230 thus define a first discharge channel, and the wall 234 of a following discharger and the wall 236 of the adjacent leading discharger define a second discharge channel, which meets the discharge channel defined by the two radial walls of the following discharger at the inner end of the radial wall 234.

Referring to FIG. 13, a grate plate 250 is attached to the outer pulp lifter 200. The grate plates 250 collectively form the grate of the grinding mill.

Between the annular array of outer pulp lifters 200 and the circular arrangement of inner dischargers 230 is an annular array of transition dischargers 220. For each inner discharger 230 there is a corresponding transition discharger 220, and each transition discharger 220 is positioned between the two radii that bound the corresponding inner discharger 230.

As shown in FIG. 10, the pulp lifter assembly comprises sixteen inner dischargers and sixteen transition dischargers, and each transition discharger is associated with three angularly adjacent pulp lifters. One of the three pulp lifters (referred to as a center pulp lifter) is associated exclusively with the transition discharger whereas each of the other two pulp lifters (referred to as leading and trailing pulp lifters) is associated with two angularly adjacent transition dischargers.

Referring to FIG. 11, each transition discharger 220 includes a back wall 221 lying substantially parallel and coplanar with the back wall 232 (FIG. 12) of the inner discharger module and three walls 222-224 projecting substantially perpendicularly to the back wall 221. The back wall 221 includes attachment structures 221A for receiving fasteners for attaching the transition discharger to the frame of the body of the mill. The back wall has two radial edges and inner and outer peripheral edges.

The projecting wall 222 extends the entire distance from the outer peripheral edge of the back wall to the inner peripheral edge of the back wall and includes attachment structures 222A at each end for receiving fasteners that attach a liner 240 (FIG. 13) to the back wall of the transition discharger. The projecting wall 222 is curved, its leading side being concave and its trailing side being convex. The radially outer end of the leading side of the wall 222 is adjacent the leading side of the outlet opening 219 in the leading pulp lifter, whereas the leading side of the inner end of the wall is substantially flush with the leading side of the wall 236 (FIG. 12) of the inner discharger 230 (FIG. 12).

The projecting wall 222 may be considered to be composed of inner and outer segments that meet at a radius that is midway between the radial edges of the back wall 221. The projecting wall 223, including the attachment structure 223A, corresponds in configuration to the inner segment of the wall 222 and extends from the leading radial edge of the back wall to the inner peripheral edge of the back wall. The projecting wall 224, including the attachment structure 224A, corresponds in configuration to the outer segment of the wall 222 and extends from the outer peripheral edge of the back wall to the trailing radial edge of the back wall. Thus, as shown in the drawings, the projecting walls 223 and 224 of a following transition discharger and a leading transition discharger respectively together have substantially the configuration of the projecting wall 222 of a transition discharger. The walls 222 and 223 of a center transition discharger and the wall 224 of the leading transition discharger form a first channel and the walls 222 and 224 of the center transition discharger and the wall 223 of a following transition discharger form a second channel. The two channels extend from the outer peripheral edge of the annular array of transition dischargers to the inner peripheral edge of the annular array of transition dischargers and the trailing walls defining the respective channels are curved such that the inner end of the trailing wall trails the outer end of that wall.

The liner 240 (FIG. 12) of the transition discharger covers the channels defined between the wall 222 and the walls 223 and 224. The liner is formed with holes for receiving fasteners that attach the liner to the attachment structures 222A, 223A and 224A and with attachment eyes for facilitating handling of the transition discharger.

In operation of the pulp lifter assembly, referring to FIGS. 10-13, each pulp lifter 200 in turn rotates through the 6 o'clock position, in which slurry enters the pulp lifter through holes 252 in the grate plate 250. As the pulp lifter rotates towards the 9 o'clock position, the pulp lifter rises relative to the following pulp lifter and slurry in the first section 215 of the leading pulp lifter flows through the transfer openings (not shown in FIGS. 10-13) into the second section 216 of the following pulp lifter, as described with reference to FIGS. 6A-9. As the pulp lifters continue to rotate, the slurry in the second section 216 of the following pulp lifter flows along the leading side of the guide 218 and flows through the opening 219 in the inner edge wall towards the annular array of transition dischargers. Depending on the angular position of the pulp lifter relative to the transition dischargers, the slurry either enters the channel between leading side of the wall 222 of a following transition discharger and the trailing side of the wall 224 of a leading transition discharger, or enters the channel between the trailing side of the wall 222 and the leading side of the wall 224 of the same transition discharger, and flows down the leading side of the wall 222 or 224, as the case may be. The rotation of the pulp lifter assembly provides a force that tends to fling the slurry back into the outer pulp lifter, but the slope of the wall 222 (or 223 and 224), particularly as the pulp lifter rotates beyond the 10 o'clock position, provides a centripetal force that resists outward movement of the slurry, and the slurry falls under the force of gravity into the inner discharger and passes towards the discharge cone.

It will be appreciated from inspection of FIGS. 10-13 that a particle that enters a channel of the transition discharger, for example at the 10 o'clock position, will be accelerated more strongly than would be the case in the event that the projecting walls were radial, as shown in FIGS. 6A-9. Accordingly, the particle attains a higher velocity before it reaches the 12 o'clock position, and there is a greater likelihood that the particle will be discharged from the pulp lifter instead of being carried over for a second revolution of the mill.

The pulp lifter assembly described with reference to FIGS. 10-13 includes only one annular array of transition dischargers 220. In a modification of the pulp lifter assembly shown in FIGS. 10-13, there may be two (or more) arrays of transition dischargers between the annular array of outer pulp lifters and the circular arrangement of inner dischargers. Thus, FIG. 14 illustrates a pulp lifter assembly including an array of outer transition dischargers 320 and an array of inner transition dischargers 340 between the pulp lifters 300 (which are essentially the same as the pulp lifters 200) and the inner dischargers 330.

As shown in FIG. 14, each outer transition discharger 320 is associated with three angularly adjacent pulp lifters 300. The center pulp lifter is associated exclusively with the outer transition discharger whereas each of the other two pulp lifters is associated with two angularly adjacent outer transition dischargers. The outer transition discharger 320 includes a back wall 321 and two walls 322, 324 projecting substantially perpendicularly to the back wall. The back wall 321 includes attachment structures (not shown) for receiving fasteners for attaching the outer transition discharger to the frame of the body of the mill. The back wall has two radial edges and inner and outer peripheral edges.

The projecting walls 322, 324 each extend the entire distance from the outer peripheral edge of the back wall 321 to the inner peripheral edge of the back wall and include attachment structures (not shown) for receiving fasteners that attach a liner (not shown, but similar in function to the liner 240 shown in FIG. 13) to the back wall of the transition discharger. Each of the projecting walls 322, 324 is curved, its leading side being concave and its trailing side being convex. The radially outer end of the leading side of the wall 322 is adjacent the trailing side of the outlet opening of the leading pulp lifter whereas the radially outer end of the leading side of the wall 324 is adjacent the trailing side of the outlet opening of the center pulp lifter. The two projecting walls 322, 324 of an outer transition discharger define a first transition channel whereas the wall 322 of a given outer transition discharger and the wall 324 of an adjacent leading outer transition discharger define a second transition channel.

The inner transition discharger 340 shown in solid lines in FIG. 14 is associated with two adjacent outer transition dischargers 320. One of the associated outer transition dischargers is illustrated in solid lines and is referred to as the aligned outer transition discharger. The other associated outer transition discharger is shown only partially, in dashed lines, and is referred to as the leading outer transition discharger. The inner transition discharger 340 includes a back wall 341 and two walls 342, 344 projecting substantially perpendicularly to the back wall. The back wall 341 includes attachment structures (not shown) for receiving fasteners for attaching the inner transition discharger to the frame of the body of the mill. The back wall has two radial edges and inner and outer peripheral edges.

The projecting walls 342, 344 each extend the entire distance from the outer peripheral edge of the back wall 341 to the inner peripheral edge of the back wall and include attachment structures (not shown) for receiving fasteners that attach a liner (not shown, but similar in function to the liner 240 shown in FIG. 13) to the back wall of the transition discharger. Each of the projecting walls 342, 344 is curved, its leading side being concave and its trailing side being convex. The radially outer end of the wall 342 is adjacent the radially inner end of the wall 322 of the aligned outer transition discharger whereas the radially outer end of the wall 344 is adjacent the radially inner end of the wall 324 of the leading outer transition discharger. The two projecting walls 342, 344 of an inner transition discharger define a first transition channel, as an extension of the second transition channel defined by the wall 322 of the aligned outer transition discharger and the wall 324 of the leading outer transition discharger, whereas the wall 344 of a given inner transition discharger and the wall 342 of the adjacent leading inner transition discharger define a second transition channel, as an extension of the first transition channel defined by the walls 322, 324 of the leading outer transition discharger.

The inner discharger 330 is associated with an aligned inner transition discharger 340 and a leading inner transition discharger and includes a back wall 331 and three walls 332, 334, 336 projecting substantially perpendicularly to the back wall. The back wall 331 includes attachment structures (not shown) for receiving fasteners for attaching the outer transition discharger to the frame of the body of the mill. The back wall has two radial edges aligned respectively with the radial edges of the back wall of the aligned inner transition discharger.

The projecting wall 334 extends from a location about half way along the outer peripheral edge of the back wall 331 to a location about half way along the trailing radial edge of the back wall 331. At its radially outer end, the wall 334 is aligned with the radially inner end of the wall 344 of the aligned inner transition discharger. The projecting wall 332 is of similar configuration to the wall 334, but extends from a location in the region of the leading end of the outer peripheral edge of the back wall to a location about half way between the outer peripheral edge of the back wall and the radially inner edge of the wall 331 and about half way between the radial edges of the back wall. The projecting wall 336 extends from a location about half way along the leading radial edge of the back wall to a location near the radially inner region of the back wall. At its radially outer end, the wall 336 is aligned with the radially inner end of the wall 334 of the leading inner discharger. Each of the projecting walls is curved, its leading side being concave and its trailing side being convex.

The two projecting walls 334, 332 of an inner discharger define a first discharger channel, as an extension of the second transition channel defined by the wall 344 of the aligned inner transition discharger and the wall 342 of the leading inner transition discharger, whereas the wall 332 of a given inner discharger and the wall 334 of the adjacent leading inner discharger define a second discharger channel, as an extension of the first transition channel defined by the walls 342, 344 of the leading inner transition discharger. It will be noted that the discharger channels cross the radial boundary between adjacent inner dischargers 330.

It will be appreciated that because the projecting walls of the transition dischargers and the inner dischargers are configured so that the inner end of each wall trails the outer end of the wall, and in particular is curved so that the leading side of the wall forming the following boundary of a channel is inclined to the radius at a greater angle at radially outward positions than at radially inward positions, a particle that enters a channel of an outer transition discharger, for example at the 10 o'clock position, will continue to be accelerated by gravity as the mill rotates even when the particle enters the discharger 330. Accordingly, the particle attains a higher velocity before it reaches the 12 o'clock position than it would in the case of the pulp lifter shown in FIGS. 6A-9, and there is a greater likelihood that the particle will be discharged from the pulp lifter instead of being carried over for a second revolution of the mill.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Numbers provided in flow charts and processes are provided for clarity in illustrating steps and operations and do not necessarily indicate a particular order or sequence. Unless otherwise defined, the term "or" can refer to a choice of alternatives (e.g., a disjunction operator, or an exclusive or) or a combination of the alternatives (e.g., a conjunction operator, and/or, a logical or, or a Boolean OR).

Figure 6B:
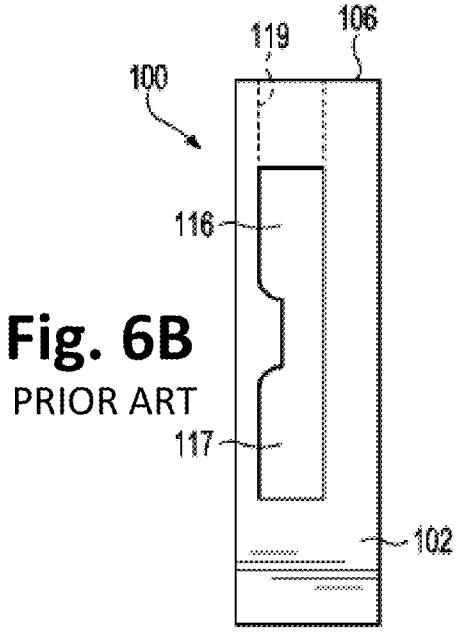
Fig. 6B PRIOR ART
FIG. 6B illustrates a view of the component shown in FIG. 6A taken on the line 6B-6B of FIG. 6A.
Figure 6A:
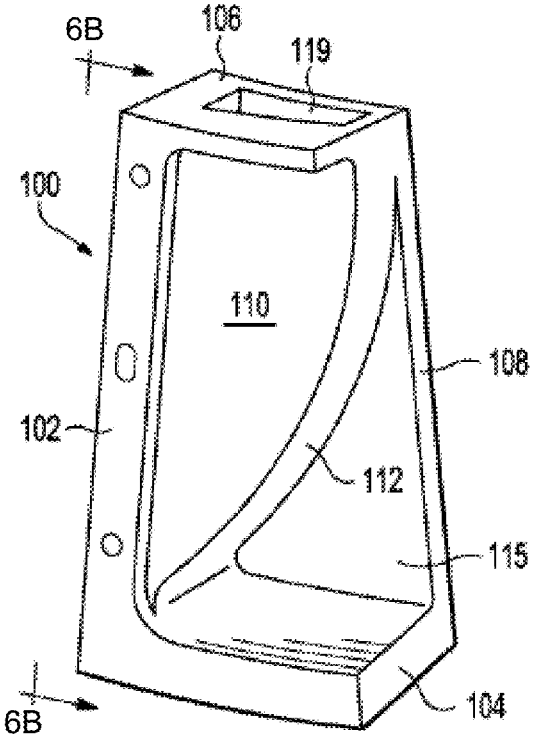
Fig. 6A PRIOR ART
FIG. 6A illustrates a perspective view of a component of a fourth pulp lifter structure.
Figure 7:
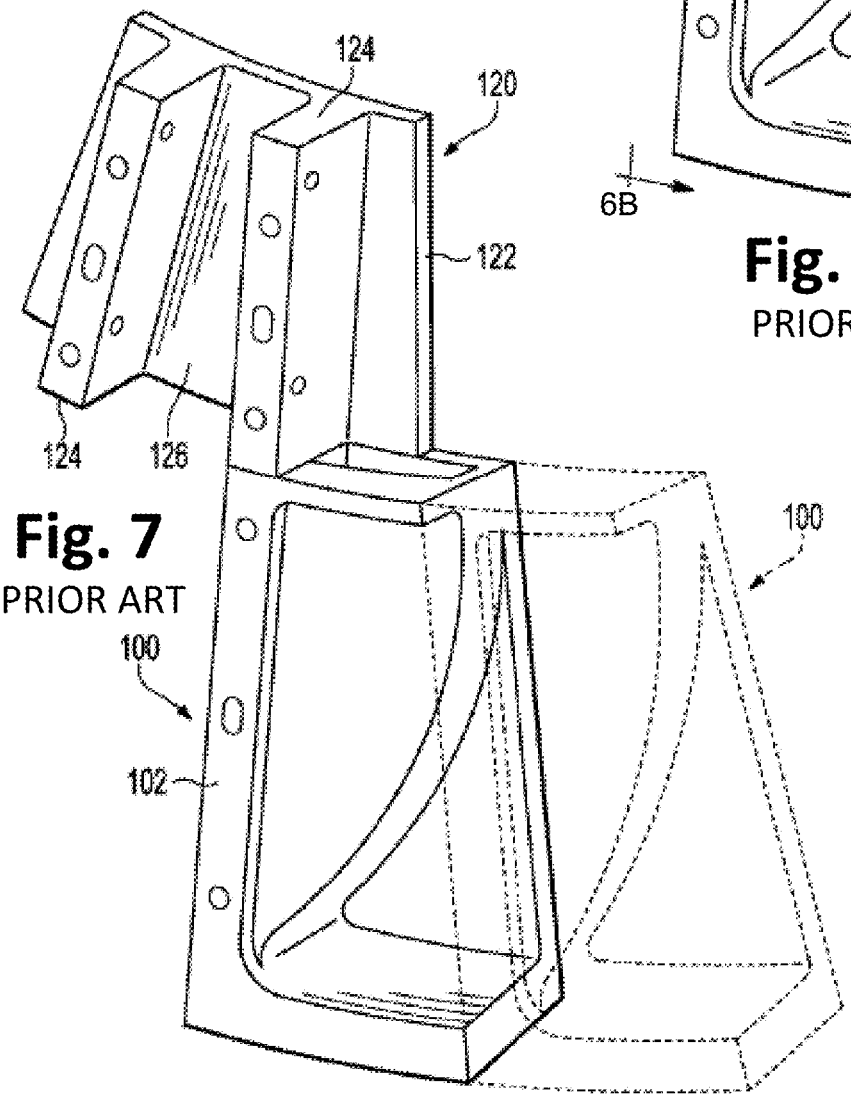
Fig. 7 PRIOR ART
FIGS. 7-9 illustrate perspective views of the fourth pulp lifter structure at different stages of assembly.
Figure 8:
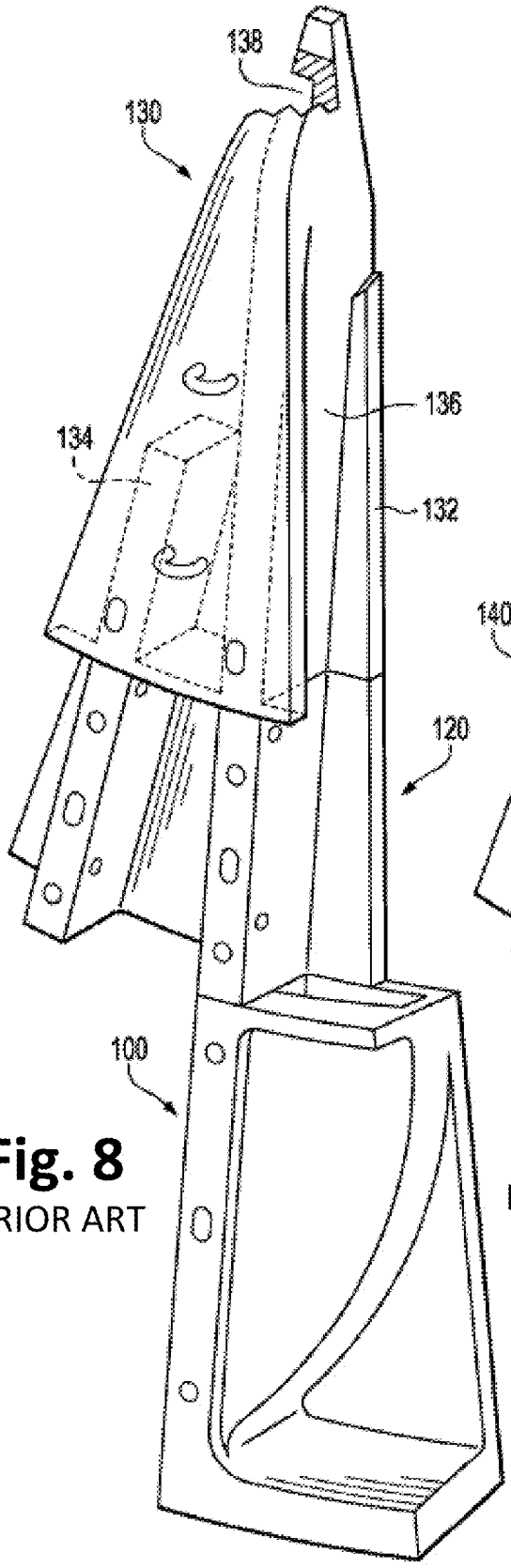
Fig. 8 PRIOR ART
Figure 9:
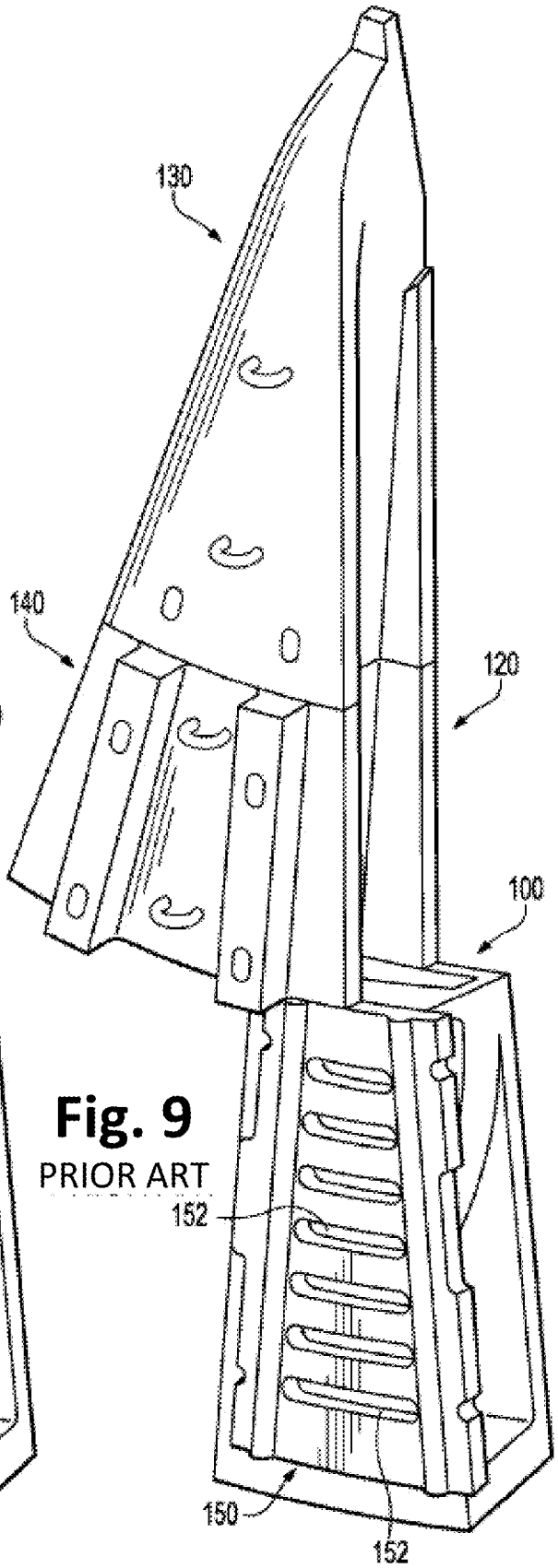
Fig. 9 PRIOR ART
Figure 10:
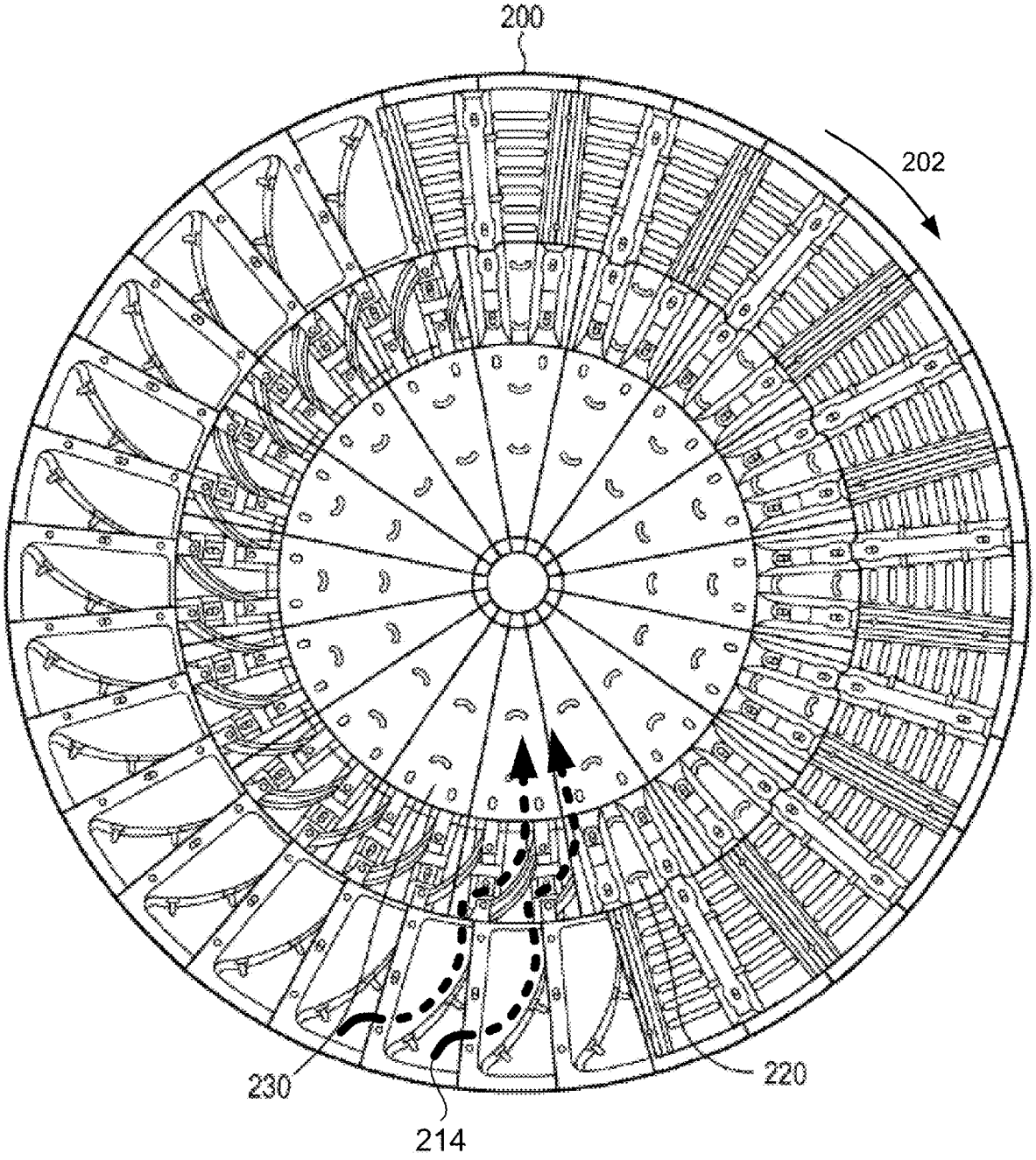
FIG. 10 illustrates a sectional view of a pulp lifter assembly of the grinding mill, similar in orientation and scope to FIG. 1B.
Figure 11:
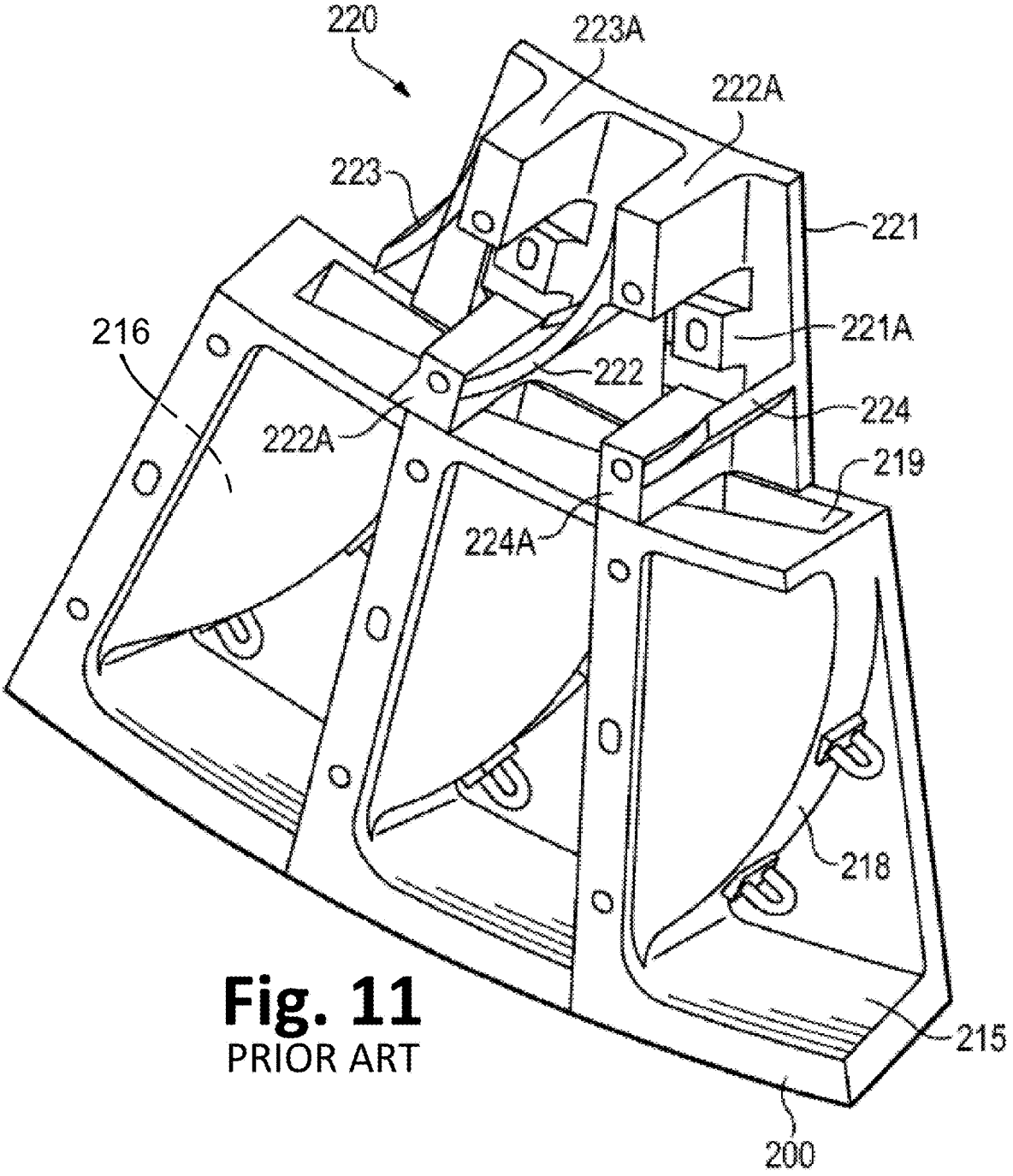
Fig. 11 PRIOR ART
FIGS. 11-13 are enlarged perspective views of the pulp lifter assembly shown in FIG. 10 at different stages of assembly.
Figure 12:
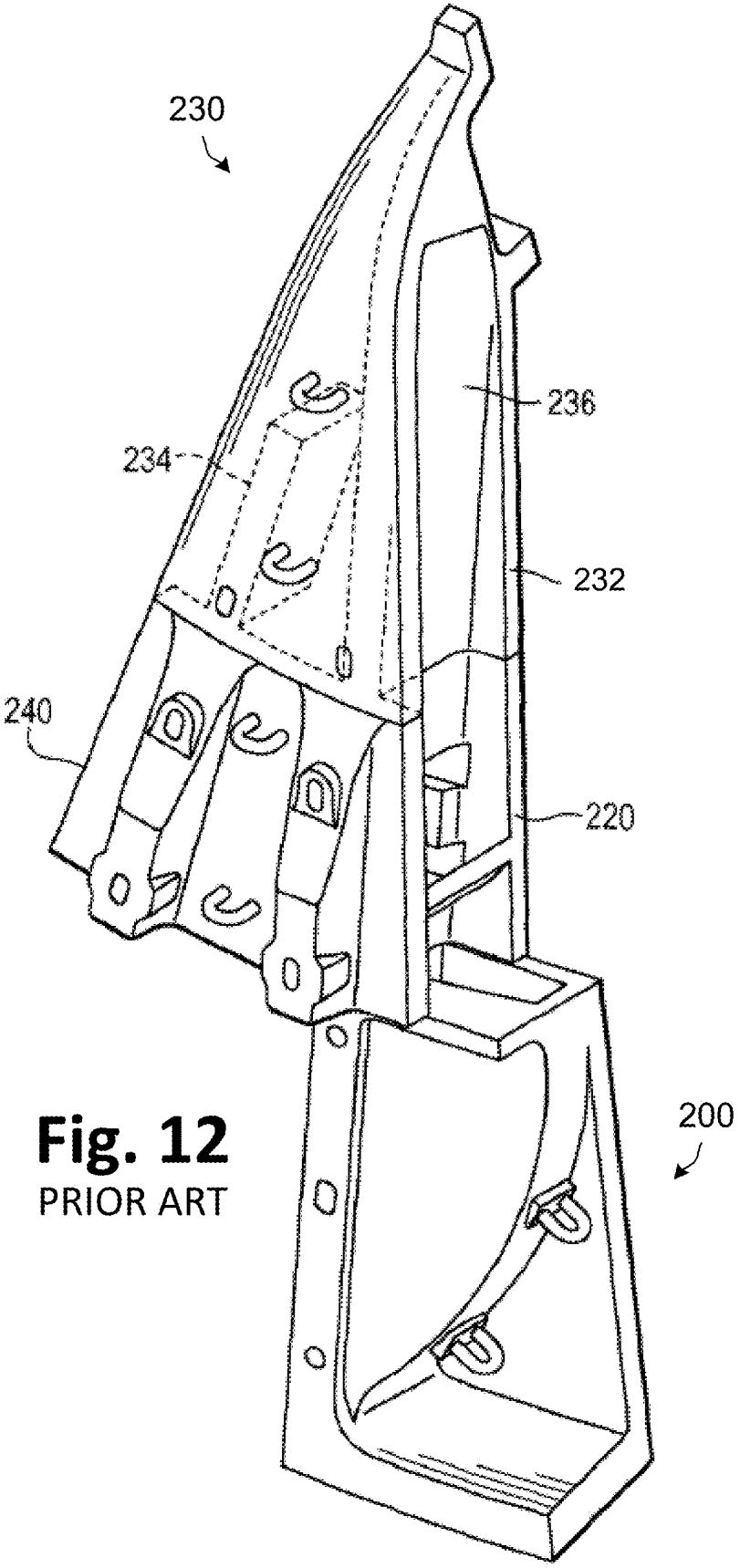
Fig. 12 PRIOR ART
Figure 13:
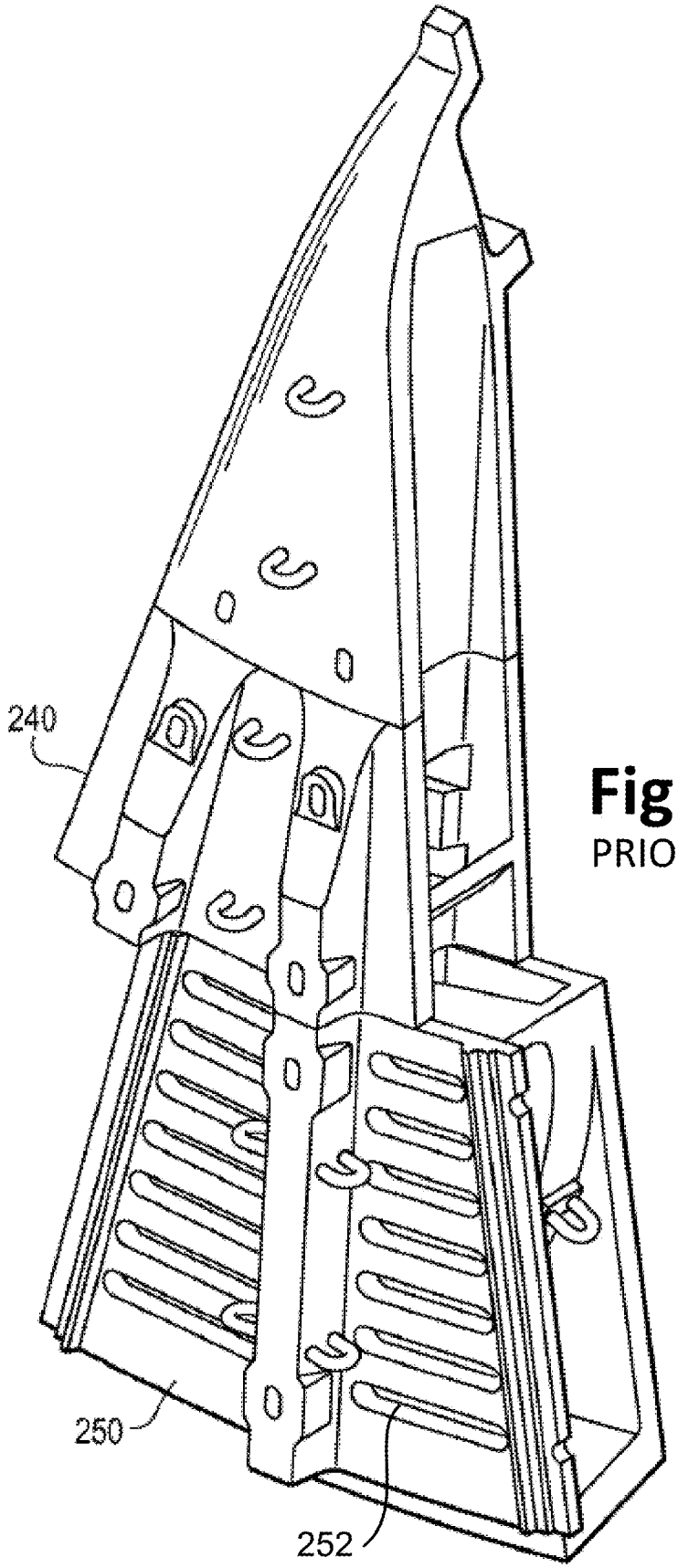
Fig. 13 PRIOR ART
Figure 14:
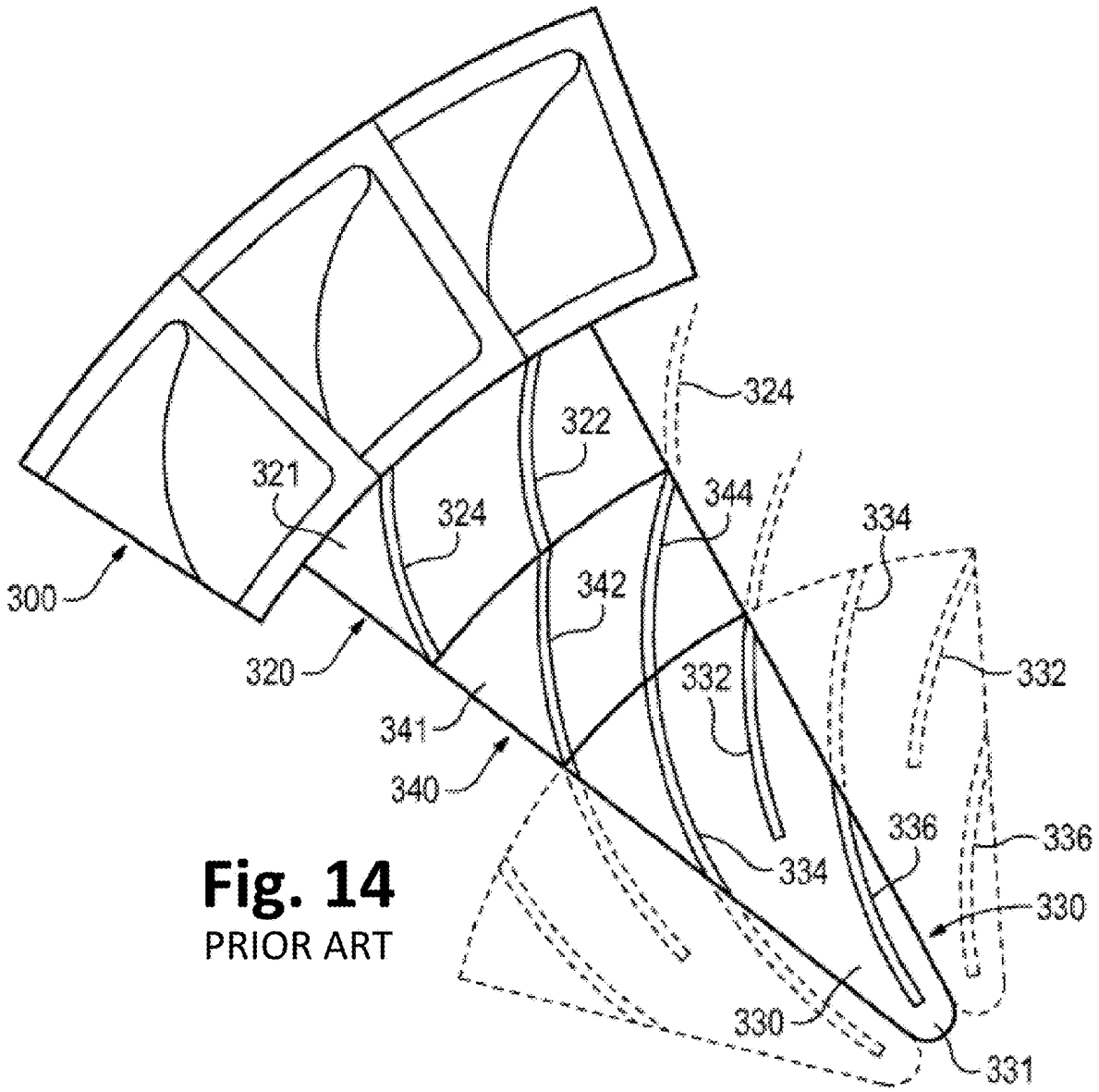
Fig. 14 PRIOR ART
FIG. 14 is an enlarged partial view of a further pulp lifter assembly.
Figure 15A:
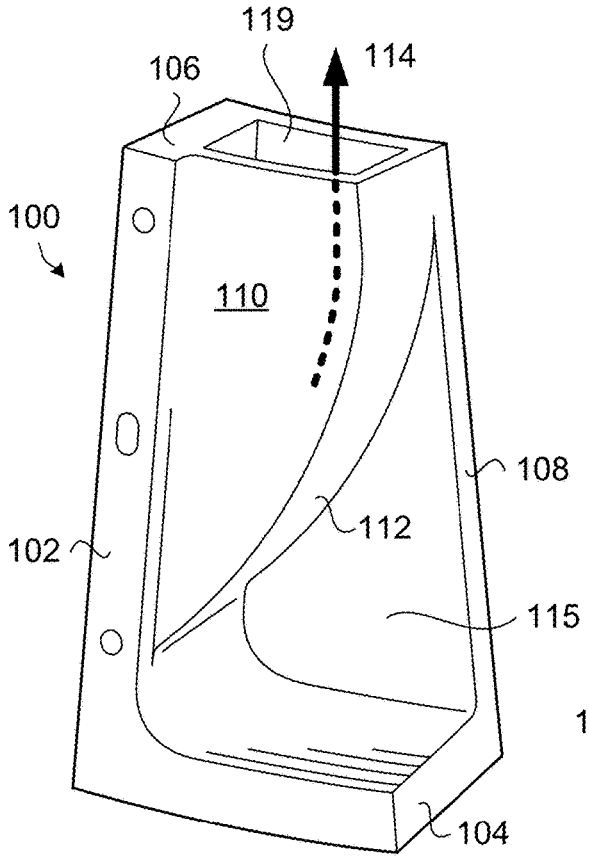
FIG. 15A illustrates a perspective view of an outer pulp lifter.
Figure 15B:
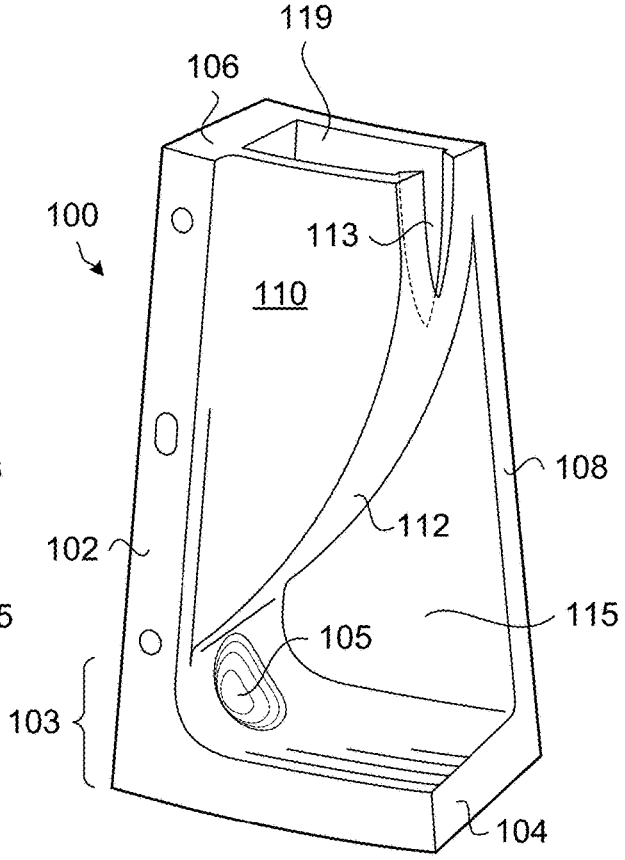
FIG. 15B illustrates a perspective view of a wear pattern in an outer pulp lifter.

FIGS. 15A-15B illustrate the outer pulp lifter 100, shown in FIG. 6A. FIG. 15A shows the direction 114 of slurry from the outlet opening 119 of the outer pulp lifter 100. FIG. 10 shows the direction 214 of slurry through the pulp lifter assembly 200 described and shown in FIGS. 10-14. Although the pulp lifter assembly 200 reduces flow back, the movement 214 of slurry changes direction substantially, multiple times through the pulp lifter assembly 200, which can reduce the velocity and flow of the slurry, resulting in less material throughput through the mill, as well as increase the wear on various components, such as the outer pulp lifter. FIG. 15B shows various areas wear in the outer pulp lifter 100. One area of wear 113 (i.e., guide wear) is in the guide 112 at the outlet opening 119 due to the friction, abrasion, and force of the material on the curved guide 112. More specifically, the slurry, pebbles, and scats (i.e., waste product) gain inward momentum due to the intimal curvature, but the material is forced to take radially inwards direction as the material approaches the exit at outlet opening 119. The restriction in the momentum of particles cause excessive wear 113, which has been observed with the pulp lifter assembly 200 described and shown in FIGS. 10-14.

The particles of the material can also accumulate on the pedestal area 103 and their probability to pass through the transfer port 117 is minimal (which can be similar accumulations in conventional radial pulp lifters). As a result, the particles continue to rattle or move inside the outer pulp lifter, which leads to impact wear 105 (i.e., pedestal wear).

The disclosed subject matter provides a pulp lifter of a pulp lifter assembly with a continuous guide profile that allows a smoother transport of slurry and pebbles towards the central discharger while still reducing backflow. In some examples, the overall curvature is concave. The continuous profile of the guide reduces the wear due to the radially inward flow in each of the pulp lifter components, which can increase the life of pulp lifters and reduce plant downtime. The pulp lifter assembly components or pulp lifter components can be formed of a hard substance or metal, such as iron or steel. In addition, the pulp lifter components may also be coated with a heavy duty polymer to provide additional protection to the components and extend the life of the components.

FIGS. 16-42D illustrate a pulp lifter with a continuum profile of the guide from an outer pulp lifter to inner discharger or discharger cone that maintains the inward momentum of the slurry, which minimizes the wear and increase the life of pulp lifters. The reduced wear of the pulp lifter results in reduced mill downtime as well lower cost due to less frequent pulp lifter component replacement.

Figure 16:
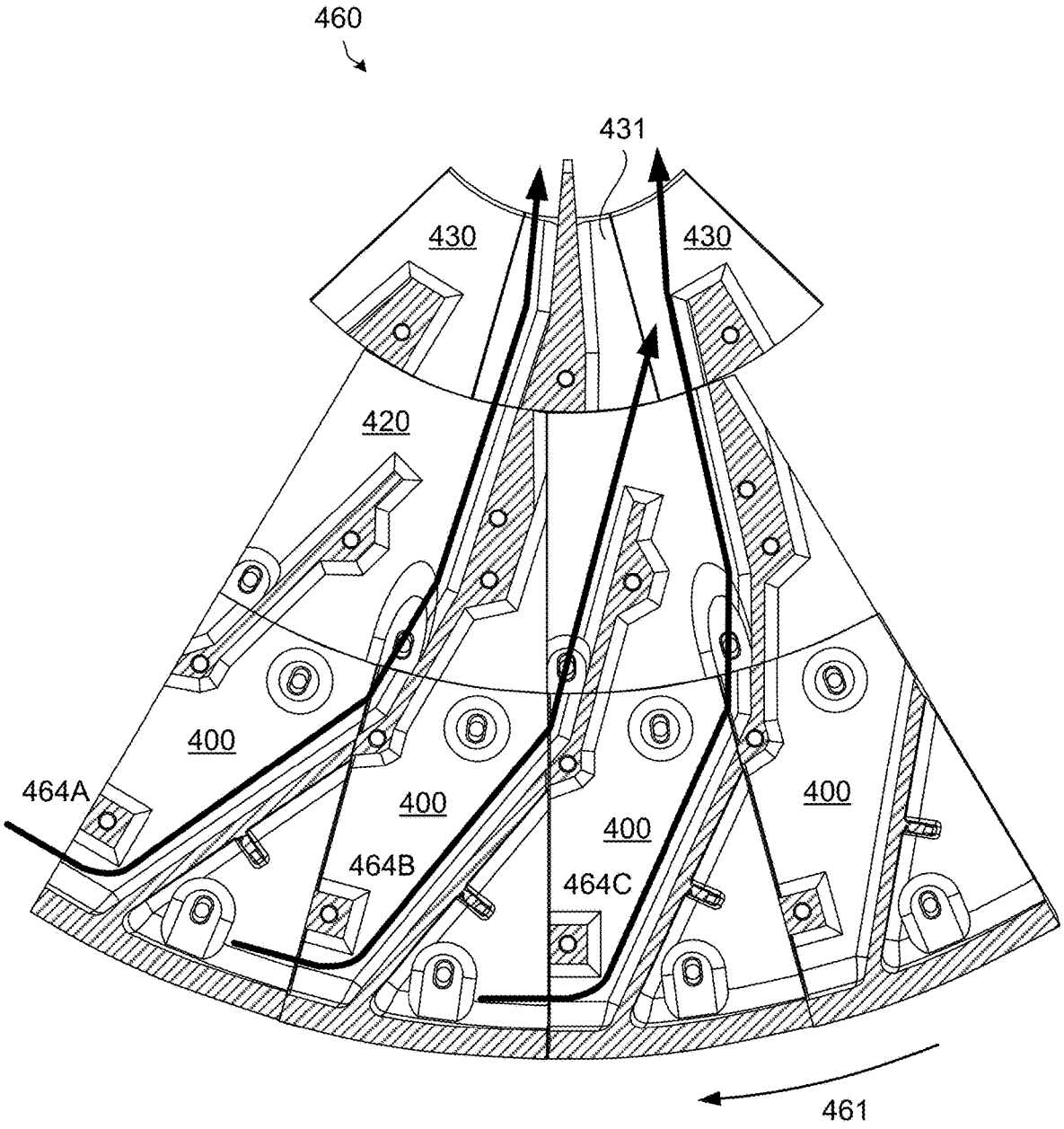
FIG. 16 illustrates a sectional view of a pulp lifter assembly of the grinding mill showing the flow of slurry, similar in orientation and scope to FIG. 10.

FIGS. 16-30 illustrate a pulp lifter assembly 460 in a semi-autogenous grinding (SAG) mill, rotary grinding mill, or mill 490 (FIG. 23) with a continuum guide for a particular bolt hole and alignment hole pattern, which may be used to retrofit to an existing bolt hole pattern of a mill, such as a bolt hole and alignment hole pattern shown in FIGS. 6A-13. The mill and a pulp lifter assembly is configured to rotate in the clockwise direction 461, referred to as the direction of rotation, with slurry designed to flow in channels defined by the structure of the pulp lifter assembly 460. The direction of slurry 464A, 464B, and 464C is shown in FIG. 16. The pulp lifter assembly 460 includes an outer pulp lifter 400, an inner pulp lifter 420, and a discharger (i.e., a long discharger 430 or a short discharger 431). As shown the guide walls of the outer pulp lifter, the inner pulp lifter, and the discharger maintain a relatively continuous guide with gradual changes in angle from the radially outer wall 404 to the discharger radial wall (i.e., a long radial wall 434 or a short radial wall 436) which directs slurry to the discharge cone.

The pulp lifter assembly 460 is shown segmented into the smaller components with 32 outer pulp lifters 400, 16 inner pulp lifters 420, and 16 dischargers, so the components can be retrofitted to the existing bolt hole pattern and alignment hole pattern shown in FIGS. 6A-13. In other examples, the number and size of the components can differ. The outer pulp lifters, inner pulp lifters, and dischargers are shown as separate components because, as a practical matter, these components are usually installed and replaced in an existing mill 490 (FIG. 23) through the opening formed by a feed trunnion 493 (FIG. 23), which has limited access because of a smaller diameter. But in other examples, two or more of these components can be integrated or formed together as a single component, or one of these components may be further segmented into smaller components.

Figure 17C:
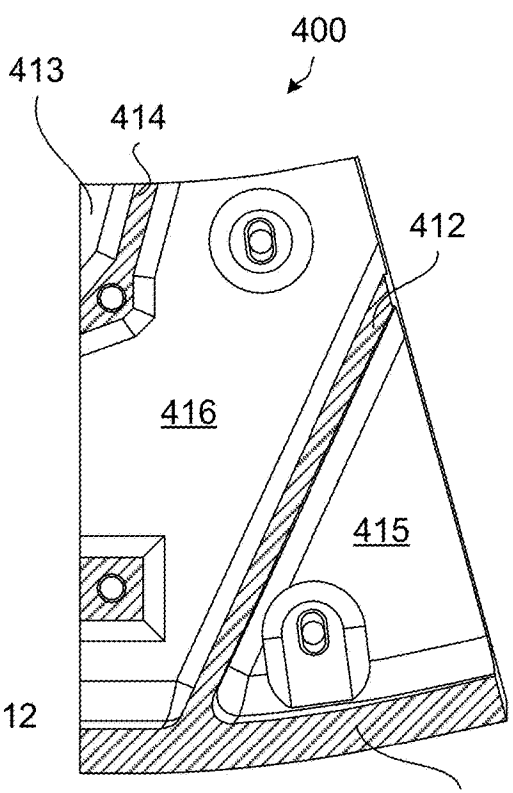
FIG. 17C illustrates a sectional view of the outer pulp lifter shown in FIGS. 17A-17B.
Figure 17B:
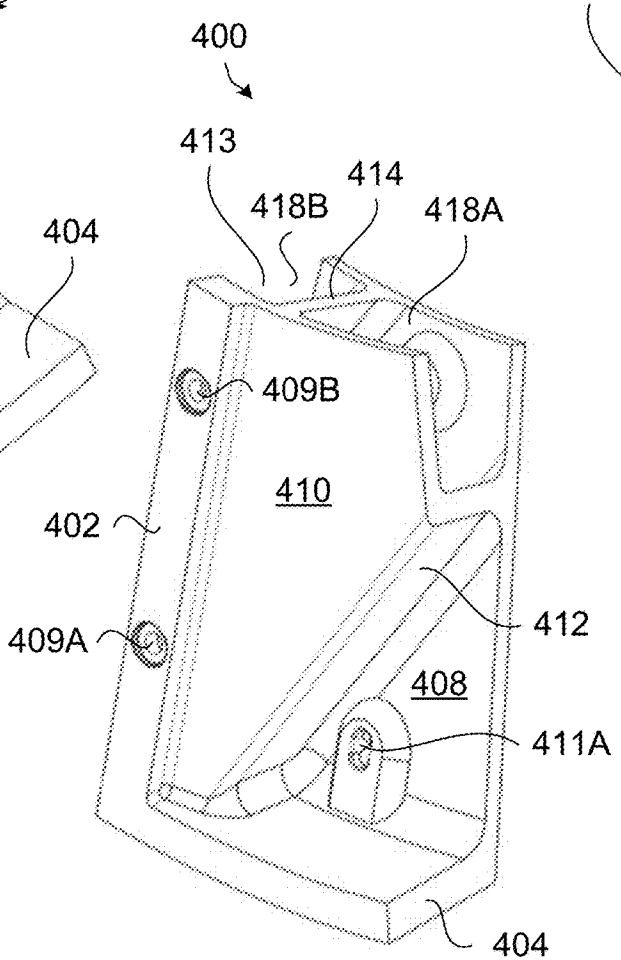
FIGS. 17A-17B illustrate perspective views of an outer pulp lifter shown in FIG. 16.
Figure 17A:
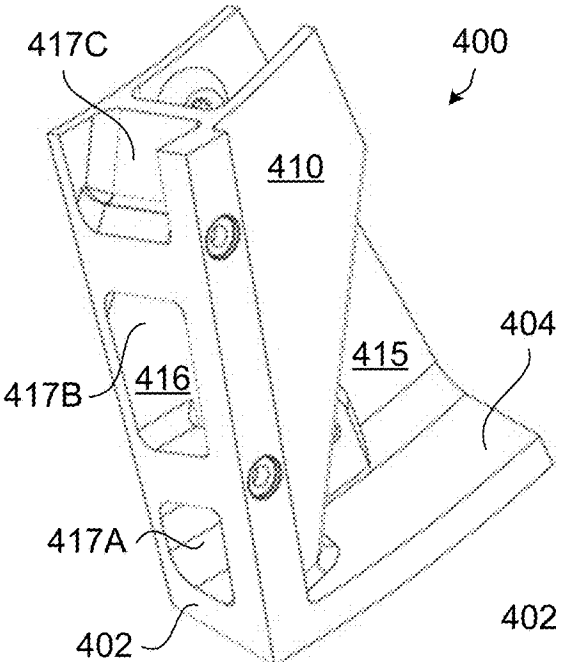
Figure 18:
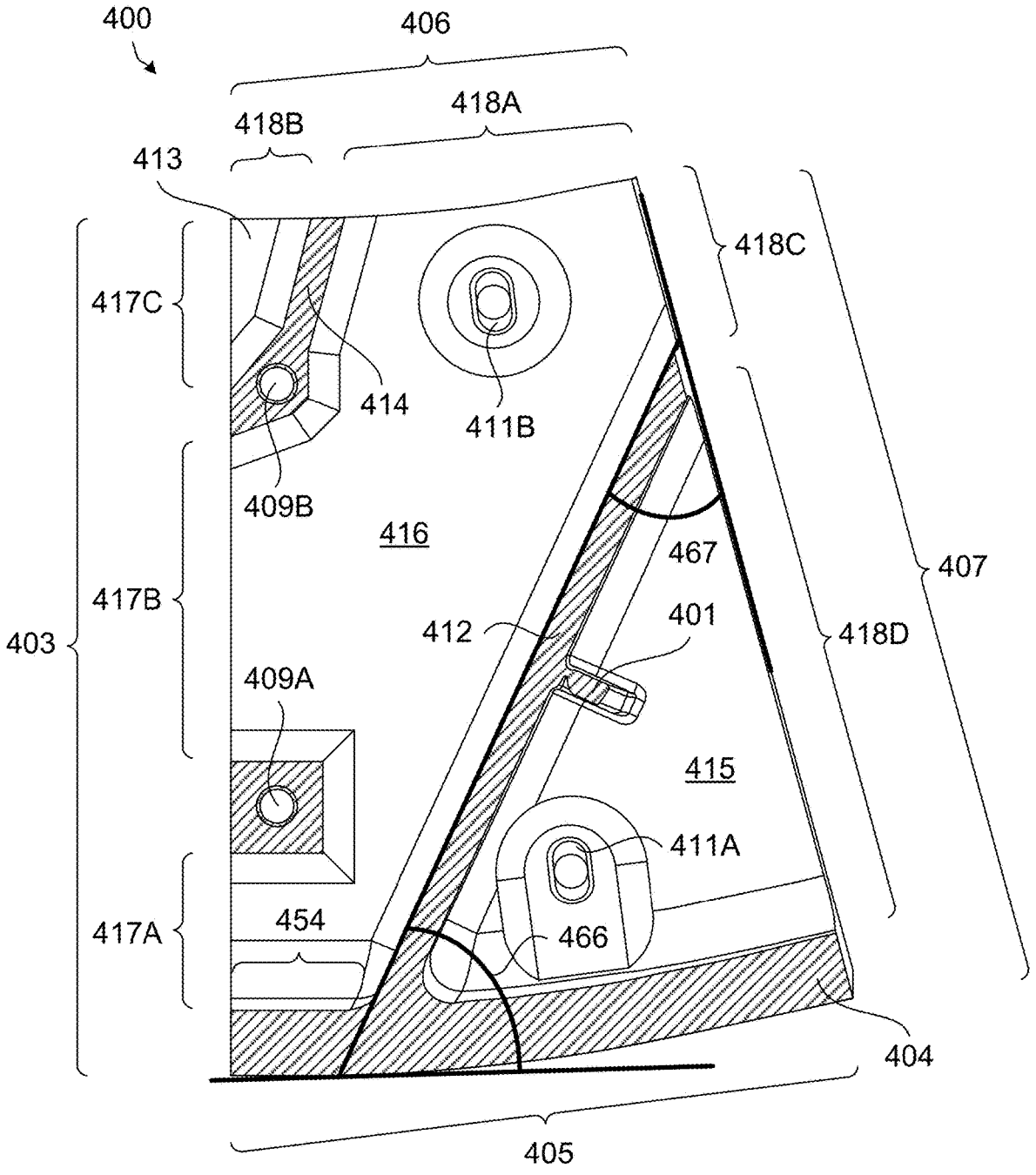
FIG. 18 illustrates another sectional view of the outer pulp lifter shown in FIGS. 17A-17C.

FIG. 17A-18 illustrate various views of an outer pulp lifter 400. The outer pulp lifter is designed to reduce flow back as previously described with other embodiments. The slurry is designed to enter through some apertures or openings 452 (FIGS. 25-26) or screening holes or slots) in the grates or grate plates 450 (FIGS. 23-26), which screens slurry with particles above the hole or slot size from entering the inlet chamber 415 of the outer pulp lifter. Particles smaller than the apertures or openings of the grate plates can flow into the inlet chamber of the outer pulp lifter. The inlet chamber is formed by an axially downstream wall or inner edge wall 408, the radially outer wall 404, a leading guide or first guide 412 on the trailing edge 407 side, a leading wall 402, and a leading wall 402 of an adjacent outer pulp lifter, and an intermediate wall 410 that partitions the inlet chamber from an outlet chamber in the axial direction.

With the rotation of the mill, the slurry is configured to flow from the inlet chamber out an outlet opening 418D through an inlet opening or transfer opening (i.e., an outer transfer opening 417A and middle transfer opening 417B) to the outlet chamber, outer outlet chamber, or main outlet chamber 416. The main outlet chamber and the inner outlet chamber 413 define the outlet chamber. The main outlet chamber is defined by the axially downstream wall or inner edge wall 408, the leading wall 402 with the transfer openings, the radially outer wall 404, a leading guide or first guide 412 on the leading edge 403 side, and the intermediate wall 410. An inner outlet chamber adjacent to the main outlet chamber may be defined by the trailing guide or second guide 414 of the adjacent outer pulp lifter, the axially downstream wall or inner edge wall 408, and the intermediate wall 410. With further rotation of the mill, the slurry is configured to flow from the main outlet chamber through inlet opening or transfer opening 417C and outlet openings 418A, 418B, 418C to an inner pulp lifter 420. The slurry flows in a spiral pattern from a radially outer edge 405 to a radially inner edge 406 and from the leading edge 403 to the trailing edge 407.

The leading guide or first guide 412 extends at an angle 466 (outer pulp lifter guide angle or outer pulp lifter outer segment guide angle) tangent to the radially outer wall 404. The leading guide 412 separated from the leading edge of the leading wall 402 of outer pulp lifter 400 by a shortest distance 454 (from leading edge to the leading guide). As a result, in some example, more area is available for the transfer opening in the leading wall, such as between the radially outer wall 404 and the outer bolt hole 409A (e.g., outer transfer opening 417A), which can increase the slurry flow of the mill. The outer pulp lifter guide angle is an acute angle that can range from 30° to 80° depending of the diameter of the mill and the rotational speed of the mill. The outer pulp lifter guide angle, mill diameter, and mill rotational speed can be designed to provide a high (or greater) flow rate. If the mill rotational speed is too fast, the centrifugal force causes the slurry to "stick" to the radially outer edge 405 of the outer pulp lifter or does not enough slurry to flow into the inlet chamber. If the mill rotational speed is too slow, the mill does not process slurry at its full capacity. The rotational speed that provides approximately the most slurry flow is referred to as the terminal velocity. The leading guide or first guide can also have an acute angle (e.g., outer pulp lifter inner segment guide angle 467) with the trailing edge 407 of the pulp lifter.

Figure 1B:
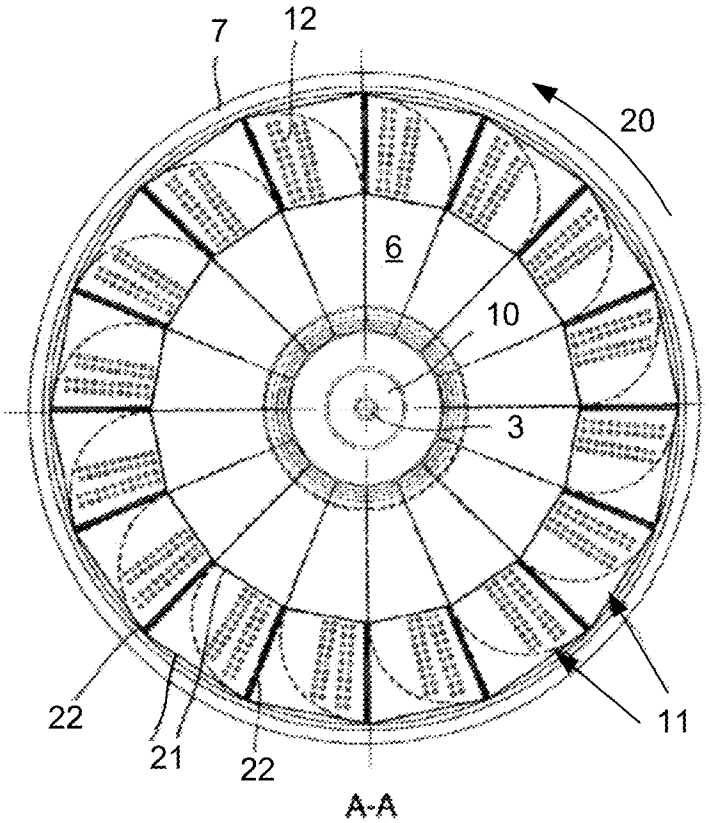
Fig. 1B PRIOR ART
FIG. 1B illustrates a sectional view of the grinding mill taken on the line A-A of FIG. 1A.
Figure 1A:
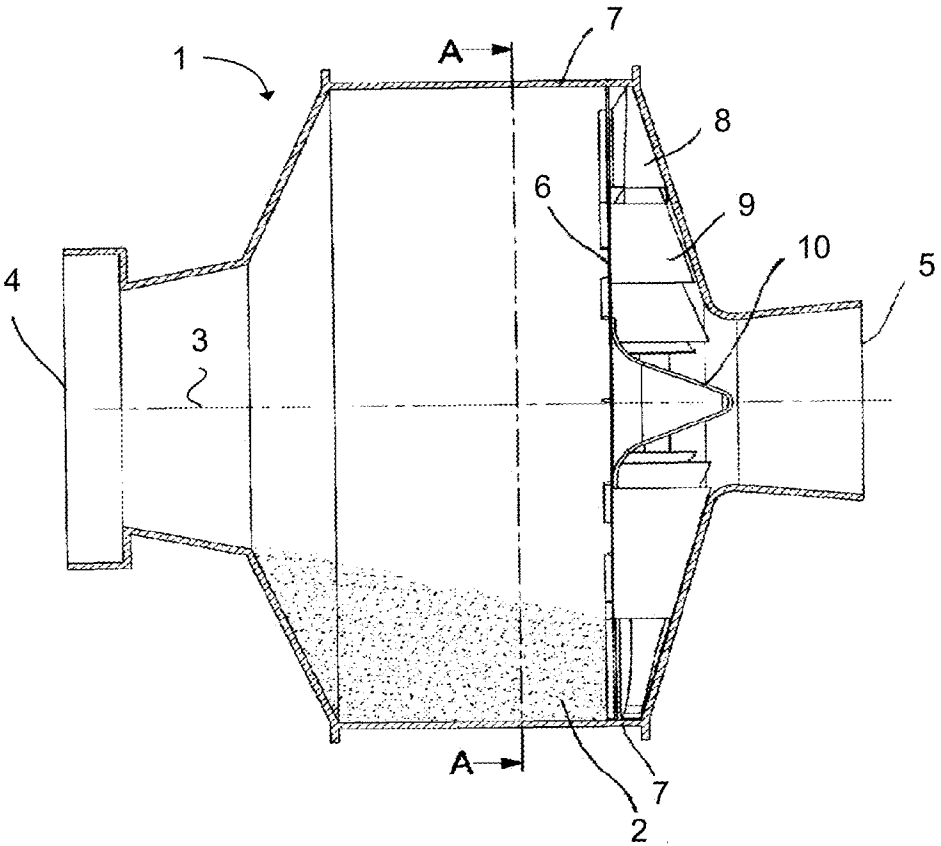
Fig. 1A PRIOR ART
FIG. 1A illustrates a sectional side view of a rotary grinding mill.
Figure 2:
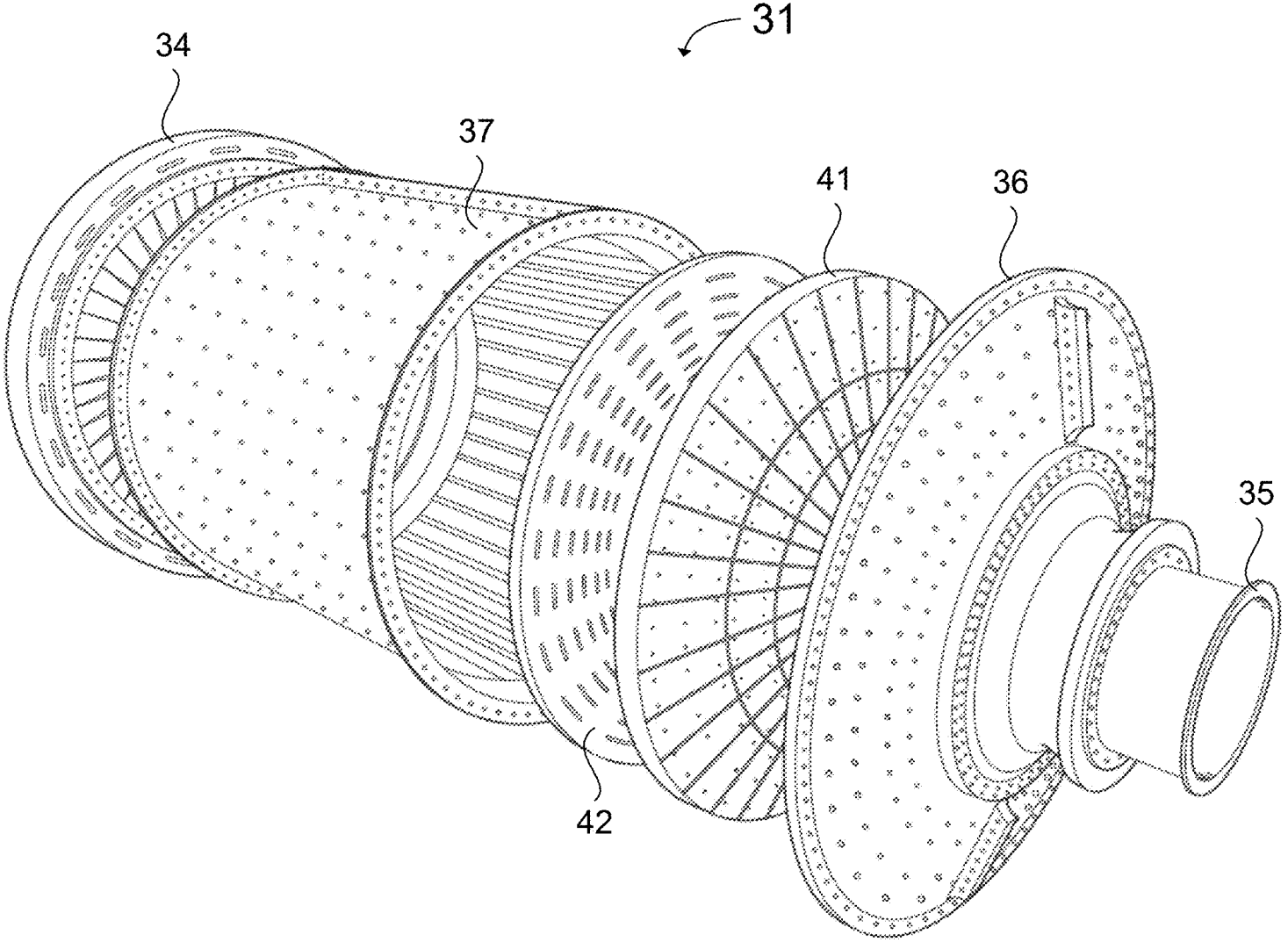
FIG. 2 illustrates a perspective view of a second rotary grinding mill.
Figure 3C:
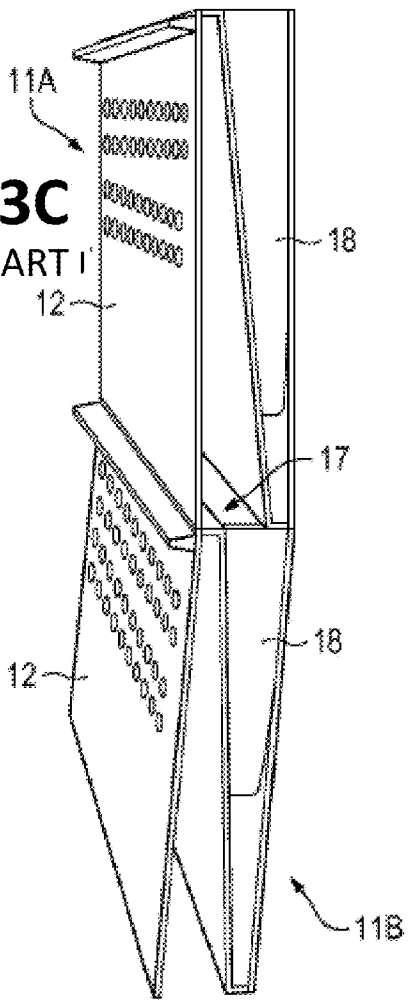
Fig. 3C PRIOR ART
FIG. 3C illustrates a perspective side view of the structure of FIG. 3A.
Figure 3B:
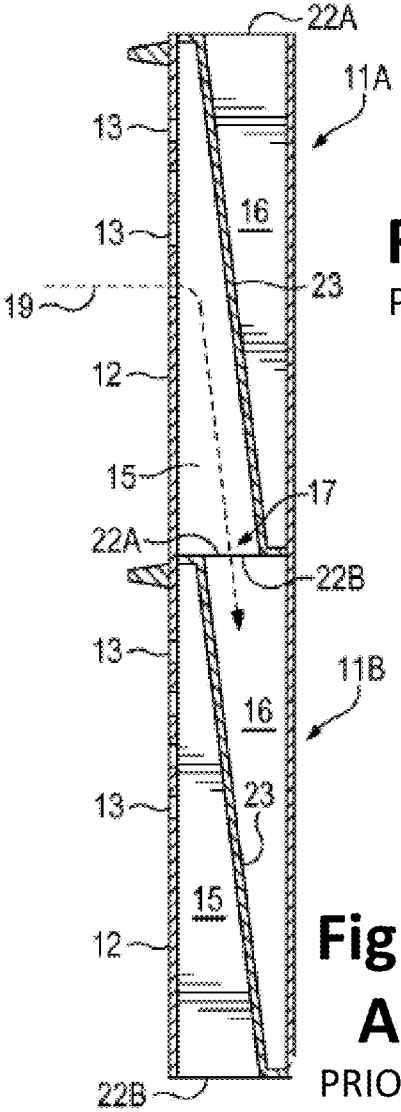
FIG. 3B illustrates the structure of FIG. 3A in section taken on the line B-B.
Figure 3A:
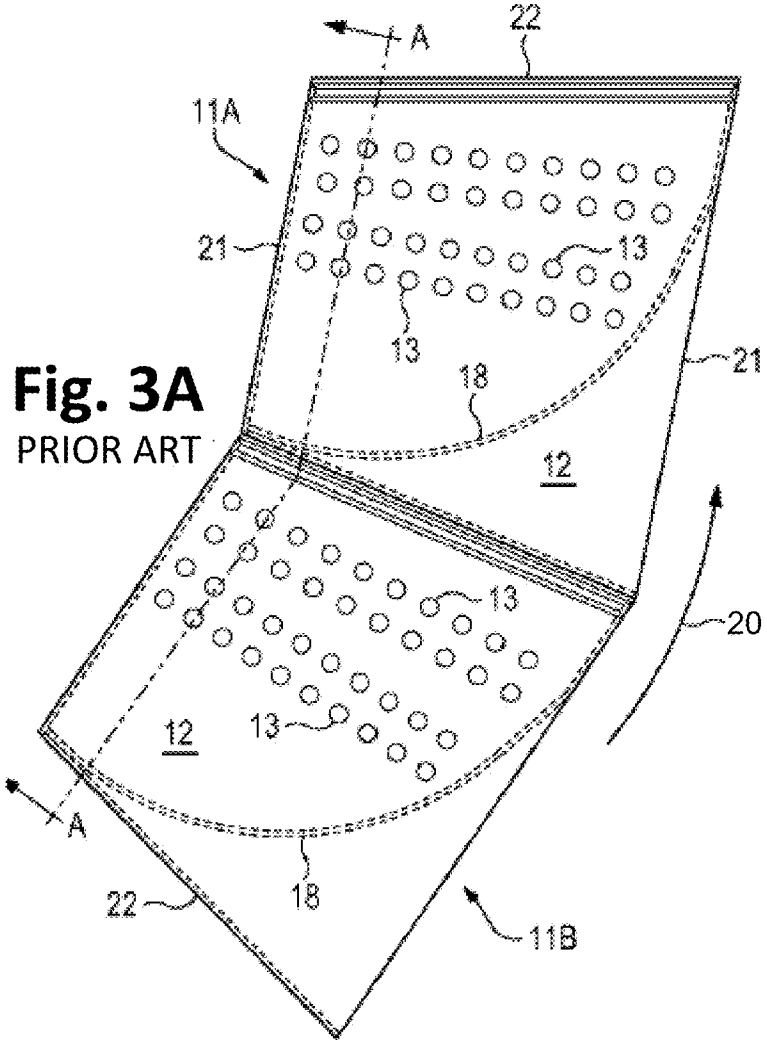
Fig. 3A PRIOR ART
FIG. 3A illustrates a schematic front view of two pulp lifter units of the grinding mill shown in FIGS. 1A-1B.
Figure 4:
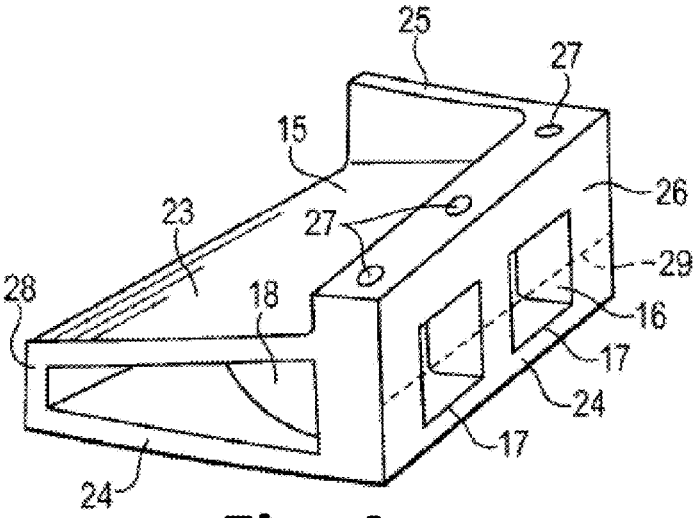
Fig. 4 PRIOR ART
FIG. 4 illustrates a perspective view of a second pulp lifter.
Figure 5A:
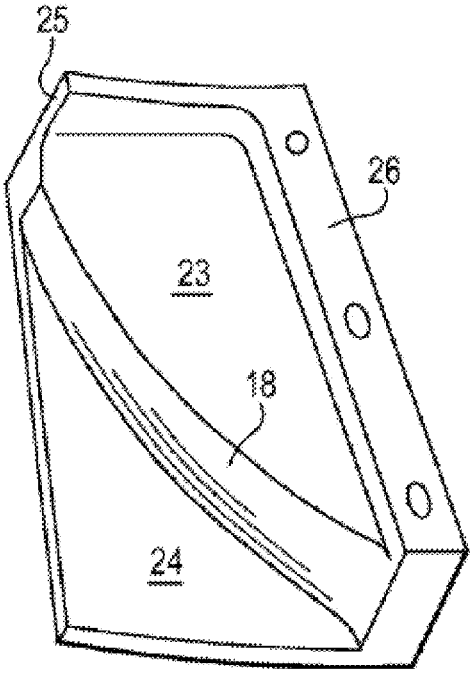
Fig. 5A PRIOR ART
FIG. 5A illustrates a perspective view of a third pulp lifter.
Figure 5B:
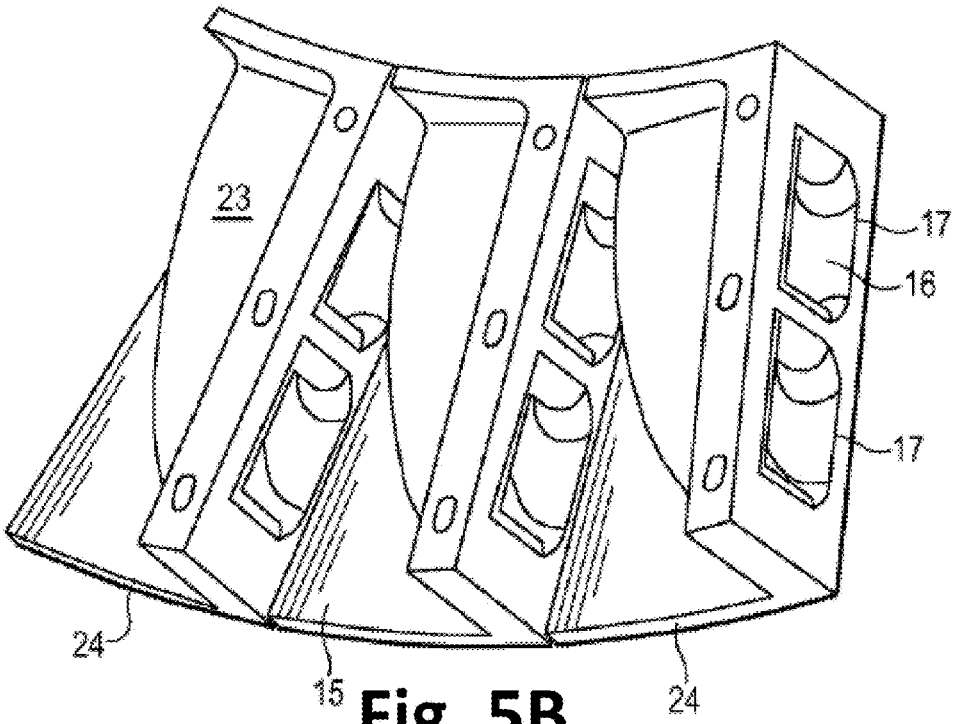
Fig. 5B PRIOR ART
FIG. 5B illustrates a perspective view illustrating the manner in which the pulp lifter shown in FIG. 5A cooperates with other pulp lifters of similar structure.

The outer pulp lifter can be designed with other features to assist with the installation and repair of the outer pulp lifters. For example, any of the pulp lifter assembly components can include a lifting eye (e.g., lifting eye 401 on the outer pulp lifter), which can be hooked to a cable of a lifting device, such as winch or crane. Any of the pulp lifter assembly components can include an alignment hole (e.g., outer alignment hole 411A or inner alignment hole 411B in the outer pulp lifter) to align the pulp lifter assembly components to posts or studs in a discharge end plate (36 of FIG. 2 or 794 of FIG. 38B). Alternatively, the discharge end plate may have openings for alignment bolts. As shown the alignment hole may be larger than the posts or studs (or alignment bolts) so allow the pulp lifter assembly components (e.g., the outer pulp lifter to shift or rotate relative to the discharge end plate so the bolt holes can align with the openings in the discharge end plate. The grate plate 450 and the outer pulp lifter 400 can be secured to the discharge end plate using bolts that pass through bolt holes (e.g., outer bolt hole 409A or inner bolt hole 409B in the outer pulp lifter, specifically in the leading wall). The outer pulp lifter with the inlet chamber and outlet chamber provides the primary mechanism for flow back reduction.

Figure 19A:
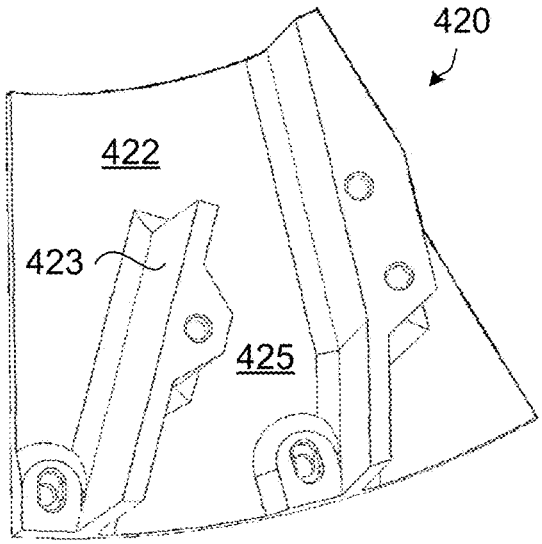
FIGS. 19A-19B illustrate perspective views of an inner pulp lifter shown in FIG. 16.
Figure 19B:
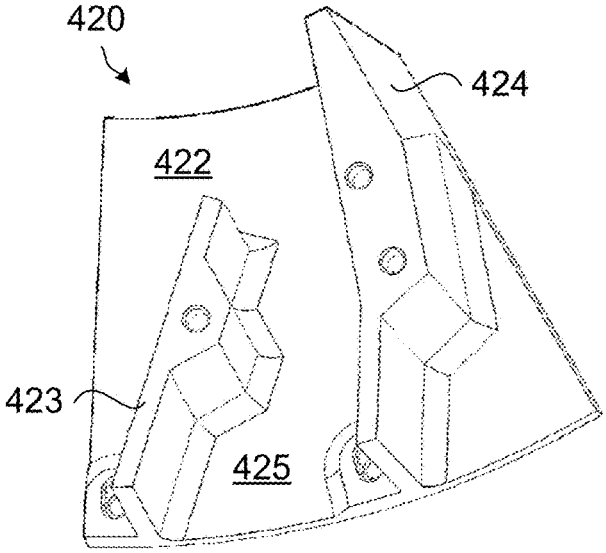
Figure 19C:
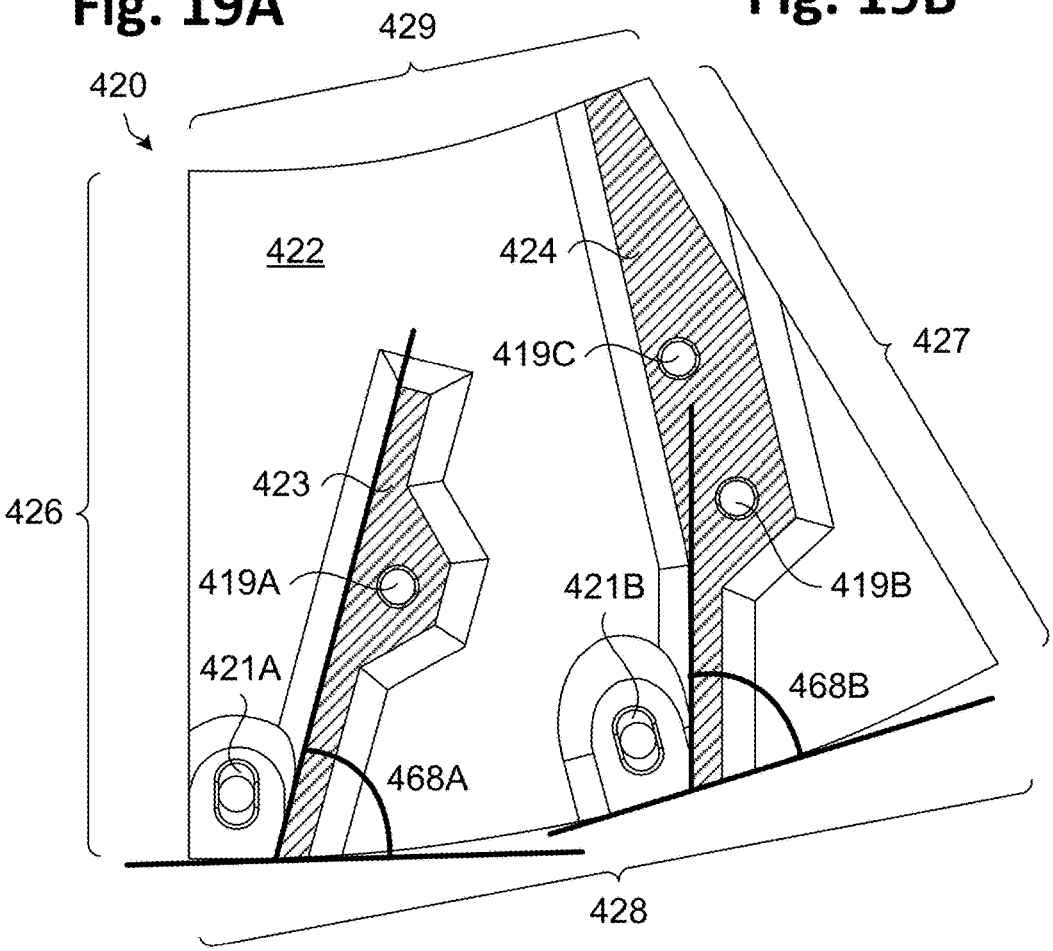
FIG. 19C illustrates a sectional view of the inner pulp lifter shown in FIGS. 19A-19B.
Figure 22:
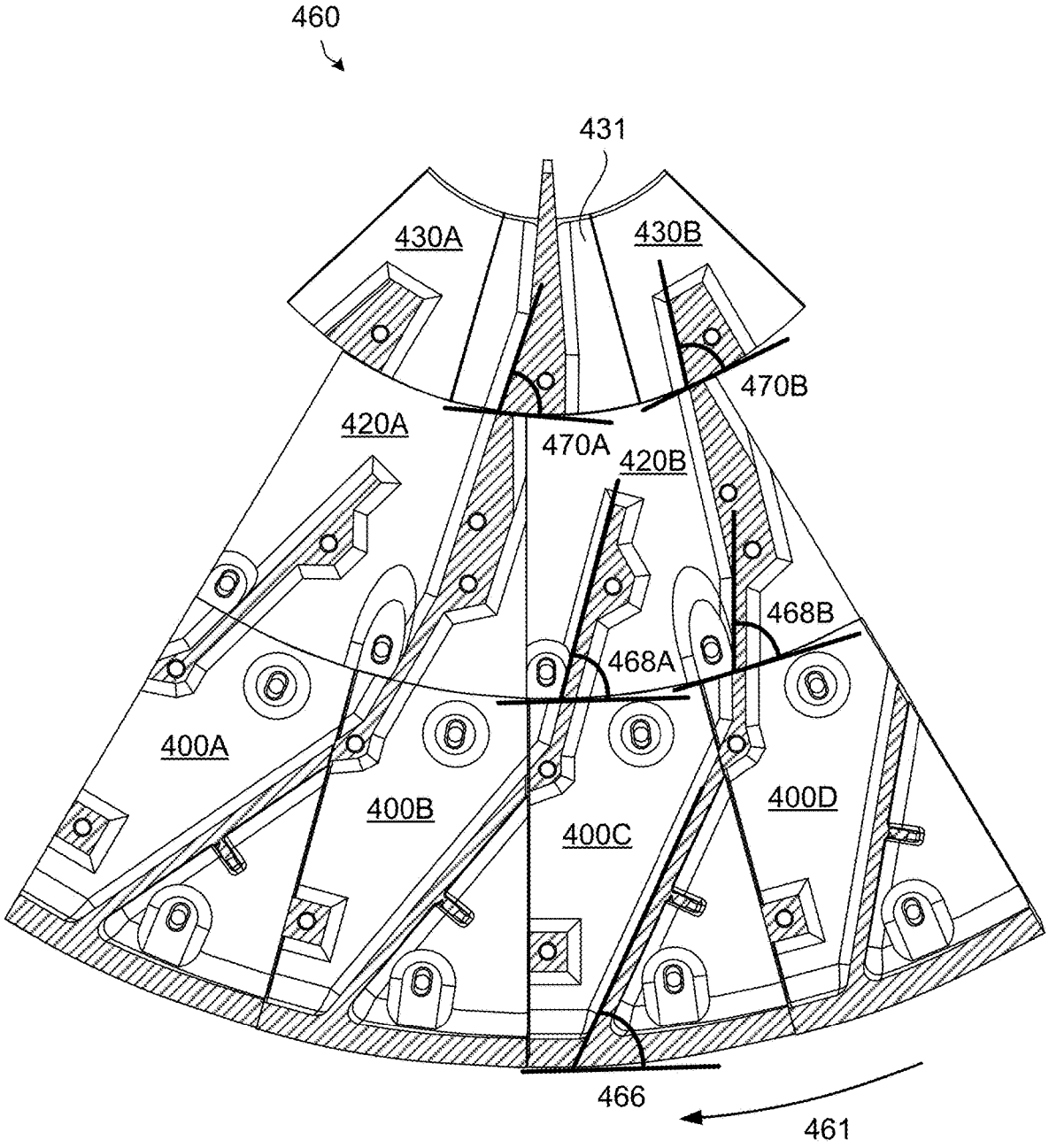
FIG. 22 illustrates a sectional view of the pulp lifter assembly of the grinding mill shown in FIG. 16 with guide and radial wall angles.

After the slurry exits the outlet chamber 413 and 416 of the outer pulp lifter, the slurry flows through channels 425 formed by the walls (e.g., a short radial wall or leading radial wall 423 or long radial wall, trailing radial wall, or following radial wall 424) of the inner pulp lifter 420, as shown in FIGS. 19A-19C. The short radial wall and long radial wall are supported by an axially downstream wall 422. Similar to the outer pulp lifter, the inner pulp lifter includes a leading edge 426, a trailing edge 427, a radially outer edge 428, and a radially inner edge 429, with the edges aligning with adjacent pulp lifter assembly components. The radial walls extend at an acute angle (e.g., inner pulp lifter guide angles) from a tangent to the radially outer edge of the inner pulp lifter. A leading inner pulp lifter guide angle 468A is an acute angle from the short radial wall or leading radial wall 423 to a tangent to the radially outer edge of the inner pulp lifter. A trailing inner pulp lifter guide angle 468B is an acute angle from the short radial wall or leading radial wall 423 to a tangent to the radially outer edge of the inner pulp lifter. In an example, the leading inner pulp lifter guide angle 468A and trailing inner pulp lifter guide angle 468B have an angle equal to or greater than the outer pulp lifter guide angle or outer pulp lifter outer segment guide angle 466. The comparison of some of the angles (e.g., 266) from the outer pulp lifter 400, some of the angles (e.g., 268A-B) from the inner pulp lifter 420, and some of the angles (e.g., 270A-B) from the dischargers is shown in FIG. 22. In an example to provide a continuum guide with high volume slurry flow (or faster slurry flow), angles between the outer pulp lifter, inner pulp lifter, and the dischargers make a gradual shift in their angles with an outer pulp lifter angle 266 being smaller than an inner pulp lifter angle 268A or 268B, and the inner pulp lifter angle 268A or 268B being smaller than an discharger angle 270A or 270B.

Referring back to FIGS. 19A-19C, the inner pulp lifter 420 can include alignment holes (e.g., leading alignment hole 421A and trailing alignment hole 421B) to align the pulp lifter assembly components to posts or studs in a discharge end plate. The center liner 448, which is a solid relatively flat piece (usually without apertures or openings for slurry flow), and the inner pulp lifter 420 can be secured to the discharge end plate using bolts that pass through bolt holes (e.g., short bolt hole 419A, outer long bolt hole 419B, and inner long bolt hole 419C in the inner pulp lifter).

Figure 20A:
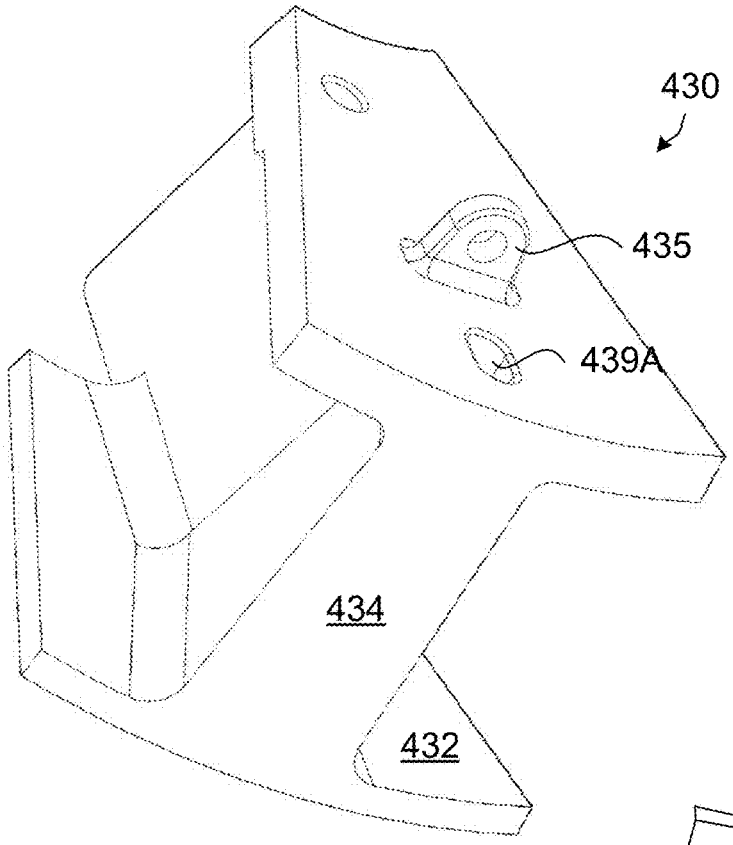
FIG. 20A illustrates a perspective view of a discharger with a long radial wall shown in FIG. 16.
Figure 20B:
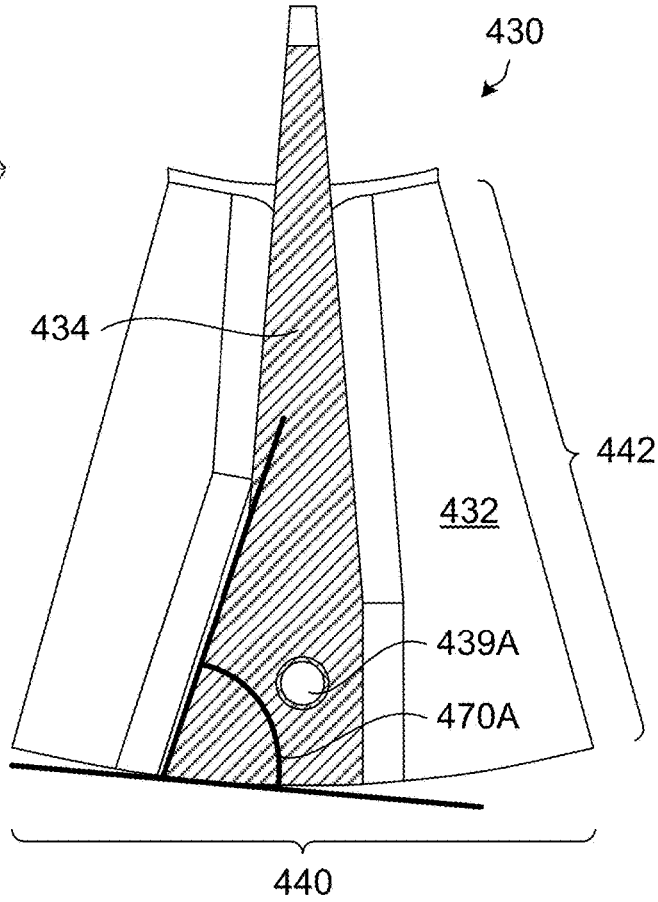
FIG. 20B illustrates a sectional view of the discharger with a long radial wall shown in FIG. 20A.

After the slurry exits the channels 425 of the inner pulp lifter, the slurry flows towards the discharger cone through channels formed by the radial walls (e.g., a long radial wall 434 or a short radial wall 436) of the dischargers. FIGS. 20A-20B illustrates a long discharger 430 with a long radial wall 434. The long radial wall is supported by axially downstream wall 432, which can be coupled to the discharge end plate. The long discharger has a long discharger radially outer edge 440 and long discharger trailing edge 442 (as well as a leading edge and radially inner edge). The long radial wall includes a bolt hole (e.g., long bolt hole 439A) as well as a lifting eye 435. The long discharger guide angle 470A is an acute angle from the long radial wall 434 to a tangent to the radially outer edge of the long discharger.

Figure 21A:
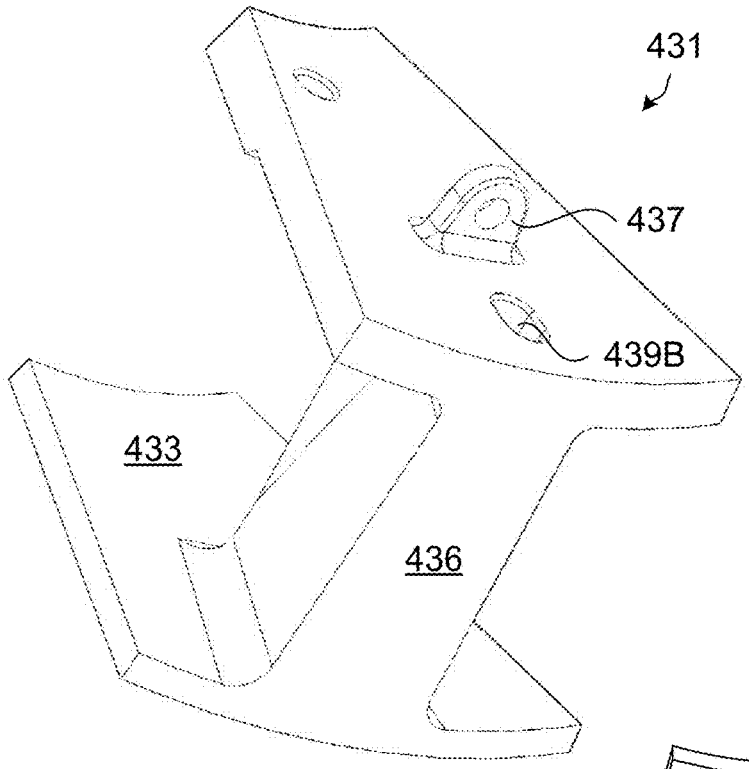
FIG. 21A illustrates a perspective view of a discharger with a short radial wall shown in FIG. 16.
Figure 21B:
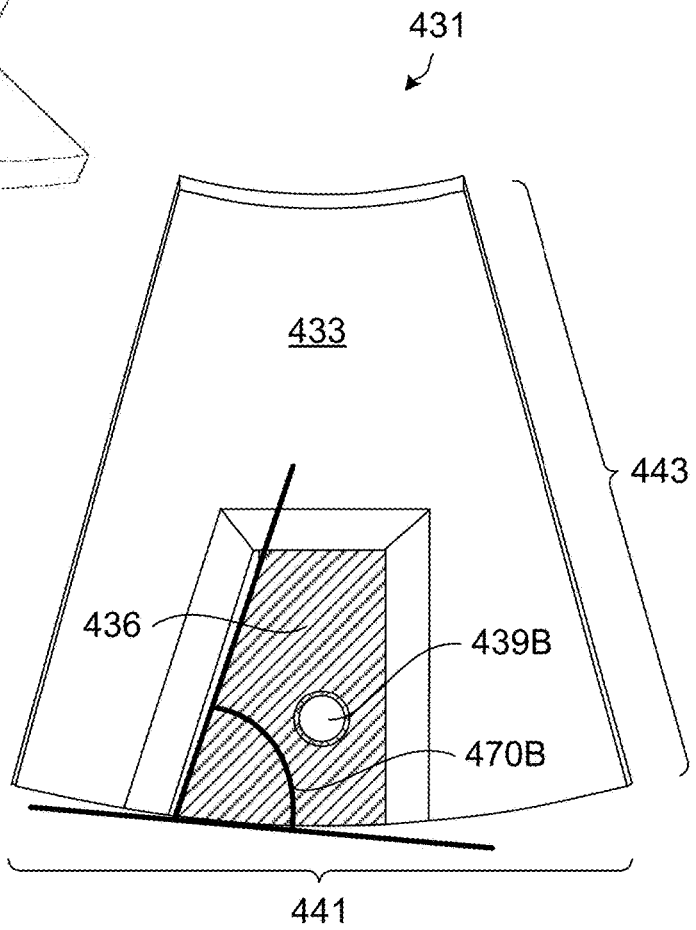
FIG. 21B illustrates a sectional view of the discharger with a short radial wall shown in FIG. 21A.

FIGS. 21A-21B illustrates a short discharger 431 with a short radial wall 436. The short radial wall is supported by axially downstream wall 433, which can be coupled to the discharge end plate. The short discharger has a short discharger radially outer edge 441 and short discharger trailing edge 443 (as well as a leading edge and radially inner edge). The short radial wall includes a bolt hole (e.g., short bolt hole 439B) as well as a lifting eye 437. The long discharger guide angle 470A is an acute angle from the long radial wall 434 to a tangent to the radially outer edge of the long discharger.

Figure 23:
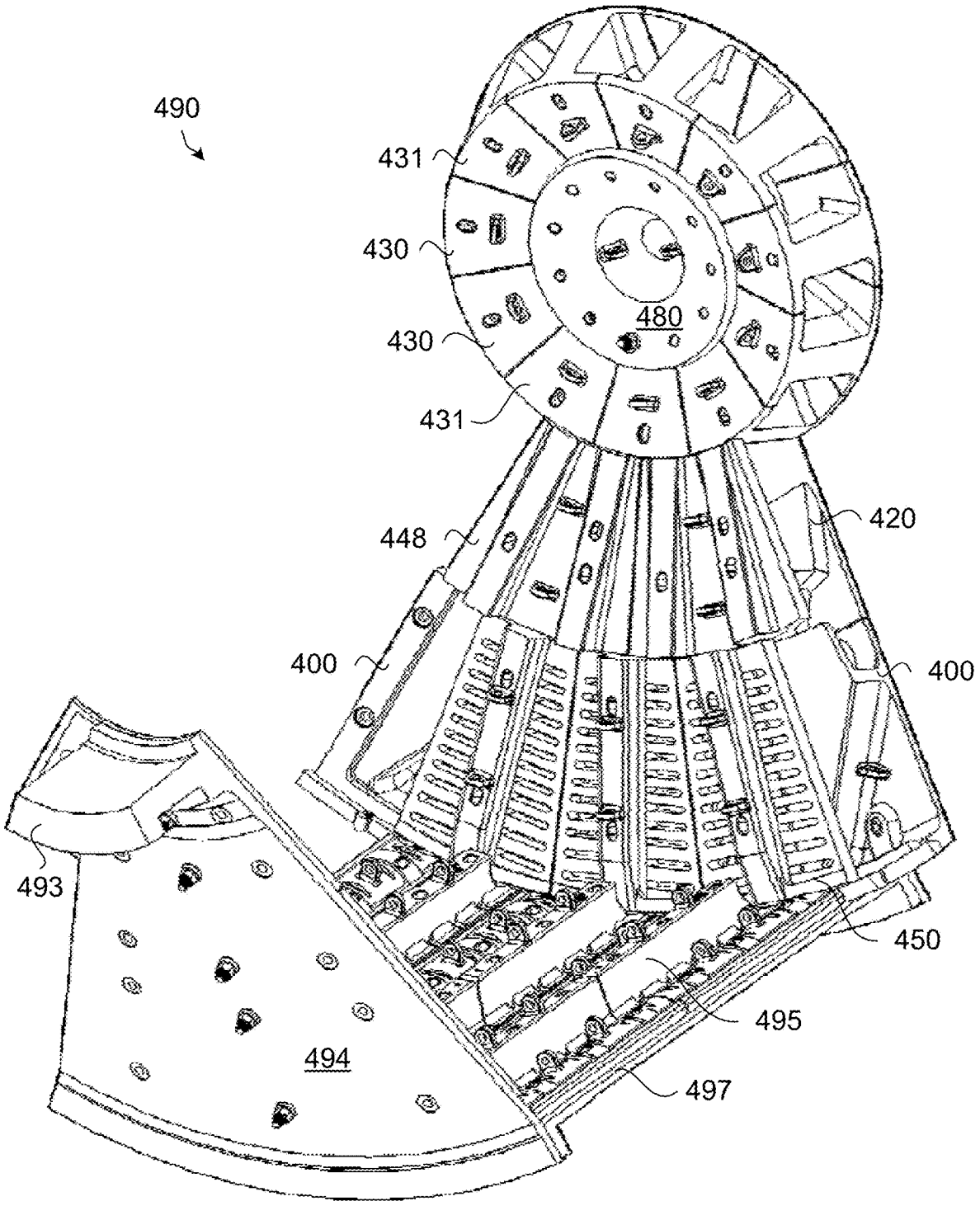
FIG. 23 illustrates a partial sectional view of semi-autogenous grinding (SAG) mill or rotary grinding mill.
Figure 24:
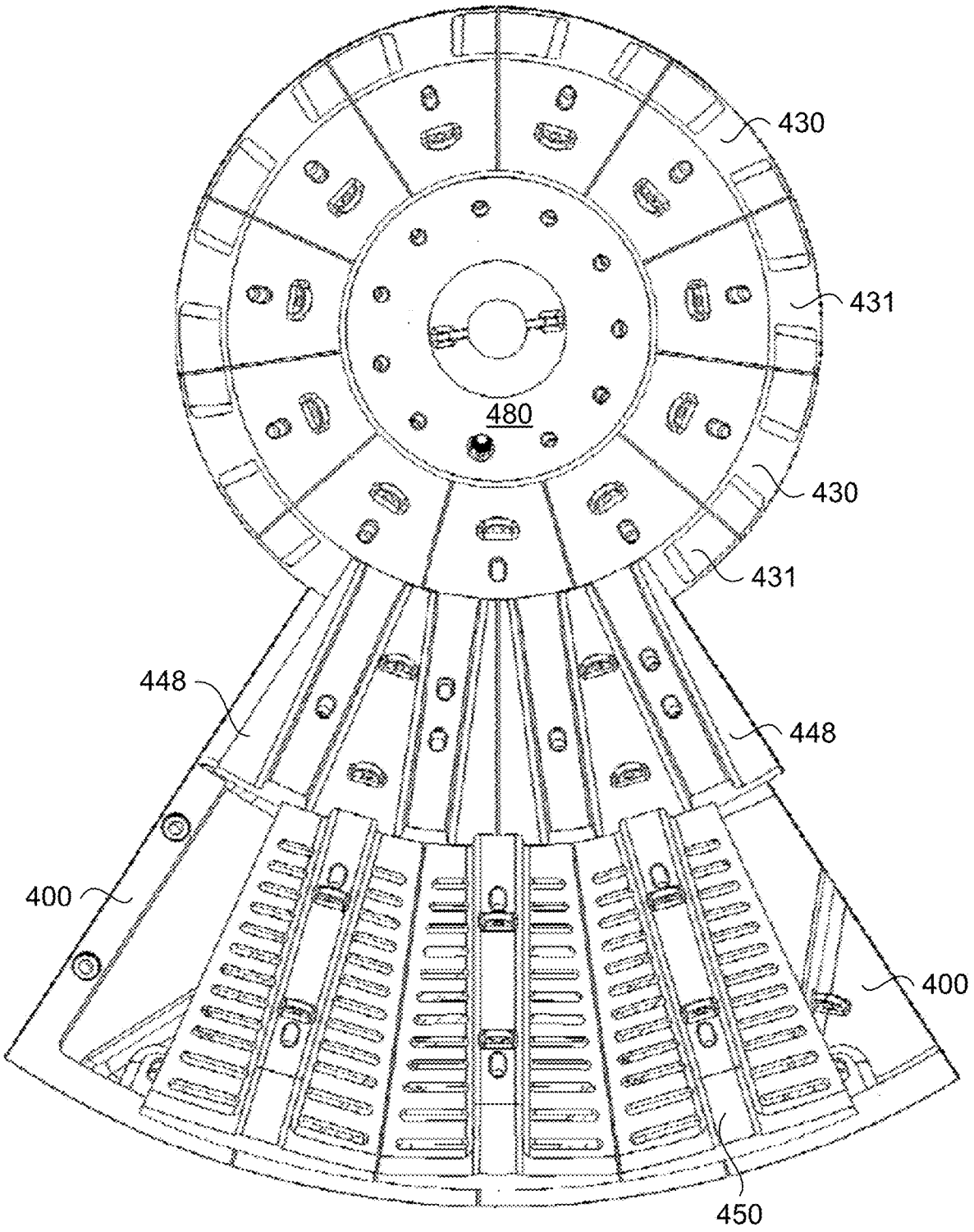
FIG. 24 illustrates a partial front view of a grate assembly mounted on a pulp lifter assembly of the grinding mill.
Figure 25:
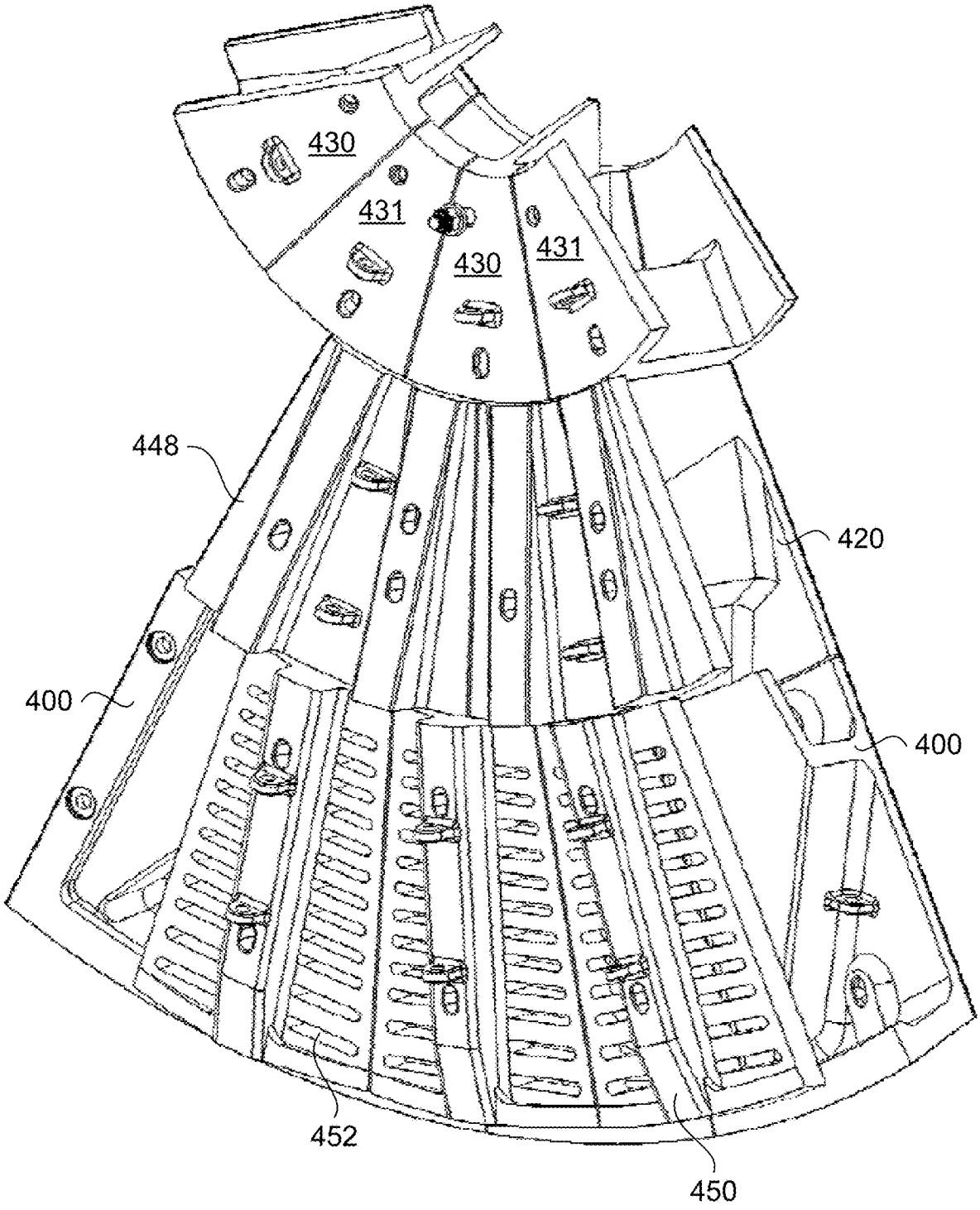
FIGS. 25-26 illustrates partial perspective views of the grate assembly mounted on the pulp lifter assembly of the grinding mill.
Figure 26:
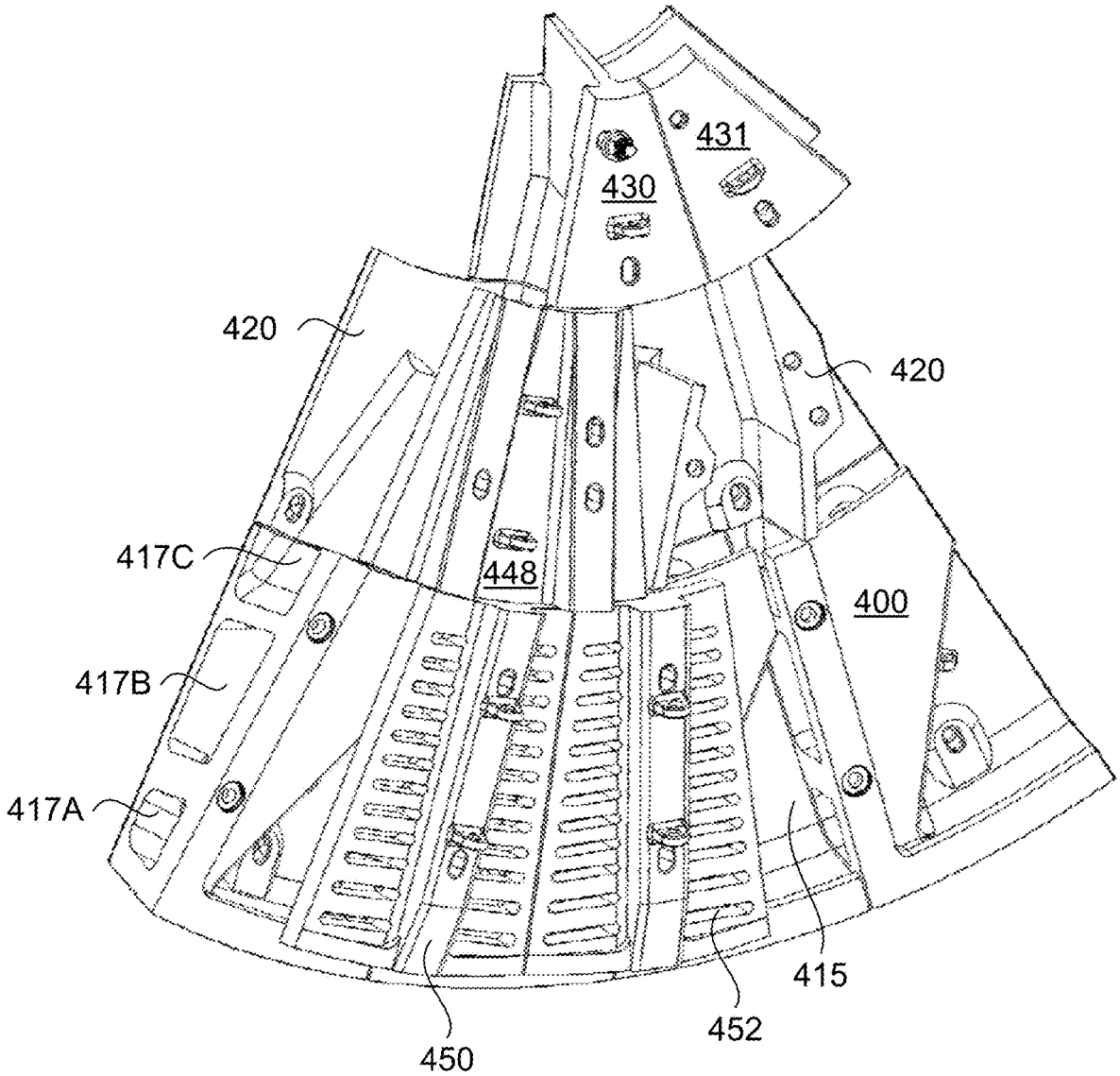
Figure 27:
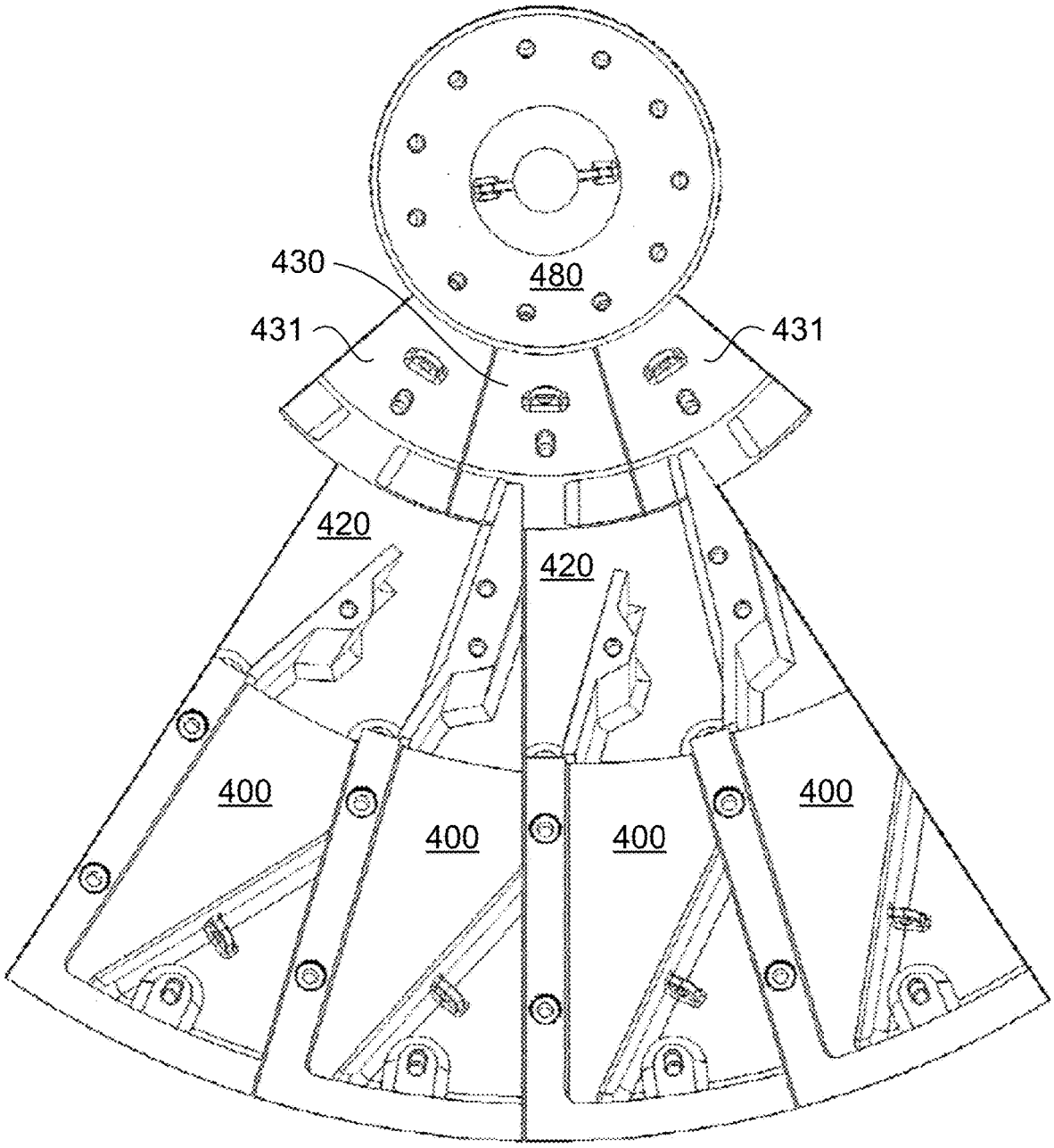
FIG. 27 illustrates a partial front view of a pulp lifter assembly of the grinding mill.
Figure 28:
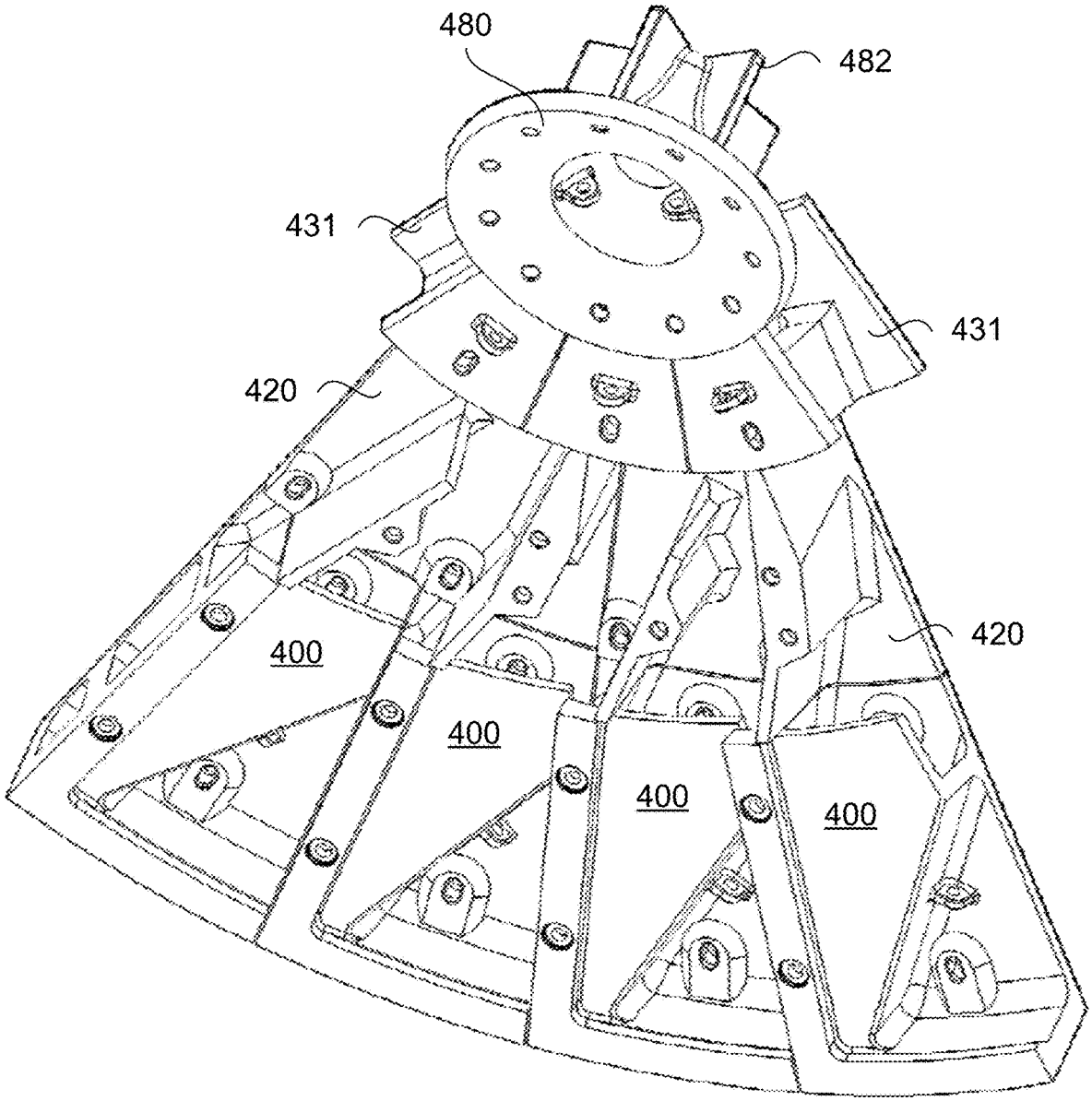
FIGS. 28-29 illustrates partial perspective views of the pulp lifter assembly of the grinding mill.
Figure 29:
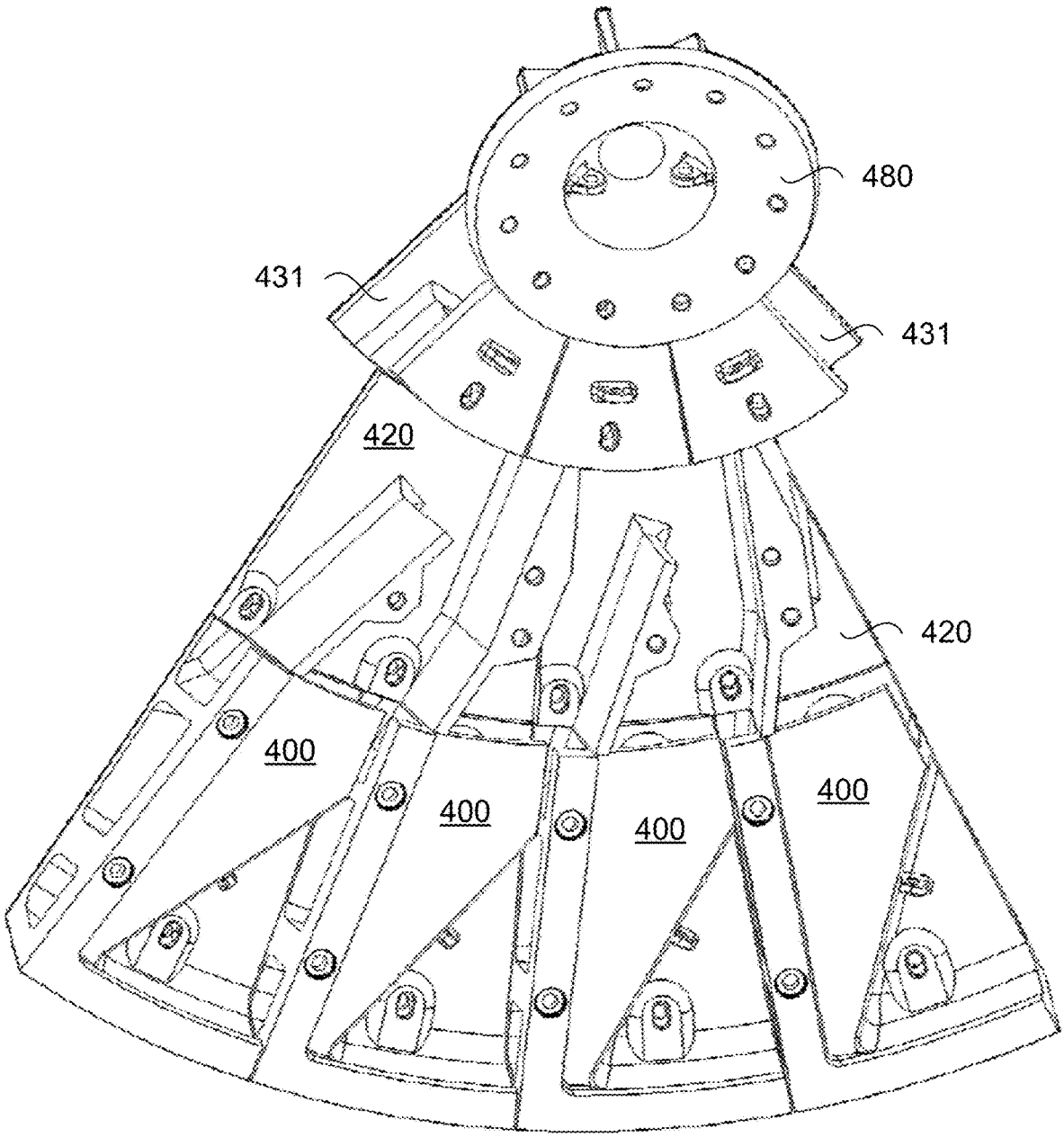
Figure 30:
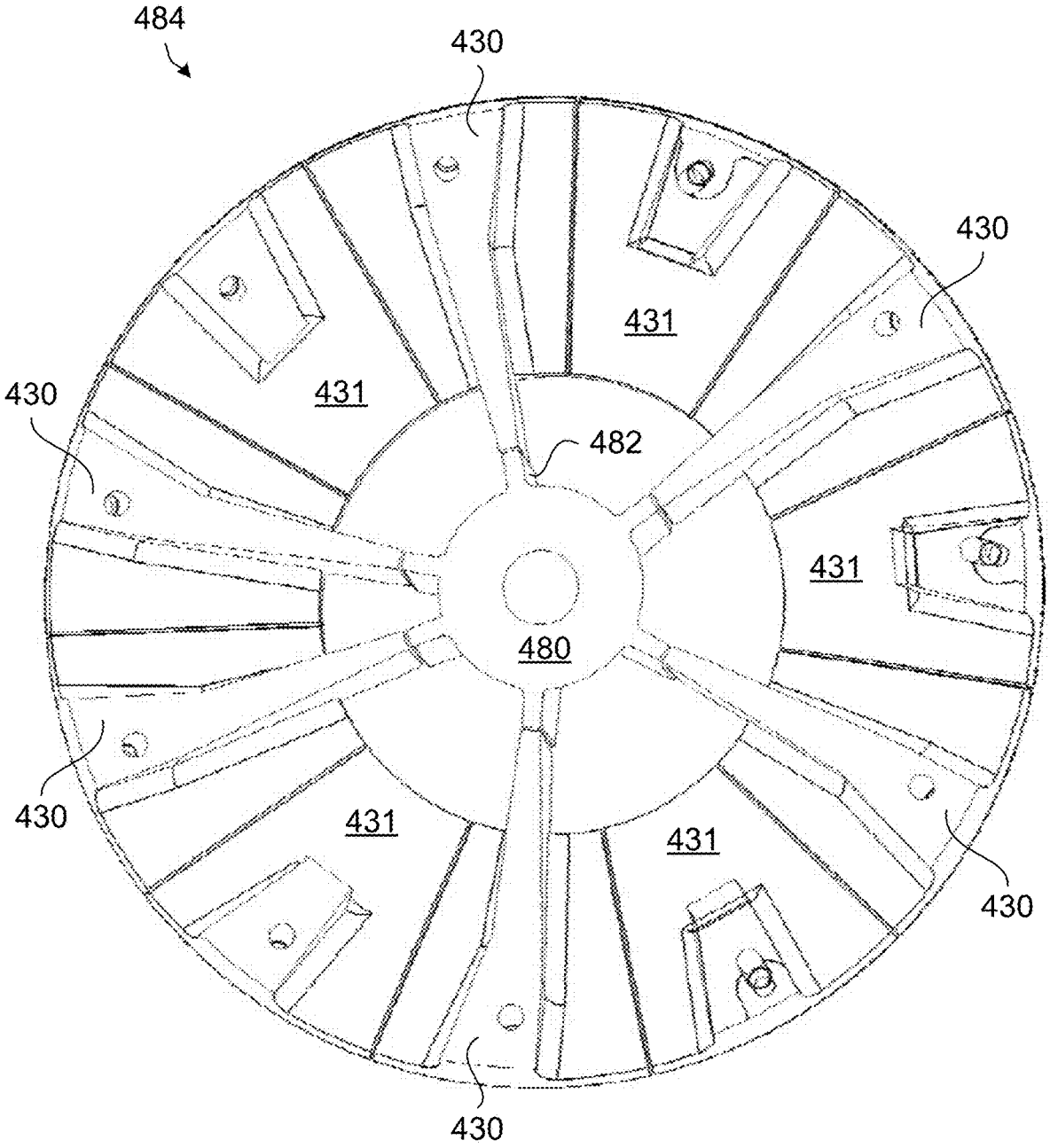
FIG. 30 illustrates a sectional view of a discharger and cone assembly of the grinding mill.

FIGS. 23-30 illustrate the pulp lifter assembly 460 in various perspective views of the mill 490. As shown in FIGS. 23-24, the long dischargers 430 and short dischargers 431 alternate in a circular orientation around a discharge cone 480. The mill has a feed trunnion 493, feed end plate 494, grinder chamber or shell 497, discharge end plate (concealed), and discharge trunnion (concealed) to contain the ground material and slurry. Liner plates 495 coupled to the grinder shell 497 help to rotate and crush the ground material into a slurry that can pass through the grate plates 450. FIG. 28 shows spokes or discharge cone axial walls 482 of the discharge cone 480. FIG. 30 illustrates the dischargers 430 and 431 and the discharge cone 480 with spokes 482 in a discharge and cone assembly 484.

In one example of a pulp lifter with a continuum guide, referring the FIGS. 16-30, the pulp lifter 400 of a pulp lifter assembly for a rotary grinding mill pulp lifter has a leading edge 403 and a trailing edge 407 with respect to rotation of the mill, and includes a first wall 402, 404, and 408 bounding an interior space and a second wall 410 and 412 dividing the interior space into a first region 415 and a second region 416. The first wall includes a leading edge wall 402 (or leading edge 702) formed with at least one inlet opening 417 providing access to the second section 416, an inner edge wall 408, and a radially outer wall 404. The second wall includes a guide 412 that extends substantially from the radially outer wall 404 to a trailing edge 407 of the inner edge wall 408. The first and second walls form an outlet opening 418A or 418B for discharge of slurry from the second section 416 at a radially inner edge 406. The first section 415 of the interior space is at least partially open at the trailing edge 407 of the pulp lifter 400.

In another configuration, the first and second walls form part of the outlet opening 418C for discharge of slurry from the second section 416 at the trailing edge 407 of the pulp lifter 400. The leading edge wall 402 includes an outer hole 409A extending from an outer edge to an inner edge, and an inlet opening 417A formed between the radially outer wall 404 and the outer hole 409A.

In another configuration, pulp lifter includes a trailing guide 414 between the first and second walls that extends from the leading edge wall 402 to the radially inner edge 406. The leading edge wall 402 can also include an inner hole 409B extending from an outer edge to an inner edge, and an inlet opening 417C formed between the inner hole 409B and the radially inner edge 406. In one example, the guide 412 is substantially linear. In another example, the guide is concave towards the leading edge wall 402 of the first wall.

In another configuration, the guide 412 has an outer segment at an acute angle 466 to the radially outer wall 404 in the direction of the trailing edge 407. In one example, the acute angle 466 of the outer segment is between 30° and 80°. In another example, the guide 412 has an inner segment at an acute angle 467 to the trailing edge 407 of the pulp lifter in the direction of the radially outer wall 404. A wall thickness at an intersection of the guide 412 and the radially outer wall 404 can be substantially thicker than a wall thickness of the rest of the guide.

In another example, a pulp lifter with a continuum guide can be included in a pulp lifter assembly. The pulp lifter assembly for installation in a grinding mill on a downstream side of a grate 450 formed with apertures 452 can allow slurry to pass through the grate 450 from an upstream side of the grate 450 to the downstream side of the grate 450, the pulp lifter assembly comprising a plurality of mutually adjacent outer pulp lifters 400 each having a leading edge 403 and a trailing edge 407, each two adjacent outer pulp lifters 400 being respectively a leading pulp lifter 400A and a trailing pulp lifter 400B. Each outer pulp lifter includes a first wall 402, 404, and 408 bounding an interior space, a second wall 410 and 412 dividing the interior space into a first region 415 and a second region, and a third wall 414 dividing the second region into a first sub-region 416 and a second sub-region 413. The first wall includes a leading edge wall 402 formed with at least one inlet opening 417 providing access to the second section 416, an inner edge wall 408, and a radially outer wall 404. The second wall includes a leading guide 412 that extends substantially from the radially outer wall 404 to a trailing edge 407 of the inner edge wall 408. The third wall includes a trailing guide 414 between the first and second walls that extends from the leading edge wall 402 to a radially inner edge 406. The first, second, and third walls form an outlet opening 418A for discharge of slurry from the second section 416 at a radially inner edge 406. The first section 415 of the interior space is at least partially open at the trailing edge 407 of each outer pulp lifter 400A-B.

In another example, the third wall includes a trailing guide 714 between the first and second walls that extends from the leading edge wall 702 to a trailing edge 707. The first, second, and third walls form an outlet opening 718A for discharge of slurry from the second section 716 at a trailing edge 707.

In one configuration, the leading guide 412 of the leading pulp lifter 400A at the inner edge wall 408 of the leading guide 412 aligns with the trailing guide 414 of the trailer pulp lifter 400B at the leading edge wall 402 of the trailing guide 414.

In another configuration, the pulp lifter assembly includes an inner pulp lifter 420 defining at least one channel 425 for receiving slurry from the outlet opening 418 of the outer pulp lifter 400 and conveying the slurry radially inward relative to the mill. The at least one channel 425 of the inner pulp lifter 420 includes at least one radial wall 423 or 424, and the at least one radial wall 423 or 424 aligns with the trailing guide 414 at a radially edge 406 or 428 between at least one outer pulp lifter 400A or 400B and the inner pulp lifter 420. In another example, the at least one channel 425 of the inner pulp lifter 420 includes at least one radial wall 423 or 424, and the at least one radial wall 423 or 424 forms an acute angle 468A or 468B to a radially outer edge 428 of the of the inner pulp lifter 420 in the direction of the trailing edge 427, the guide 412 has an outer segment at an acute angle 466 to the radially outer wall 404 in the direction of the trailing edge 407, and the acute angle 468A or 468B of the at least one radial wall 423 or 424 is greater than the acute angle 466 of the guide 412.

In another configuration, the pulp lifter assembly includes a grate 250 formed with apertures 252 for allowing slurry to pass to the at least one pulp lifter 400A or 400B for removal from the mill by the at least one pulp lifter 400A or 400B. The grate 450 is aligned to the at least one pulp lifter 400A or 400B.

In another example, a pulp lifter with a continuum guide can be included in a pulp lifter structure for installation in a grinding mill. The pulp lifter structure includes an outer pulp lifter 400, an inner pulp lifter 420, and a discharger 430 or 431. The outer pulp lifter includes a first wall 402, 404, and 408 bounding an interior space, a second wall 410 and 412 dividing the interior space into a first region 415 and a second region, and a third wall 414. The first wall includes a leading edge wall 402 formed with at least one inlet opening 417 providing access to the second section 416, an inner edge wall 408, and a radially outer wall 404. The second wall includes a leading guide 412 that extends substantially from the radially outer wall 404 to a trailing edge 407 of the inner edge wall 408. The third wall includes a trailing guide 414 between the first and second walls that extends from the leading edge wall 402 to a radially inner edge 406. The first, second, and third walls form an outlet opening 418A for discharge of slurry from the second section 416 at a radially inner edge 406. The first section 415 of the interior space is at least partially open at the trailing edge 407 of the outer pulp lifter 400.

The inner pulp lifter 420 defines at least one channel 425 for receiving slurry from the outlet opening 418 of the outer pulp lifter 400 and conveying the slurry radially inward relative to the mill. The discharger 430 or 431 receives slurry from the at least one channel 425 of the inner pulp lifter 420 and discharging the slurry from the inner pulp lifter 420.

In another configuration, the leading guide 412 forms an acute angle 466 to the radially outer wall 404 in the direction of the trailing edge 407. The at least one channel 425 of the inner pulp lifter 420 includes at least one radial wall 423 or 424, the at least one radial wall 423 or 424 forms an acute angle 468A or 468B to a radially outer edge 428 of the of the inner pulp lifter 420 in the direction of the trailing edge 427, and the acute angle 468A or 468B of the at least one radial wall 423 or 424 is greater than the acute angle 466 of the leading guide 412. The discharger 430 or 431 includes at least one discharger wall 434 or 436, the at least one discharger wall 434 or 436 forms an angle 470A or 470B to a radially outer edge 440 or 441 of the of the discharger 430 or 431 in the direction of the trailing edge 442 or 443, and the angle 470A or 470B of the at least one discharger wall 430 or 431 is greater than the acute angle 468A or 468B of the at least one radial wall 423 or 424.

In one example, a plurality of pulp lifter structures radially adjacent to each other formed a circular pattern. In another example, the pulp lifter structure includes a grate 450 formed with apertures 452 for allowing slurry to pass to the pulp lifter for removal from the mill by the pulp lifter. The grate 450 can be mounted or attached to the outer pulp lifter 400.

FIGS. 16-31 illustrate various configurations of pulp lifter components and a pulp lifter assembly in a SAG mill or rotary grinding mill that uses a continuum guide, which improves material (e.g., slurry) flow, speed, and throughput, as well as reducing component wear. As illustrated in FIG. 16, the pulp lifter assembly includes outer pulp lifters 400, inner pulp lifters 420, and dischargers 430 or 431. As shown the path the slurry travel has a continuous flow from the inlet chamber 115 of the outer pulp lifter 400 to the dischargers 430 or 431.

Figure 31:
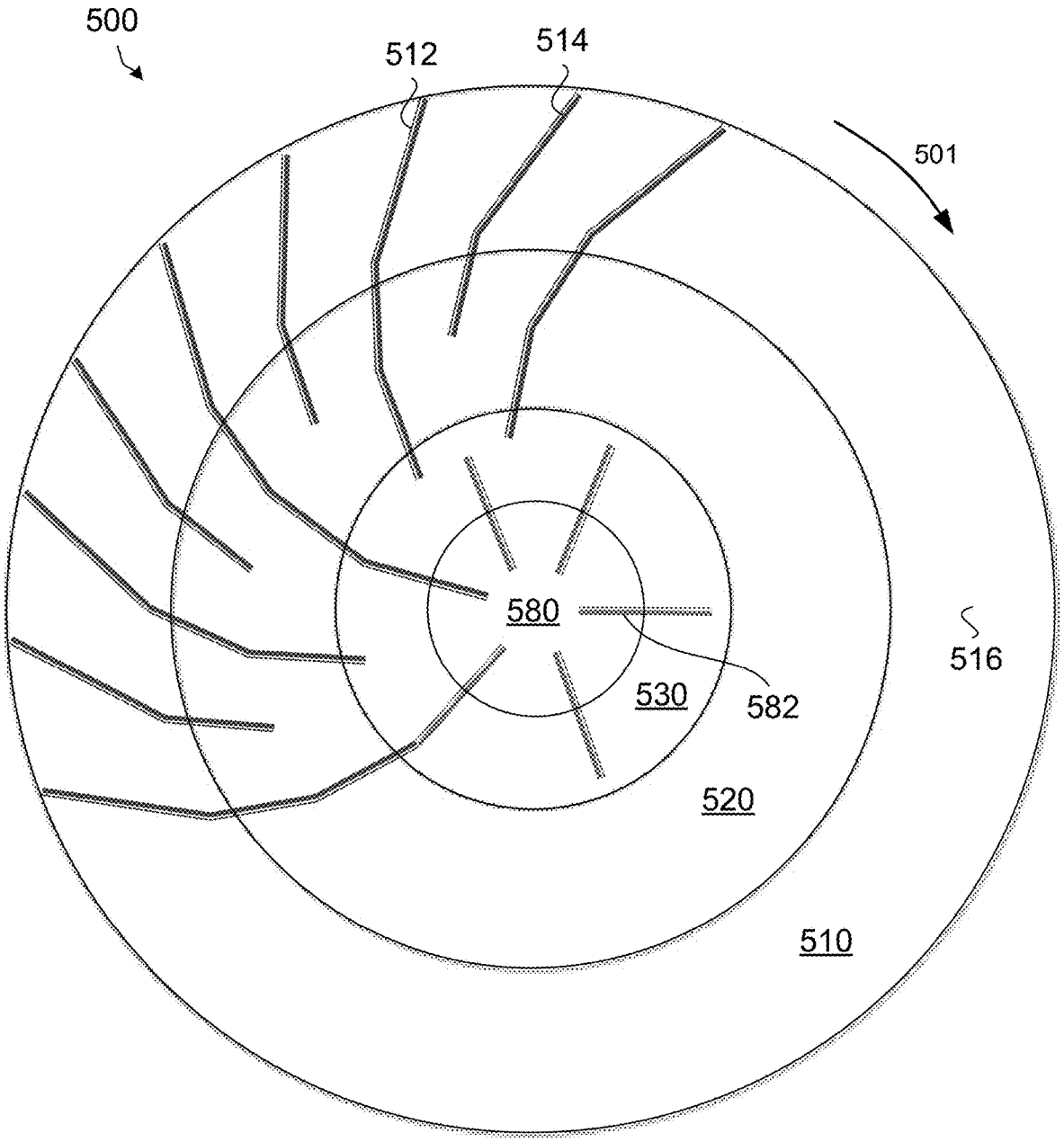
FIG. 31 illustrates a schematic view of an internal profile of a pulp lifter assembly of the grinding mill.

FIG. 31 illustrates an internal profile of a pulp lifter assembly 500 of the grinding mill, where the direction of rotation 501 is in the clockwise direction. The pulp lifter assembly has a ring of outer pulp lifters 510 with at least three holes 516 (alignment holes or bolt holes) per outer pulp lifter, a ring of inner pulp lifters 520 with at least three holes 516 per inner pulp lifter, a ring of dischargers 530 with at least one hole 516 per discharger, and a discharge cone 580. Long guides 512 and short guides 514 are illustrated in the outer pulp lifters, inner pulp lifters, and dischargers, as well as spokes or discharge cone axial walls 582 in the dischargers and discharge cone.

Figure 32:
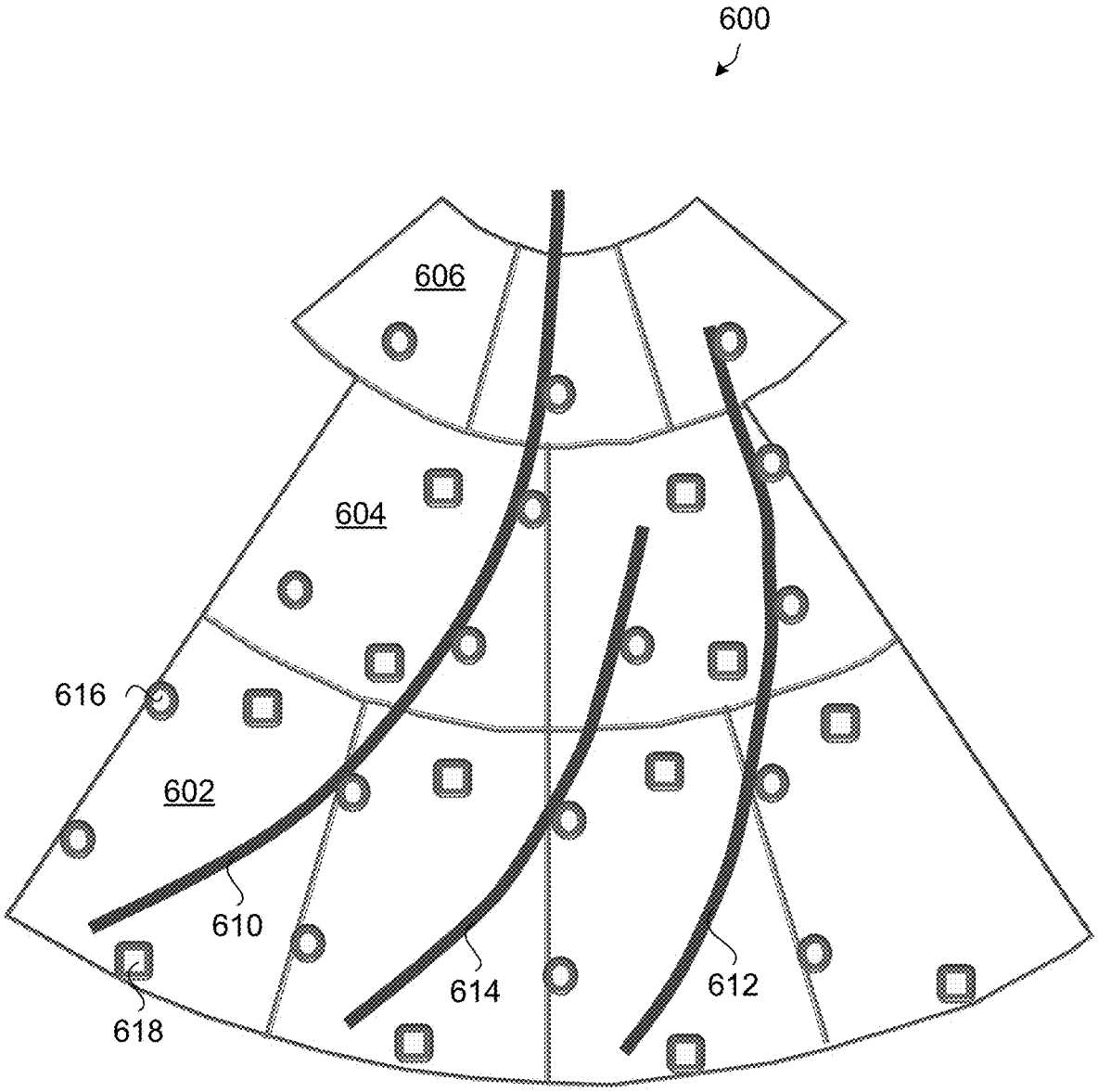
FIG. 32 illustrates a schematic view of an internal profile of another pulp lifter assembly of a grinding mill with a different bolt hole configuration from the pulp lifter assembly shown in FIGS. 16-30.
Figure 33:
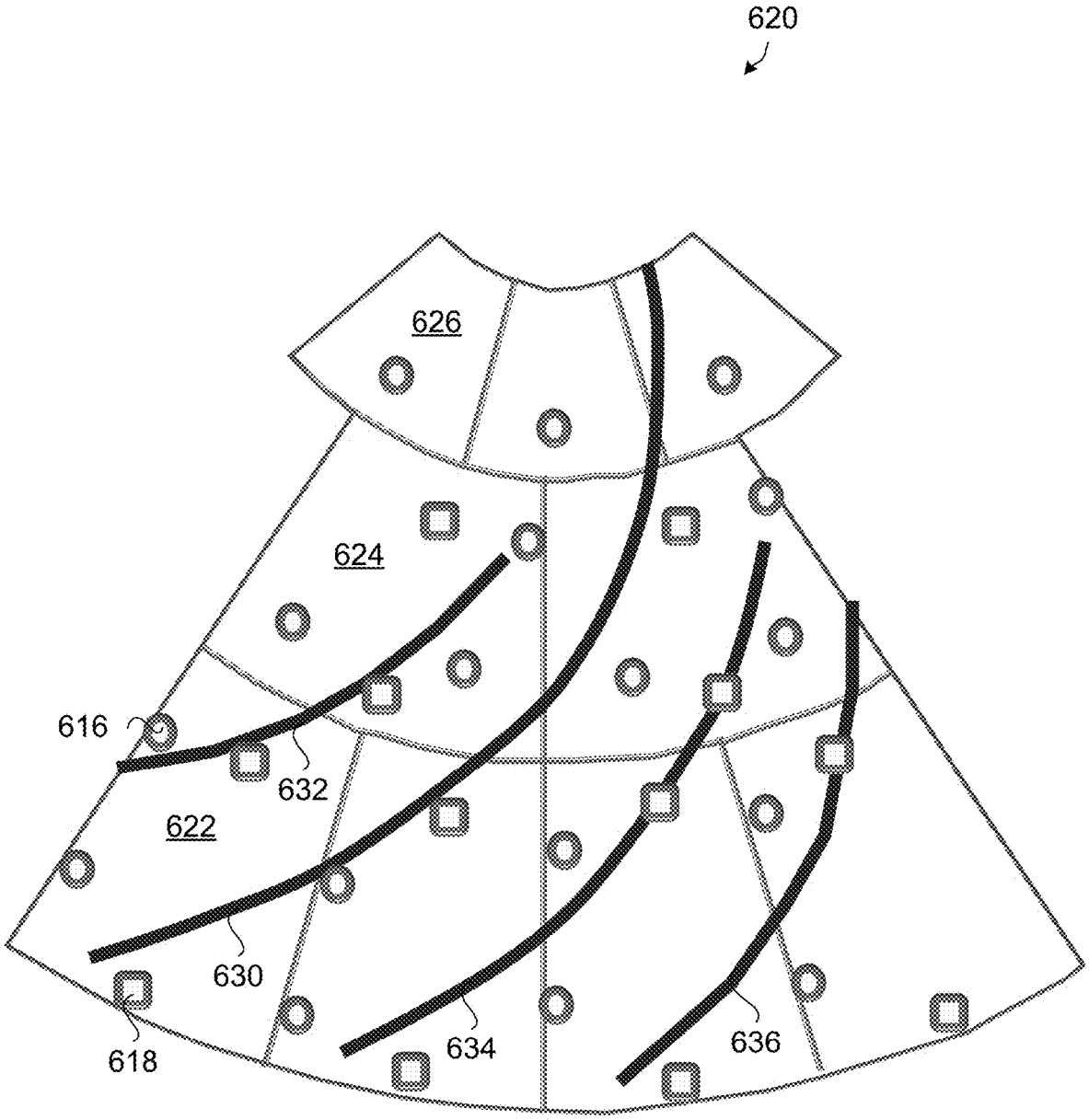
FIG. 33 illustrates a schematic view of an internal profile of another pulp lifter assembly of a grinding mill with a different bolt hole configuration from the pulp lifter assembly shown in FIGS. 16-30.
Figure 34:
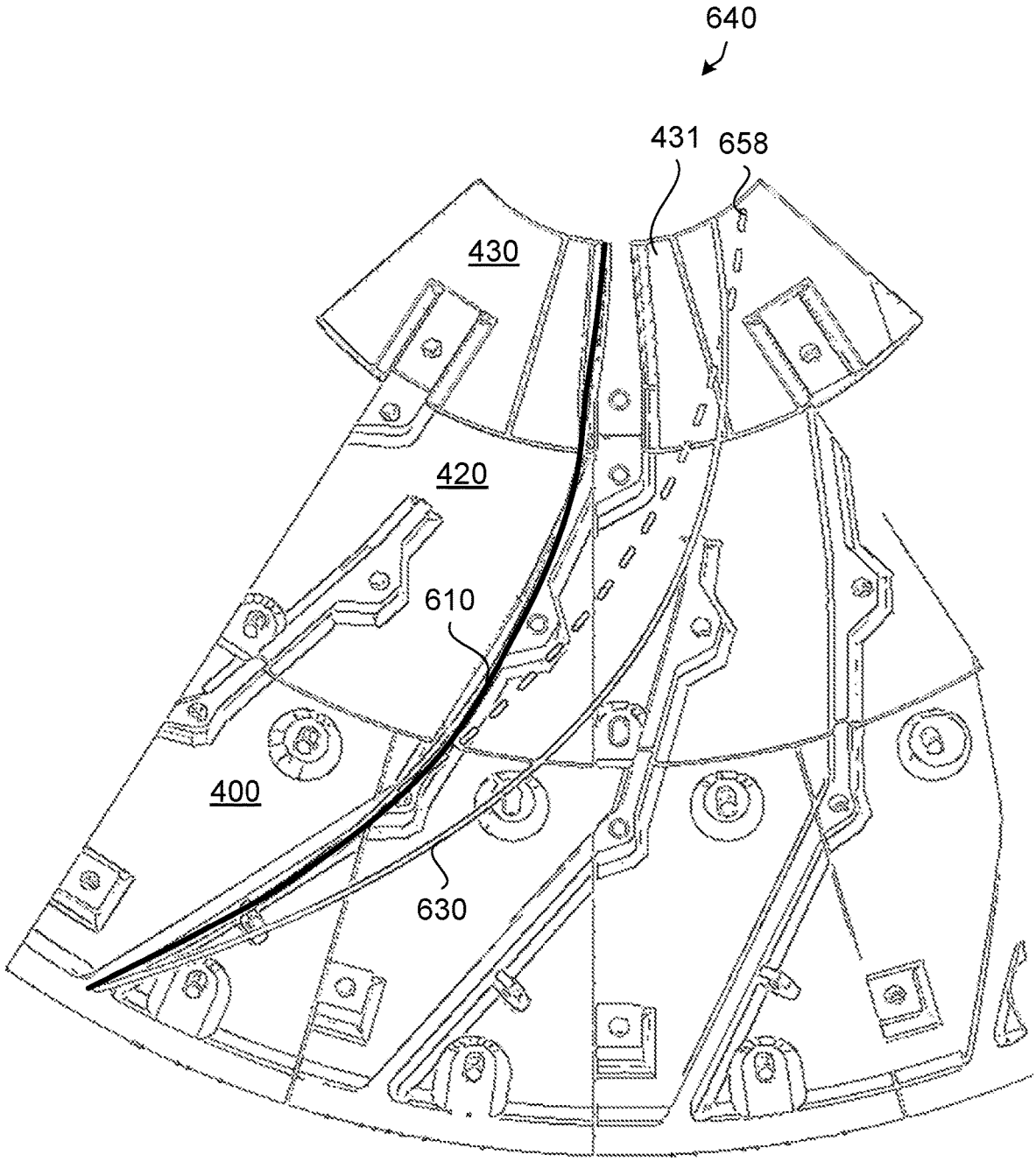
FIGS. 34-35 illustrate views of various internal profiles of pulp lifter assemblies on the sectional view of pulp lifter assembly shown in FIGS. 16 and 22.
Figure 35:
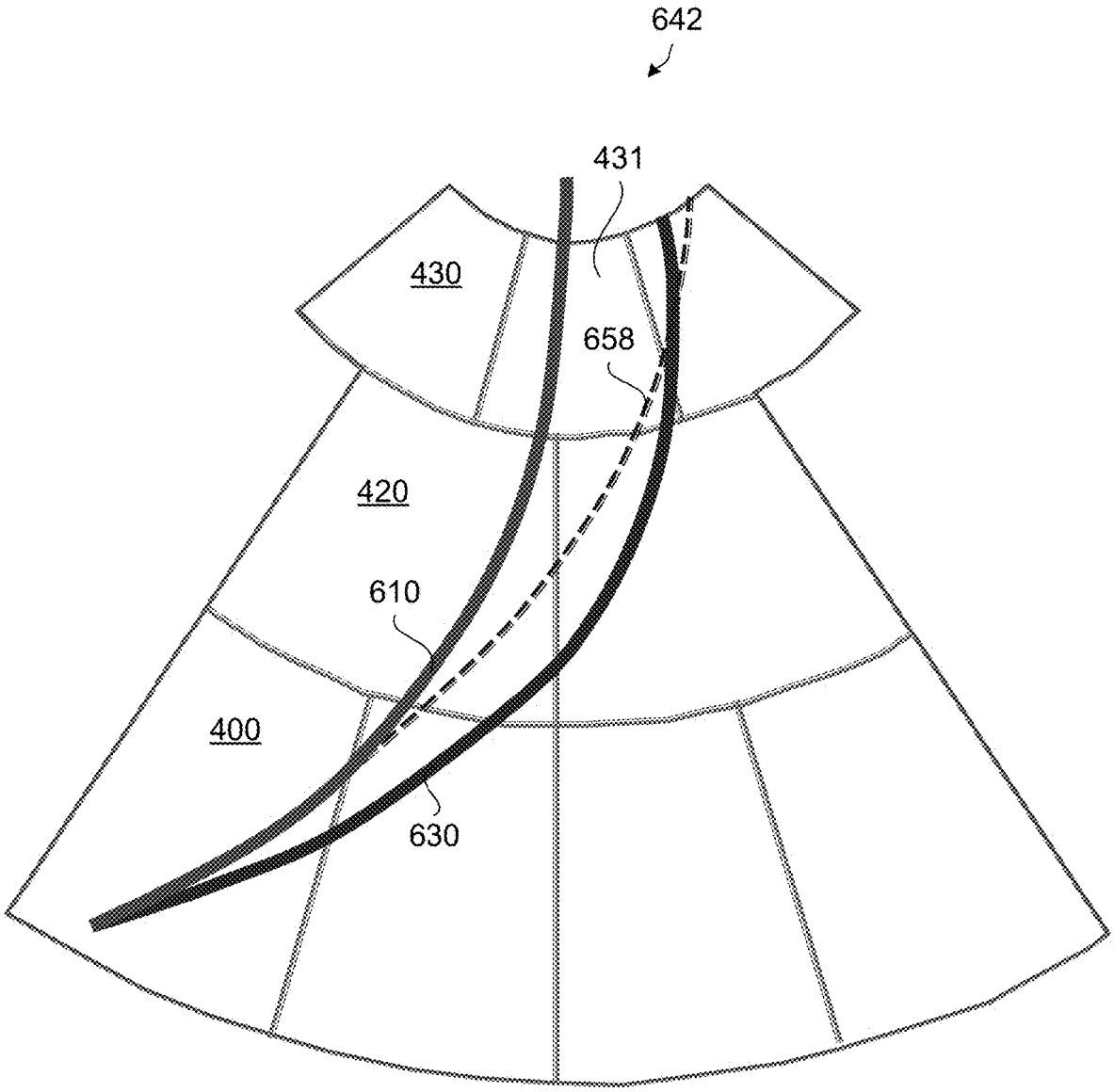
Figure 36:
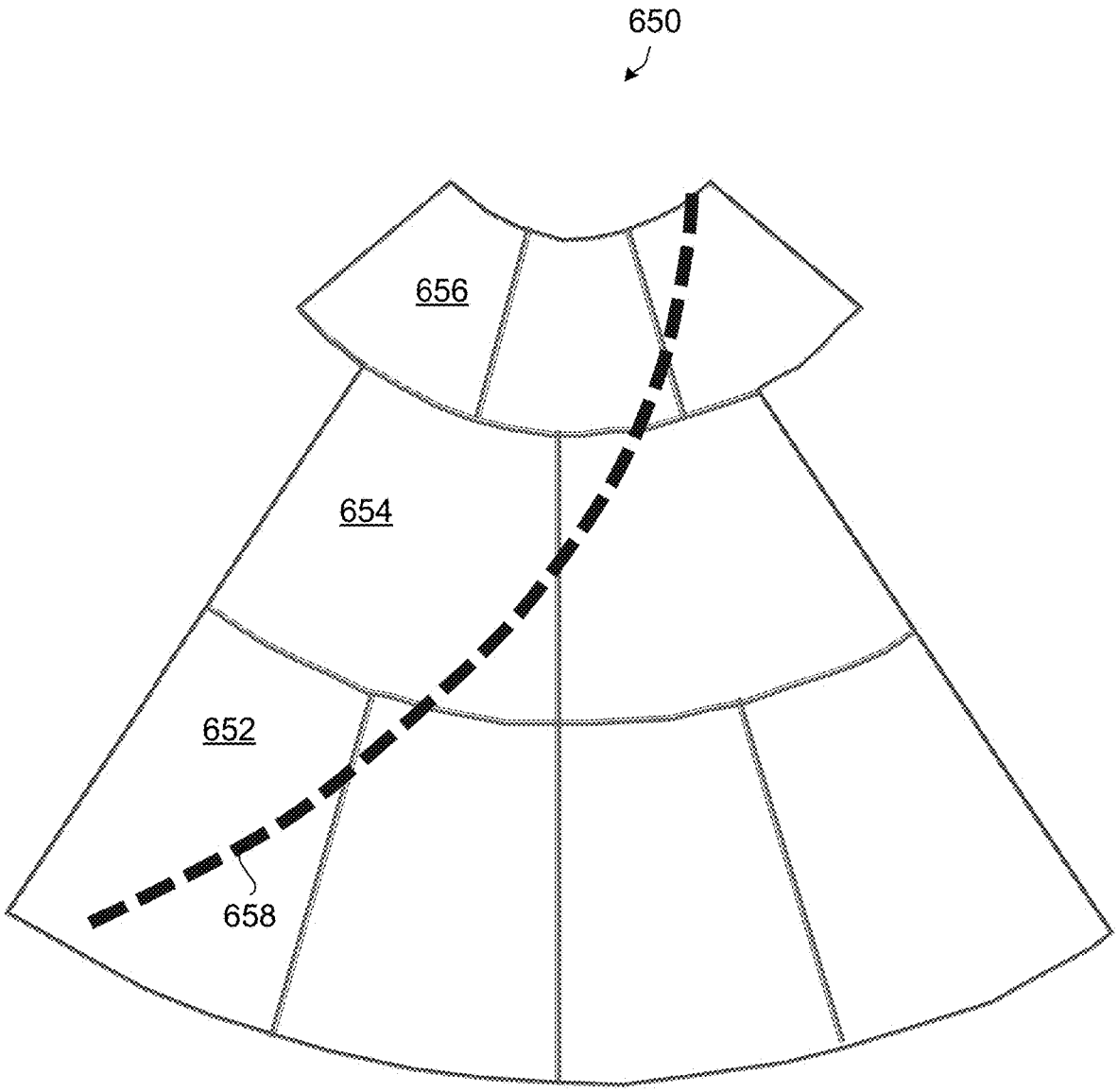
FIG. 36 illustrates a schematic view of an internal profile of another pulp lifter assembly of a grinding mill with a different guide configuration from the pulp lifter assembly shown in FIGS. 16-30.

FIGS. 32 and 33 illustrate a different bolt hole and alignment hole pattern from FIGS. 16-30. The curvature of the guides in shown in FIGS. 32 and 33 differ from each other, as illustrated in FIGS. 34-35. FIGS. 34-36 illustrate another curvature of a guide that differs from FIGS. 32 and 33. In other examples (not shown), the bolt holes and alignment holes of the pulp lifter assembly may have another pattern. The pulp lifter assembly may have guides with different curvatures.

FIG. 32 illustrates an internal profile of a pulp lifter assembly 600 of the grinding mill, where the direction of rotation is in the clockwise direction. The pulp lifter assembly has a ring of outer pulp lifters 602 with two alignment holes 618 (e.g., bolt hole to hold the piece) and two bolt holes 616 (e.g., longer bolt hole to hold complete outer pulp lifter and grate) per outer pulp lifter, a ring of inner pulp lifters 604 with two alignment holes 618 (e.g., bolt hole to hold the piece) and two bolt holes 616 (e.g., longer bolt hole to hold complete inner pulp lifter and center liner) per inner pulp lifter, and a ring of dischargers 606 with one bolt hole 616 per discharger. Long guides 610, medium guides 612, and short guides 614 are illustrated in the outer pulp lifters, the inner pulp lifters, and the dischargers.

FIG. 33 illustrates another internal profile of a pulp lifter assembly 620 of the grinding mill, where the direction of rotation is in the clockwise direction. The pulp lifter assembly has a ring of outer pulp lifters 622 with two alignment holes 618 (e.g., bolt hole to hold the piece) and two bolt holes 616 (e.g., longer bolt hole to hold complete outer pulp lifter and grate) per outer pulp lifter, a ring of inner pulp lifters 624 with two alignment holes 618 (e.g., bolt hole to hold the piece) and two bolt holes 616 (e.g., longer bolt hole to hold complete inner pulp lifter and center liner) per inner pulp lifter, and a ring of dischargers 626 with one bolt hole 616 per discharger. Long guides 630, first medium guides 632, second medium guide 634, and third medium guide 636 are illustrated in the outer pulp lifters, the inner pulp lifters, and the dischargers.

FIGS. 34-36 illustrate views of various internal profiles of pulp lifter assemblies with various guide slopes and angles. FIG. 34 illustrates pulp lifter assembly 640 with the long guide 610 of FIG. 32, the long guide 630 of FIG. 33, and another guide 658 overlaid on the pulp lifter assembly shown in FIGS. 16-30. FIG. 35 illustrates pulp lifter assembly 642 with the long guide 610 of FIG. 32, the long guide 630 of FIG. 33, and another guide 658 overlaid on an outline of the pulp lifter assembly shown in FIGS. 16-30. FIG. 36 illustrates pulp lifter assembly 650 with the other guide 658 with a more gradual slope overlaid on the outer pulp lifters 652, inner pulp lifters 654, and dischargers 656 of the pulp lifter assembly. The more gradual slope or curvature can have a better slurry flow where the slurry has minimal change in direction, which can slow down or disrupt the slurry flow.

Figure 37:
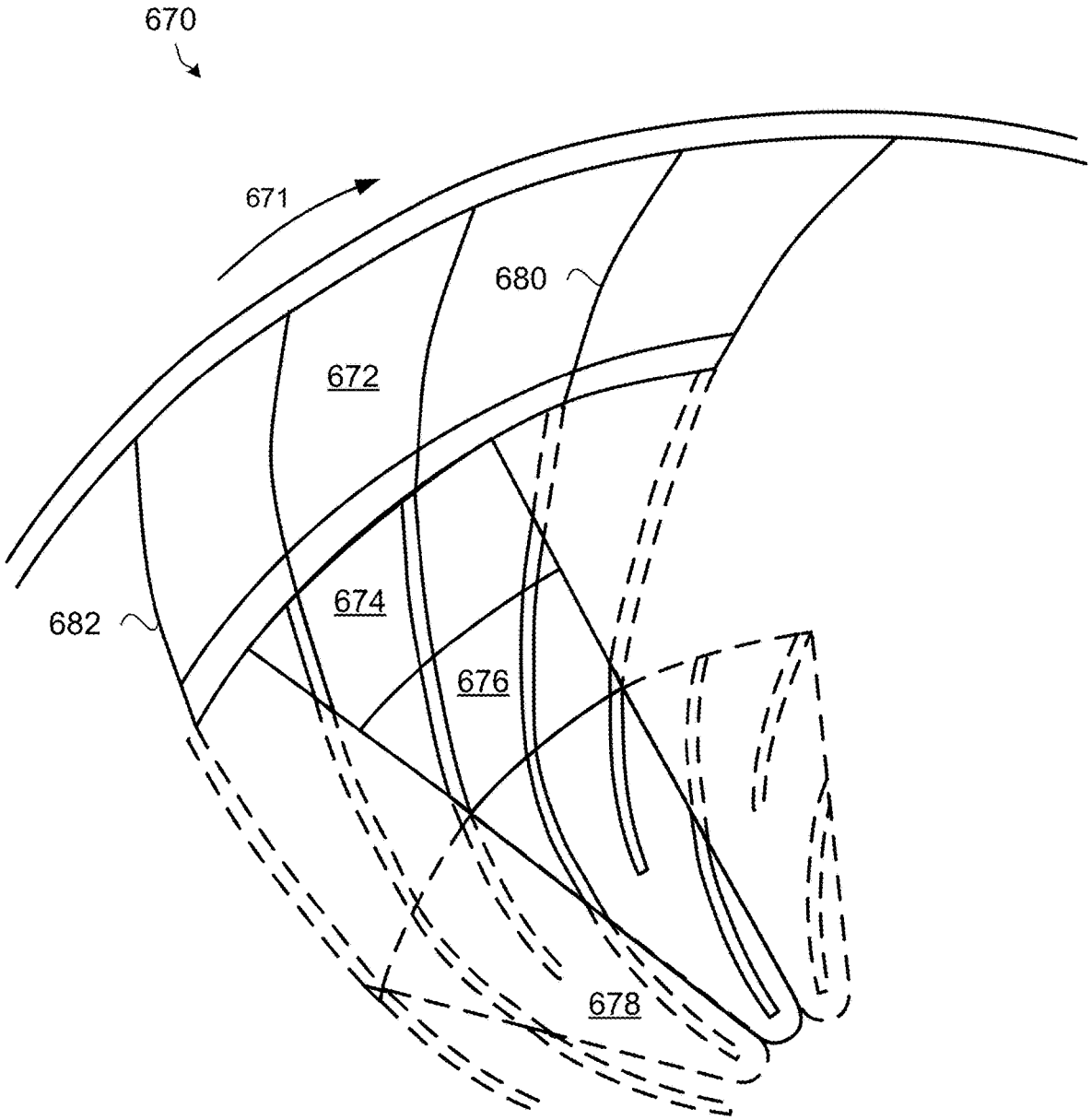
FIG. 37 illustrates a schematic view of an internal profile of a pulp lifter assembly of the grinding mill that includes outer pulp lifters, middle pulp lifters, inner pulp lifters, and dischargers.

The pulp lifter assembly may have more than three radial sections based on the radius or diameter of the mill. For example, FIG. 37 illustrates a pulp lifter assembly 670 with four radial sections including outer pulp lifters 672, first inner pulp lifters or middle pulp lifters 674, second inner pulp lifters or inner pulp lifters 676, and dischargers 678. The pulp lifter assembly may have different lengths of guides, such as long guides 680 and short guides 682. The pulp lifter assembly has a direction of rotation 671 in the clockwise direction.

The structure for the pulp lifter assembly 500 of FIG. 31, 600 of FIG. 32, 620 of FIG. 33, 640 of FIG. 34, 642 of FIG. 35, 650 of FIGS. 36, and 670 of FIG. 37 including outer pulp lifters with inlet chambers and outlet chambers can have a design similar to the features describe with FIGS. 16-30 or FIGS. 38A-42D to follow. Thus, the outer pulp lifters of FIGS. 31-37 include and inlet chamber and outlet chamber separated by an intermediate wall and guide to reduce flow back.

FIGS. 16-37 illustrate a mill and a pulp lifter assembly rotating in the clockwise direction. The features of the pulp lifter assembly shown could be flipped for a mill that rotates in the counter clockwise direction. FIGS. 38A-42D illustrate a mill and a pulp lifter assembly rotating in the counter clockwise direction. The features of the pulp lifter assembly shown could be flipped for a mill that rotates in the clockwise direction. The components FIGS. 38A-42D illustrate another example of pulp lifter components and a pulp lifter assembly 760 in a SAG mill or rotary grinding mill. FIG. 38A shows the pulp lifter assembly with a direction of rotation 761 in the counter clockwise direction. The pulp lifter assembly 760 includes 20 outer pulp lifters 700 (each outer pulp lifter with approximately 18° of the cylinder), 10 inner pulp lifters 720 (each inner pulp lifter with approximately 36° of the cylinder), and a discharge cone assembly 740. Unlike FIGS. 16-30, a discharger is not present in FIGS. 38A-42D, which illustrates that various inner pulp lifters and discharger may or may not be included in a pulp lifter design. A gap 763 (with specified dimension) may exist between the outer pulp lifters. Each outer pulp lifter represents an angle 755 (i.e., arc angle of the outer pulp lifter) of the circular configuration of the pulp lifter assembly. Each inner pulp lifter represents an angle 756 (i.e., arc angle of the outer pulp lifter) of the circular configuration of the pulp lifter assembly. As shown the guide walls of the outer pulp lifter, the inner pulp lifter, and the discharger maintain a relatively continuous guide with gradual changes in angle from the radially outer wall 704 to spokes or discharge cone axial walls 742A-F which directs slurry out of the mill from the discharge cone. Although not shown, the mill can include grate plates coupled to the outer pulp lifter, as previously described with other examples.

Figure 38B:
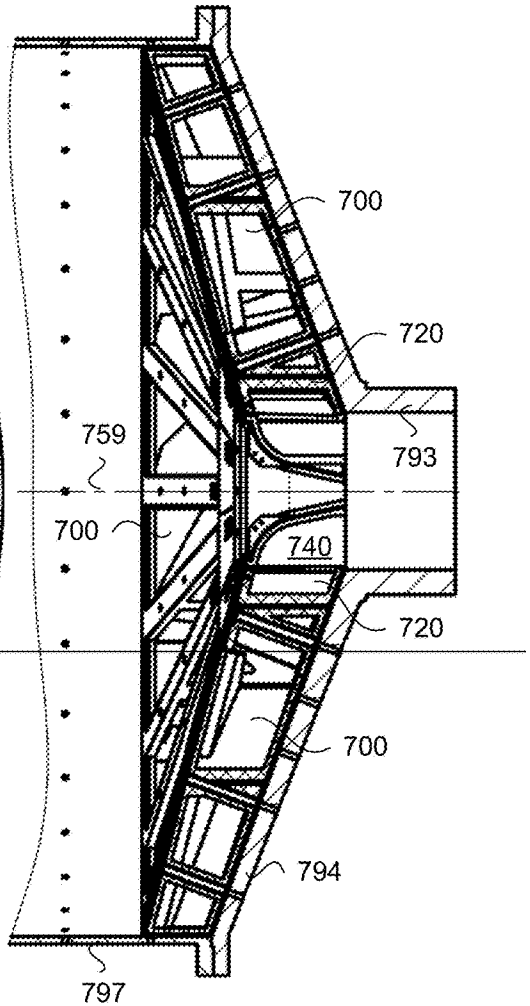
FIG. 38B illustrates a sectional view of the pulp lifter assembly shown in FIG. 38A.
Figure 38A:
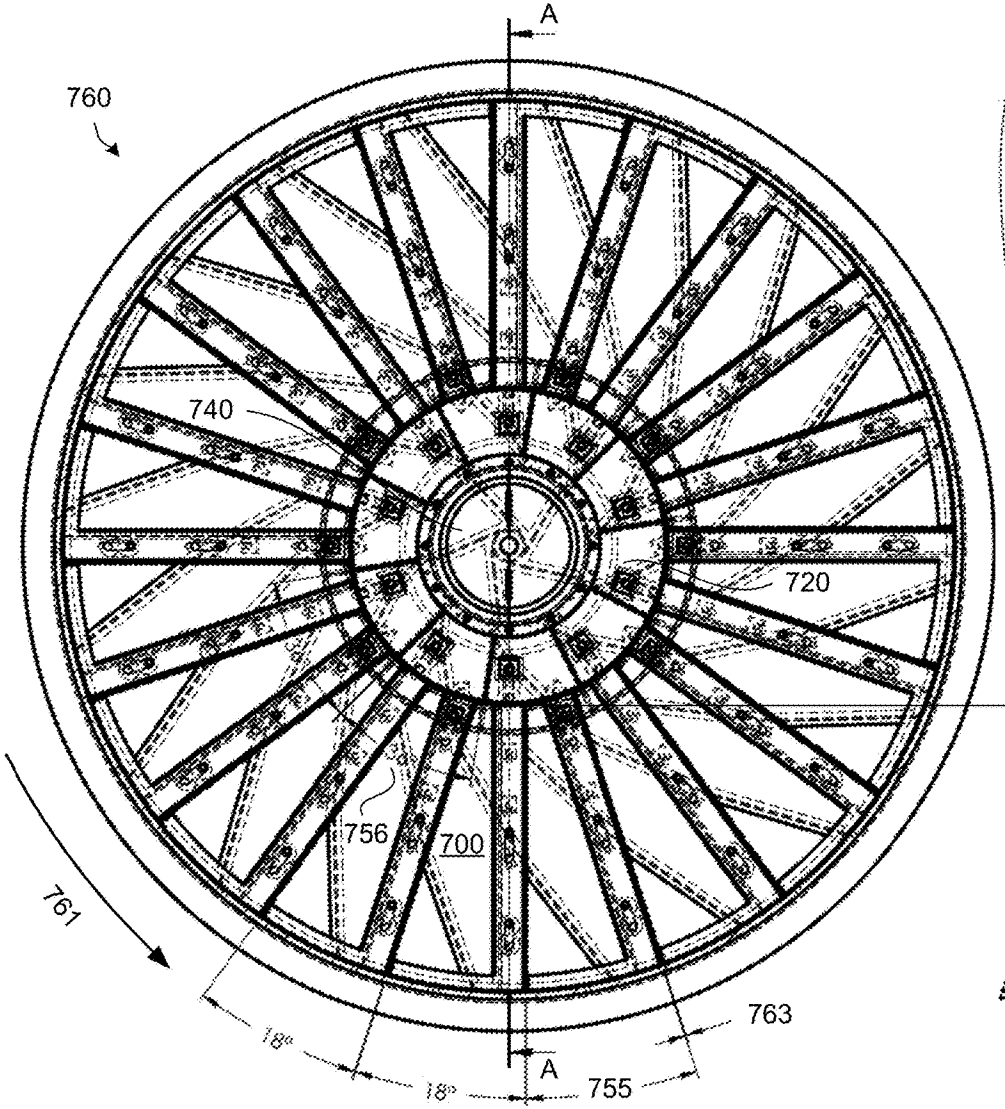
FIG. 38A illustrates a front view of a pulp lifter assembly of a grinding mill.

FIG. 38B illustrates a cross section view of the discharge end of the mill along the A-A section lines of FIG. 38A. The mill and pulp lifter assembly rotate around an axis of a pulp lifter assembly center line 759. A discharge end plate 794 includes a discharge trunnion 793 and is coupled to grinder chamber or shell 797. The outer pulp lifter 700 and the inner pulp lifter 720 is mounted to the discharge end plate, as previously described with other examples. The discharge cone assembly 740 is mounted to the discharge end plate, the discharge trunnion, or the inner pulp lifters.

Figures 39A, 39B, 39C:
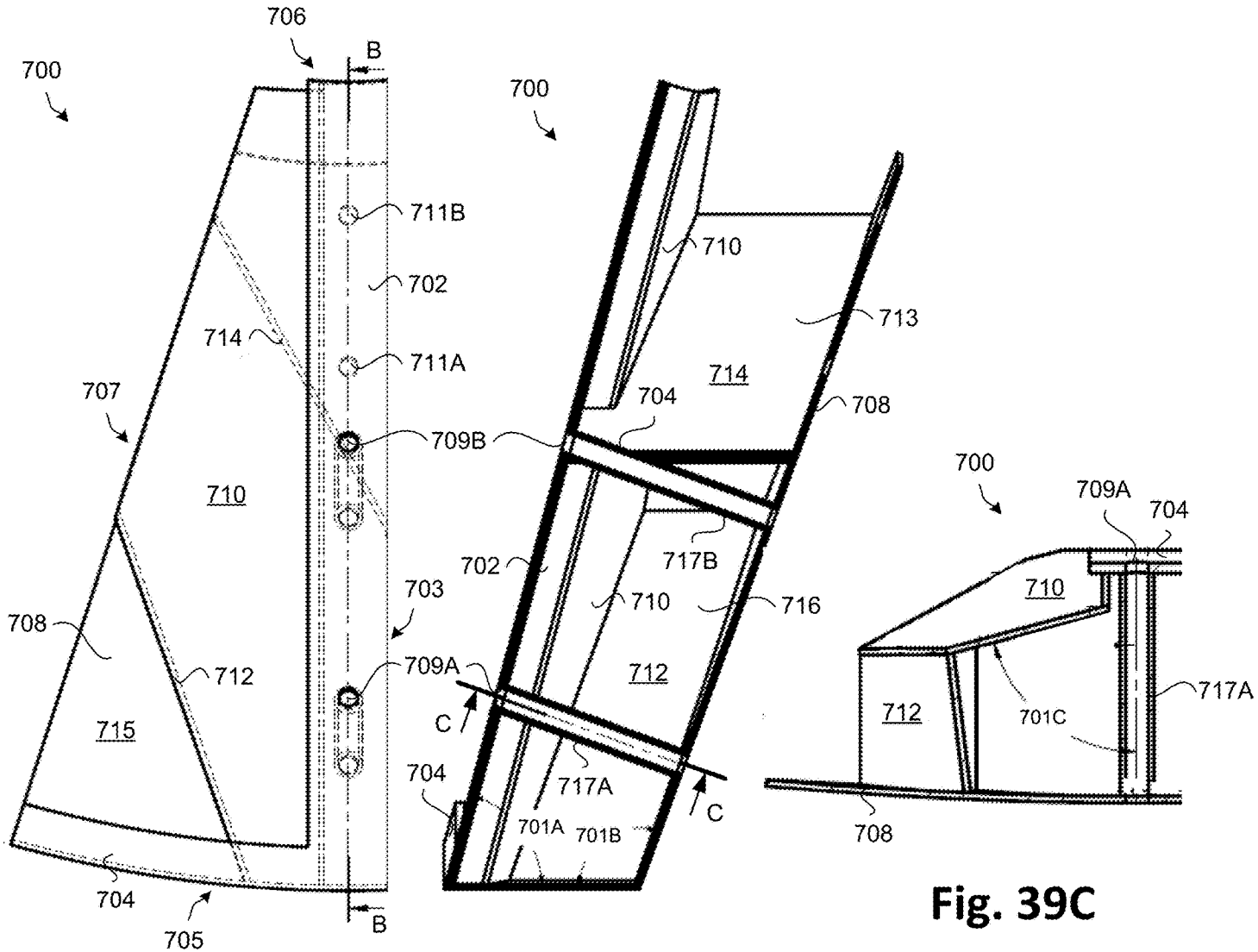
FIG. 39A illustrates a side view of an outer pulp lifter.
FIG. 39B illustrates a sectional view of the outer pulp lifter shown in FIG. 39A.
FIG. 39C illustrates a sectional view of the outer pulp lifter shown in FIG. 39B.
Figure 39D:
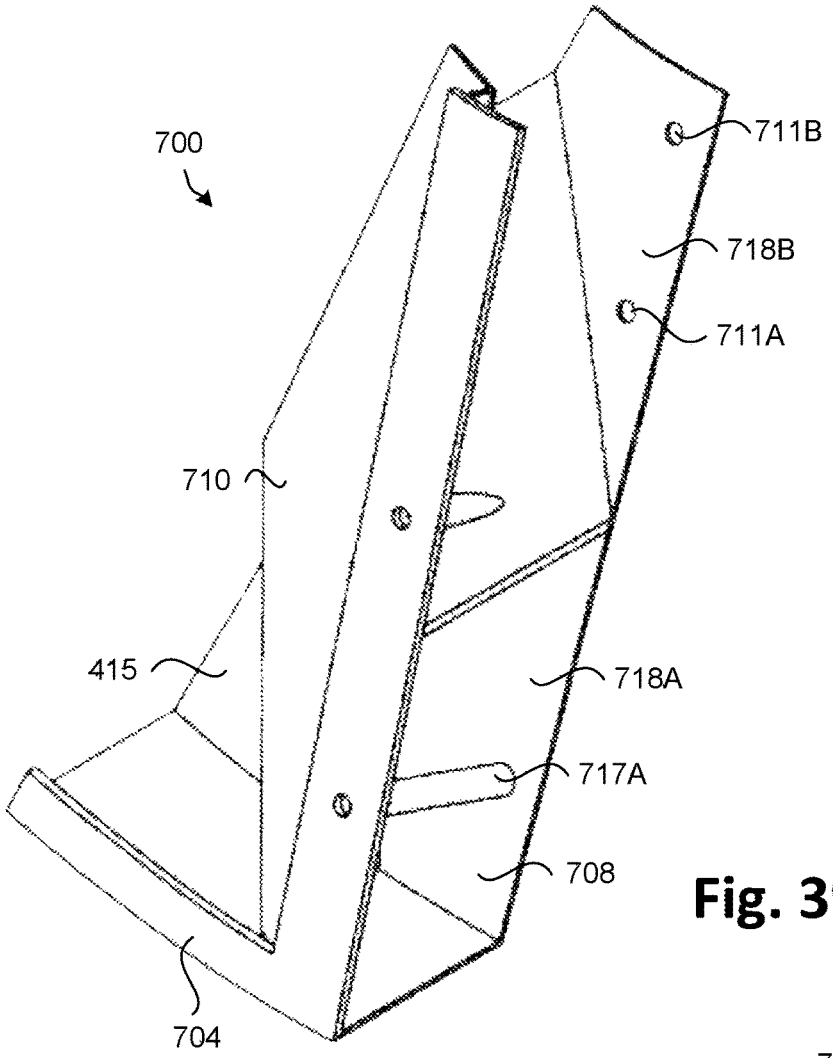
FIGS. 39D-39E illustrate perspective views of the outer pulp lifter shown in FIGS. 39A-39C.
Figure 39E:
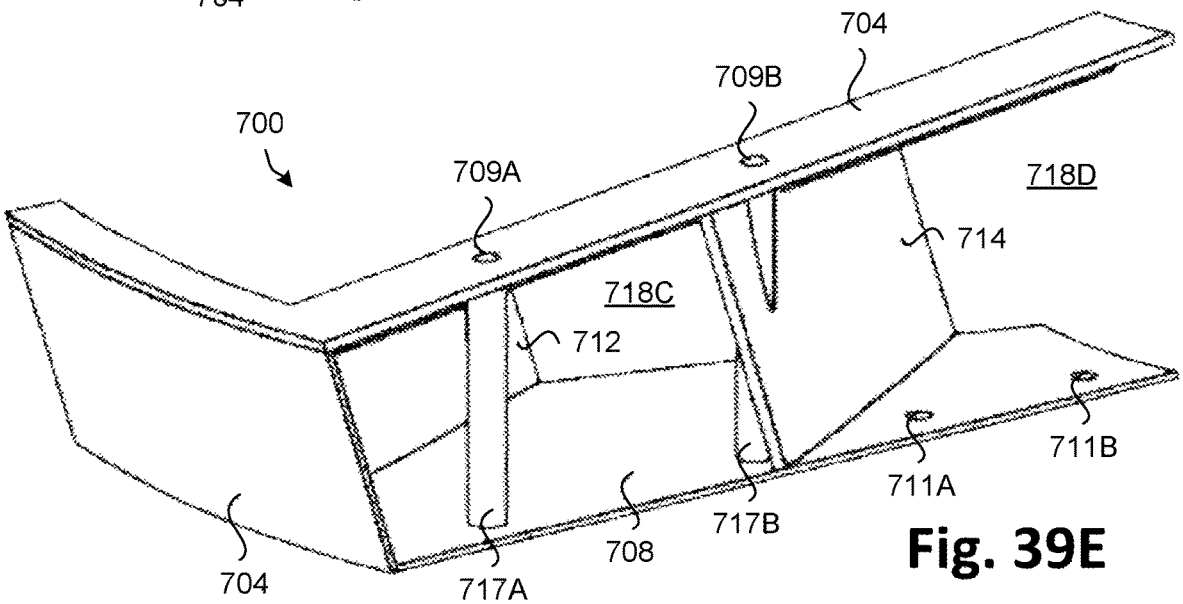

FIGS. 39A-39E illustrate various views of the outer pulp lifter 700. FIG. 39A is a side view of the outer pulp lifter. FIG. 39B illustrates a sectional view of the outer pulp lifter along the B-B section lines of FIG. 39A. FIG. 39C illustrates a sectional view of the outer pulp lifter along the C-C section lines of FIG. 39B. FIGS. 39D-39E illustrate various perspective views of the outer pulp lifter. The outer pulp lifter has a radially outer edge 705, a radially inner edge 706, a leading edge 703, and a trailing edge 707. The slurry flows in a spiral pattern from the radially outer edge 705 to the radially inner edge 706 and from the leading edge 703 to the trailing edge 707. Similar to other examples, the outer pulp lifter has an inlet chamber 715 and an outlet chamber 713 and 716. The inlet chamber is formed by an axially downstream wall or inner edge wall 708, the radially outer wall 704, a leading guide or first guide 712 on the trailing edge 707 side, a leading wall 702, and a leading wall 702 of an adjacent outer pulp lifter, and an intermediate wall 710 that partitions the inlet chamber from an outlet chamber in the axial direction. Unlike other examples, the leading wall 702 may not have the same wall thickness at the leading edge 703 as other examples. For example, the leading wall may have a minimal wall thickness where the wall includes bolt tubes (e.g., outer bolt tube 717A and inner bolt tube 717B).

The leading edge 703 or leading wall 702 is considered the inlet opening or transfer opening (e.g., outer inlet opening or outer transfer opening 718A) between the inlet chamber (on the trailing edge of the inlet chamber) and the outlet chamber. The leading edge 703 or leading wall 703 may include the bolt tubes with bolt holes (e.g., outer bolt hole 709A and inner bolt hole 709B) through center of the bolt tubes and alignment holes (e.g., an outer alignment hole 711A and an inner alignment hole 711B). The bolt holes may have at least one non-orthogonal angle with a major plane defined by the axially downstream wall or inner edge wall 708. The radially outer wall 704 may include a flange, ridge, rim, or lip.

The outer pulp lifter may include other features to improve the form to the mill (or discharge end plate) or improve the slurry flow. A major plane defined by the intermediate wall 710 may be angled relative to the planed defined by a major plane defined by the axially downstream wall or inner edge wall 708 to provide a better slope for the slurry to flow to the transfer openings. One of the acute angles defining the intermediate wall major plane can be referred to as the intermediate wall to bolt tube axis angle 701C (e.g., approximately 75°). The radially outer wall 704 can have an obtuse angle (i.e., an inner edge wall to radially outer wall angle 701B; e.g., approximately 110°) with the inner edge wall 708 so the walls better fit the contours of the mill, where the pulp lifter assembly is at an angle with the grinder shell 797. The axially upstream edge of the leading wall 702 may be angled relative to the axially downstream wall or inner edge wall 708, so the outer pulp lifter is narrower at the radially outer edge 705 than the radially inner edge 706, which can allow more slurry to pass through the center of the pulp lifter assembly. The acute angle (outer edge [axially upstream edge] to radially outer wall angle 701A) of the axially upstream edge of the leading wall 702 to the radially outer wall 704 may be closer to a right angle than the inner edge wall to radially outer wall angle 701B (e.g., $|75°-90°|=15°$ for 701A$<|110°-90°|=20°$ for 701B).

With the rotation of the mill, the slurry is configured to flow from the inlet chamber out an outlet opening through an inlet opening or transfer opening (i.e., an outer inlet opening or outer transfer opening 718A) to the outlet chamber, outer outlet chamber, or main outlet chamber 716. The main outlet chamber and the inner outlet chamber 713 of an adjacent outer pulp lifter define the outlet chamber. The main outlet chamber is defined by the axially downstream wall or inner edge wall 708, the leading wall 702 (or leading edge 703) with the transfer opening, the radially outer wall 704, a leading guide or first guide 712 on the leading edge 703 side, and the intermediate wall 710. An inner outlet chamber adjacent to the main outlet chamber may be defined by the trailing guide or second guide 714 of the adjacent outer pulp lifter, the axially downstream wall or inner edge wall 408, and the intermediate wall 410. With further rotation of the mill, the slurry is configured to flow from the main outlet chamber 716 through outer outlet opening or transfer opening 418C and outer inlet opening or outer transfer opening 718B into an adjacent inner outlet chamber 713 and then through the inner outlet opening 718D to an inner pulp lifter 720.

The leading guide or first guide 712 extends at an angle tangent to the radially outer wall 704. The leading guide 712 separated from the leading wall 702 by some shortest length (from leading edge to the leading guide). As a result, more area is available for the transfer opening in the leading wall or edge, which can increase the slurry flow of the mill.

Figure 40B:
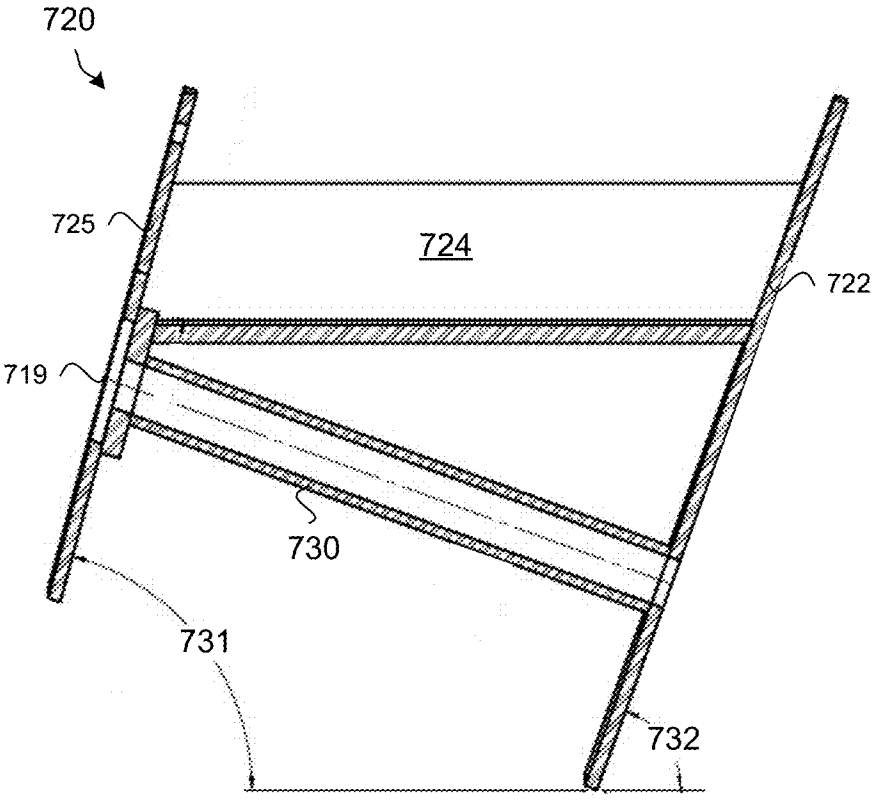
FIG. 40B illustrates a sectional view of the inner pulp lifter shown in FIG. 40A.
Figure 40A:
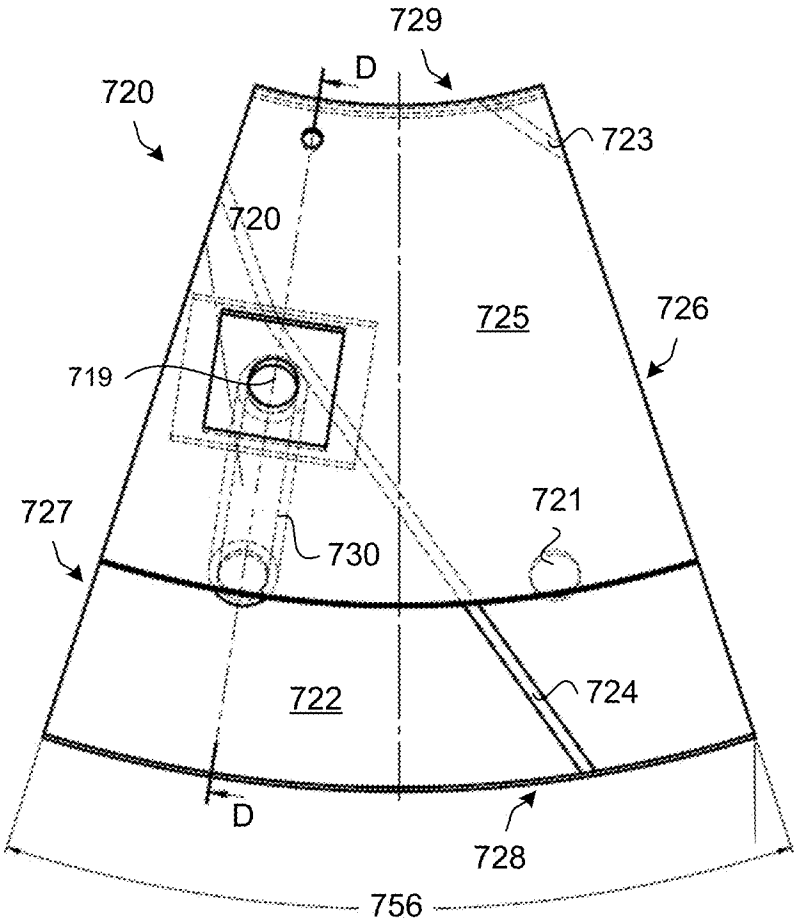
FIG. 40A illustrates a side view of an inner pulp lifter.
Figure 40C:
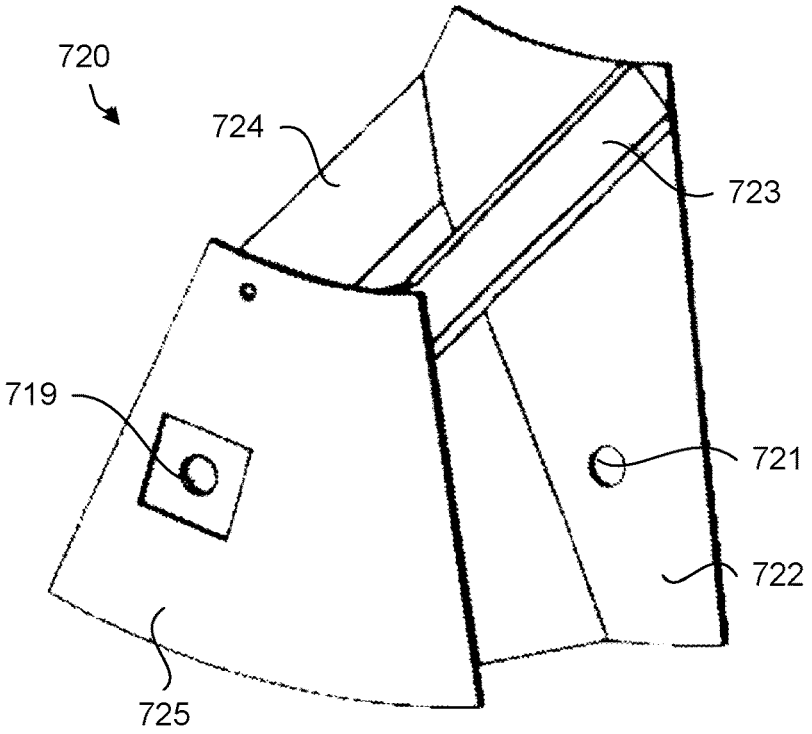
FIGS. 40C-40D illustrate perspective views of the inner pulp lifter shown in FIGS. 40A-40B.
Figure 40D:
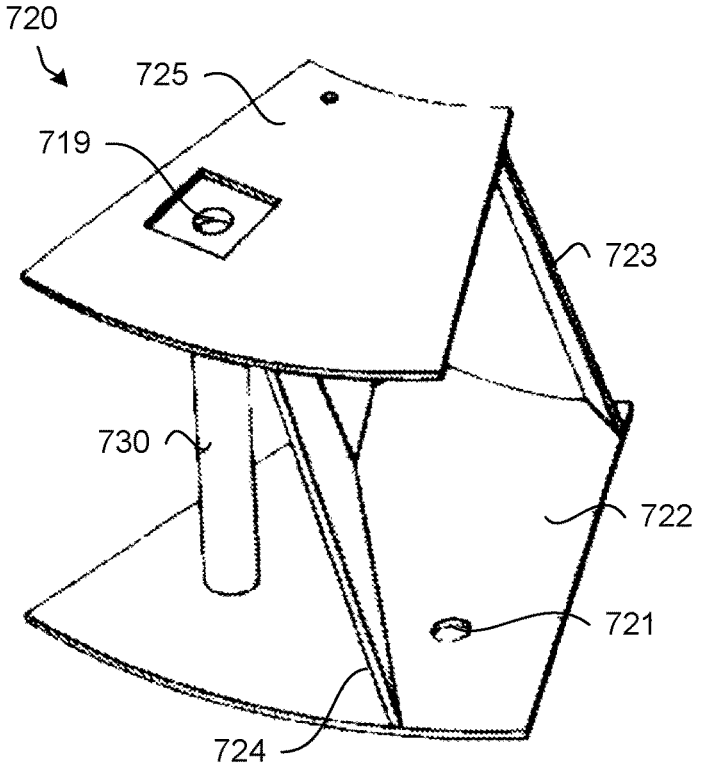
Figure 41B:
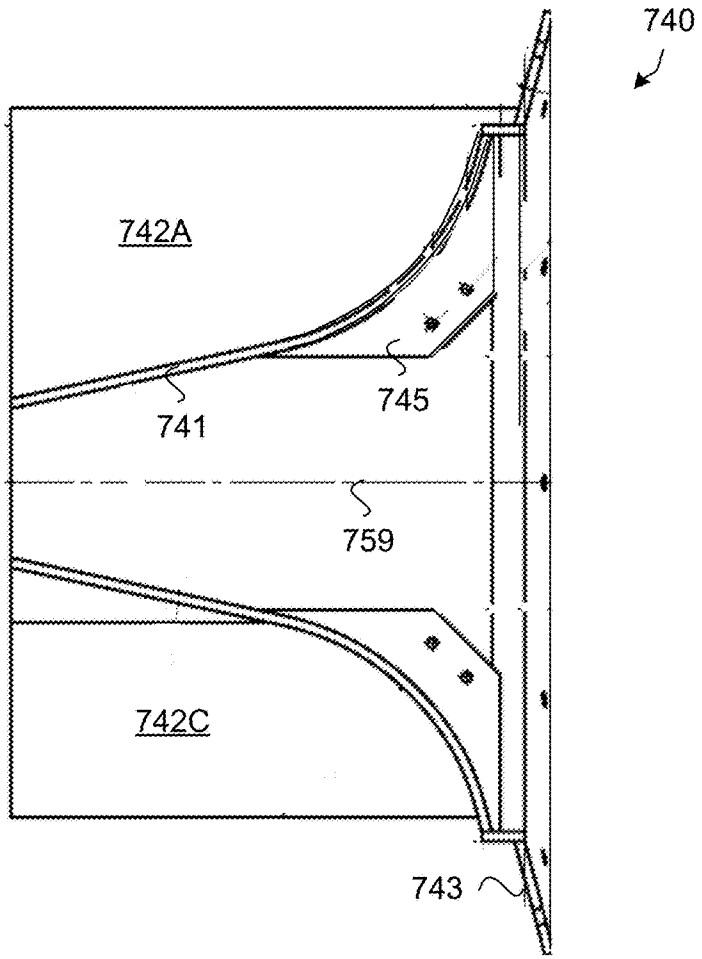
FIGS. 41A-41B illustrate side views of a discharge cone.
Figure 41A:
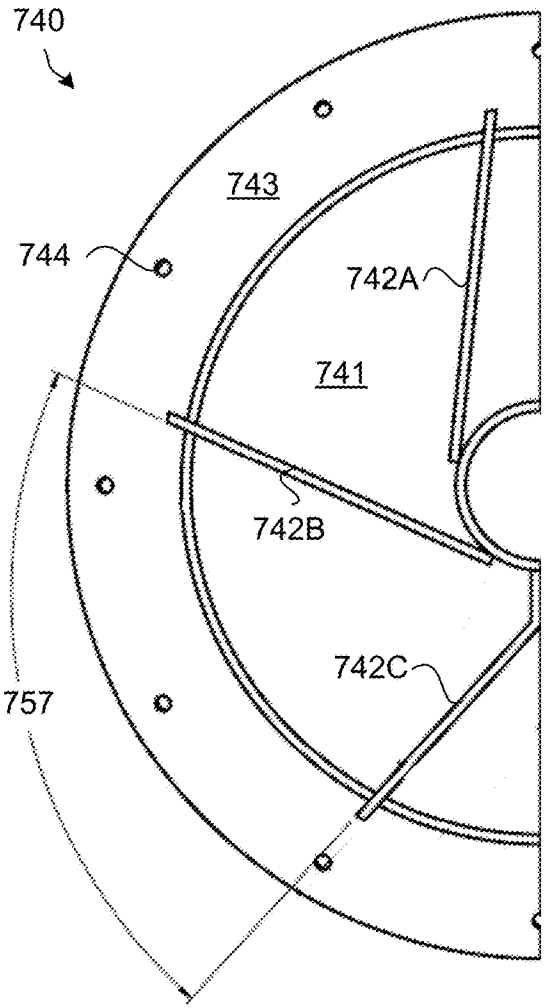
Figure 41C:
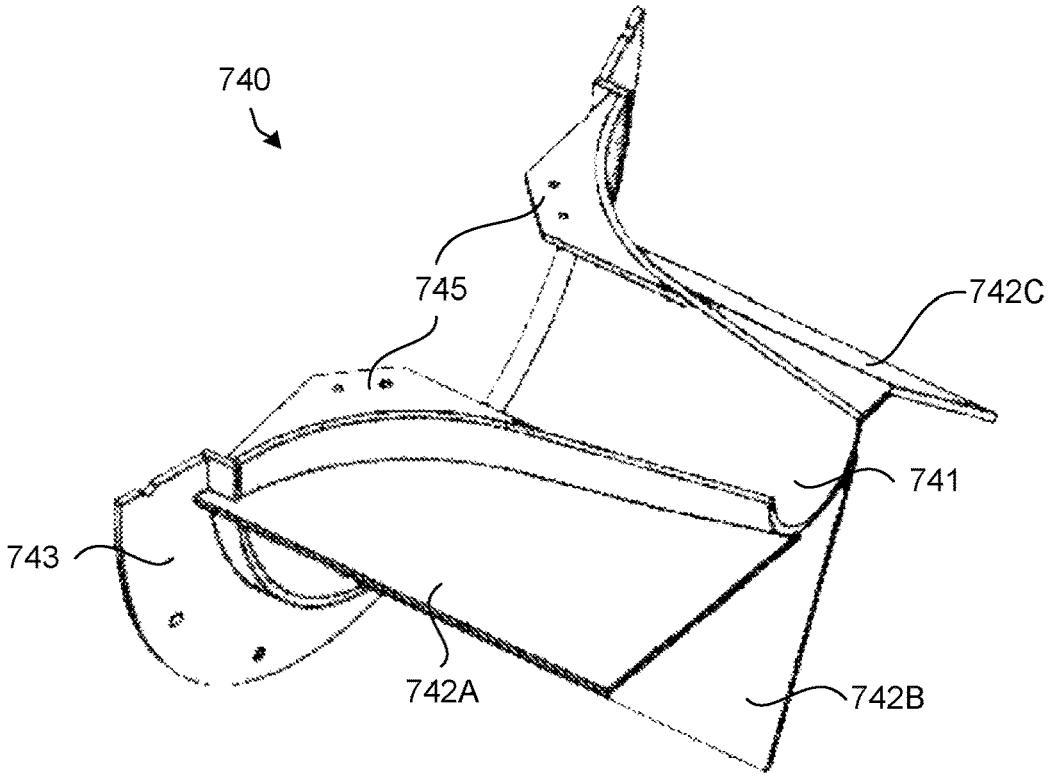
FIGS. 41C-41D illustrate perspective views of the discharge cone shown in FIGS. 41A-41B.
Figure 41D:
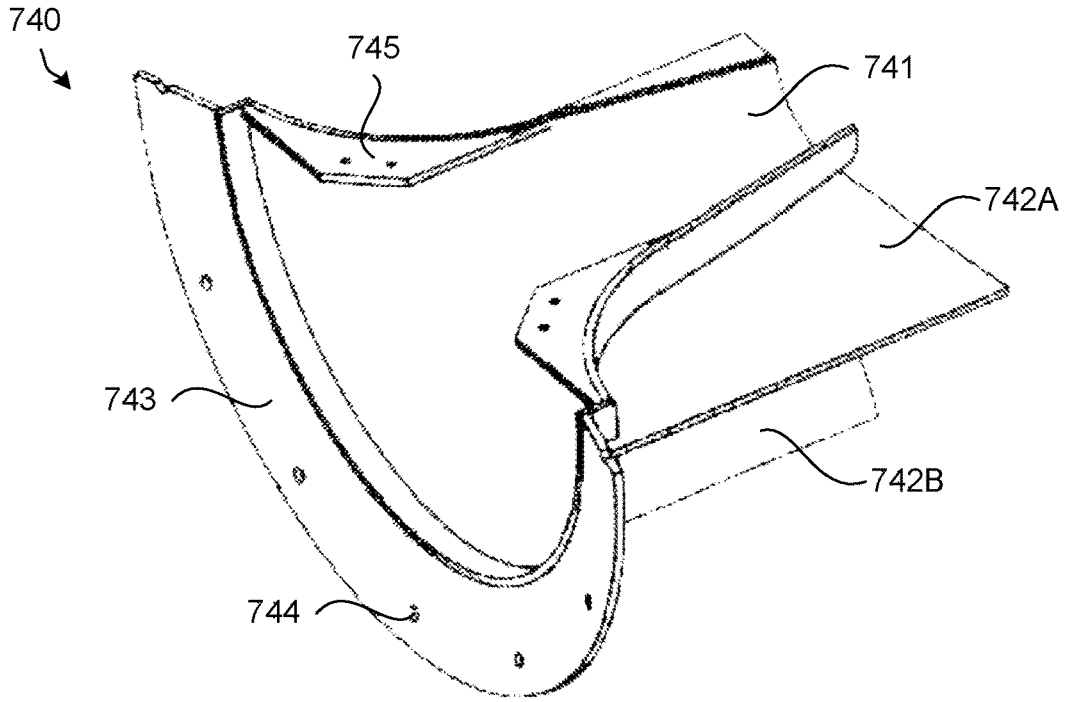
Figure 42B:
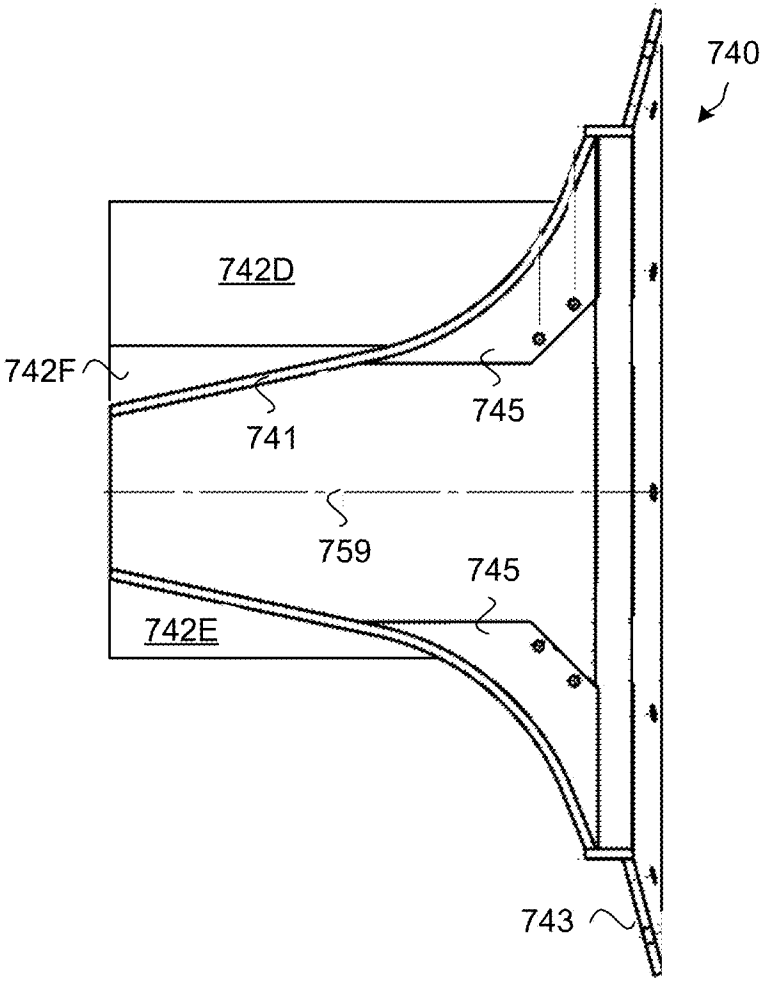
FIGS. 42A-42B illustrate side views of a discharge cone.
Figure 42A:
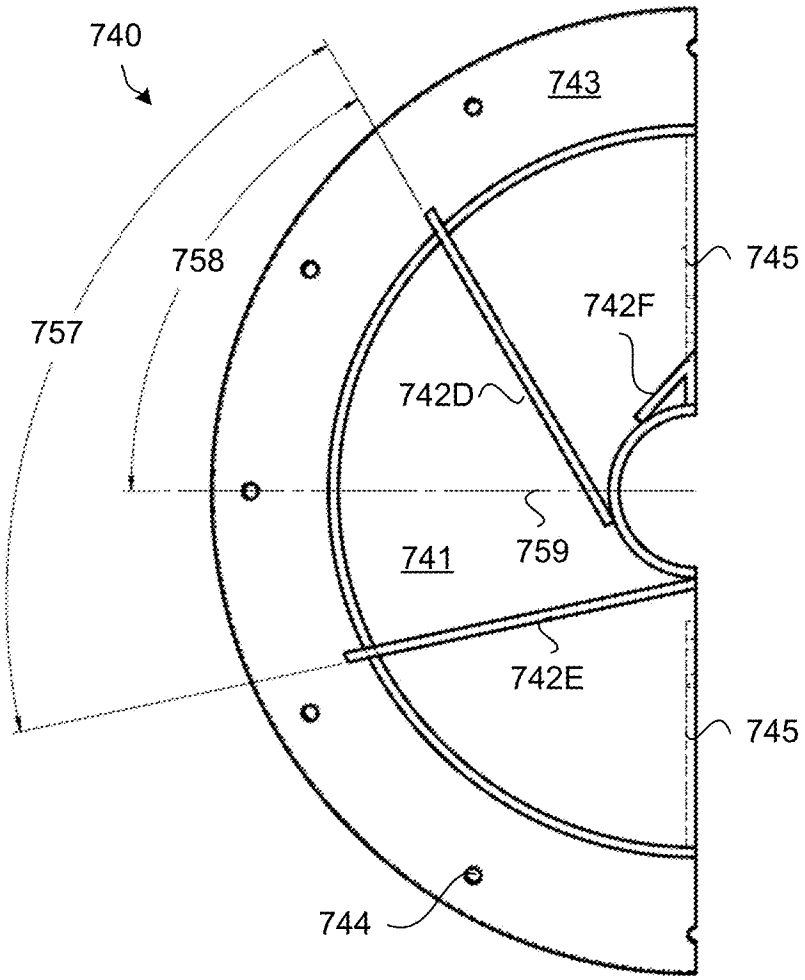
Figure 42C:
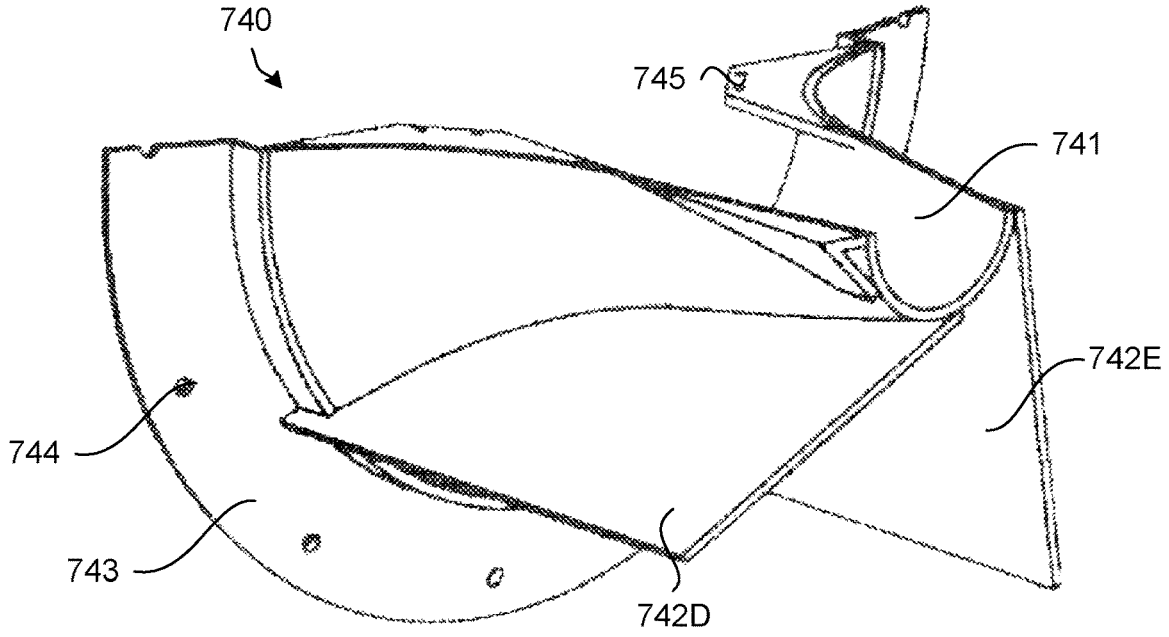
FIGS. 42C-42D illustrate perspective views of the discharge cone shown in FIGS. 41A-41B.
Figure 42D:
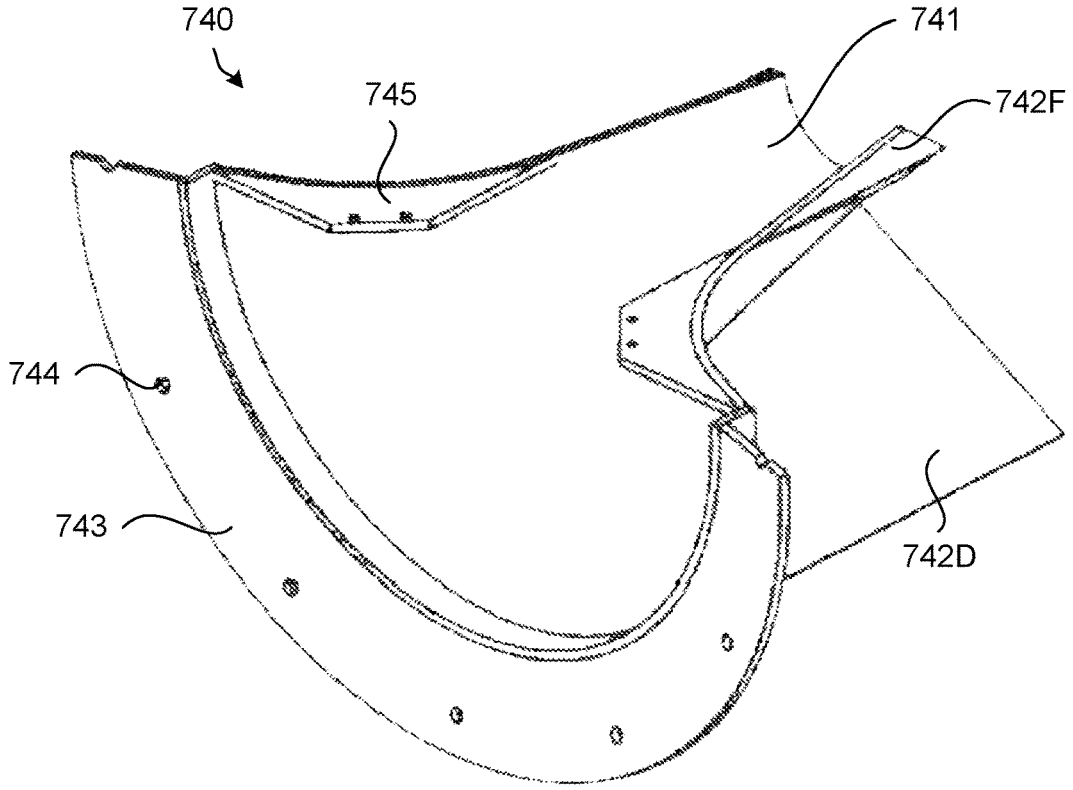

After the slurry exits the outlet chamber 713 and 716 of the outer pulp lifter, the slurry flows through channels formed by the walls (e.g., a short radial wall, trailing radial wall, or following radial wall 723 or long radial wall or leading radial wall 724) of the inner pulp lifter 720. FIGS. 40A-40D illustrate a inner pulp lifter 720. FIG. 40A is a side view of the inner pulp lifter. FIG. 40B illustrates a sectional view of the inner pulp lifter along the D-D section lines of FIG. 40A. FIGS. 40C-40D illustrate various perspective views of the inner pulp lifter. The short radial wall, long radial wall, and bolt tube 730 are supported by an axially downstream wall 722 and an axially upstream wall or outer edge wall 725. The axially upstream wall replaces the center liner used in other examples. Similar to the outer pulp lifter, the inner pulp lifter includes a leading edge 726, a trailing edge 727, a radially outer edge 728, and a radially inner edge 729, with the edges aligning with adjacent pulp lifter assembly components. The radial walls extend at an acute angle from a tangent to the radially outer edge of the inner pulp lifter. In addition, the major planes formed by the radial walls can be at non-orthogonal angles to the axially wall 722 and 725, as shown in FIG. 40B. The non-orthogonal angles can better channel the slurry in the pulp lifter assembly. The outer edge wall (axially upstream wall) to assembly center line angle 731 (e.g., approximately 75°) and inner edge wall (axially downstream wall) to assembly center line angle 732 (e.g., approximately 70°) shows that the radially inner edge 729 is wider than the radially outer edge 728.

The inner pulp lifter 720 can include an alignment hole 721 to align the pulp lifter assembly components to posts or studs in a discharge end plate. The inner pulp lifter 720 can be secured to the discharge end plate using bolts that pass through bolt hole 719 of the bolt tube 730.

After the slurry exits the channels of the inner pulp lifter, the slurry flows towards the discharger cone assembly 740. FIGS. 41A-42D illustrates two halves of the discharger cone assembly, which has five spokes or discharge cone axial walls 742A-F extending from the discharge cone 741, which moves the slurry out the mill through the discharge trunnion 793. The discharge cone has a conical shape. FIGS. 41A-41D illustrates a first half of the discharger cone. FIGS. 42A-42D illustrates a second half of the discharger cone. The two halves of the discharger cone can be joined together at the discharge cone inner flange 745. The discharger cone can be coupled to the inner pulp lifter by bolts extending through discharge cone ring flange bolt holes 744 in a discharge cone ring flange 743. The major plane defining the discharge cone axial walls 742A-F can be orthogonal to the major plane defining the discharge cone ring flange. The discharge cone axial walls 742A-F can be separated by an arc angle between discharge cone axial walls 757 (e.g., 72°). An arc angle 758 shows an angle between a discharge cone axial wall 742D and the assembly center line 759.

Reference throughout this specification to an "example" or an "embodiment" means that a particular feature, structure, or characteristic described in connection with the example is included in at least one embodiment of the invention. Thus, appearances of the words an "example" or an "embodiment" in various places throughout this specification are not necessarily all referring to the same embodiment.

Furthermore, the described features, structures, or characteristics may be combined in a suitable manner in one or more embodiments. In the following description, numerous specific details are provided (e.g., examples of layouts and designs) to provide a thorough understanding of embodiments of the invention. One skilled in the relevant art will recognize, however, that the invention can be practiced without one or more of the specific details, or with other methods, components, layouts, etc. In other instances, well-known structures, components, or operations are not shown or described in detail to avoid obscuring aspects of the invention.

While the forgoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited. Various features and advantages of the invention are set forth in the following claims.

It will be appreciated that the disclosed subject matter is not restricted to the particular embodiment(s) that has (have) been described, and that variations may be made therein without departing from the scope of the subject matter as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

What is claimed is:

1. A pulp lifter of a pulp lifter assembly for a rotary grinding mill, the pulp lifter having a leading edge and a trailing edge with respect to rotation of the mill and the pulp lifter comprising:

a first wall bounding an interior space;

a second wall dividing the interior space into a first section and a second section, wherein the first wall includes:

an inner edge wall section, and a radially outer wall section; and the second wall includes:

a guide that extends substantially from the radially outer wall section at a first end of the guide to a trailing edge of the inner edge wall section at a second end of the guide;

wherein the guide is configured such that the second end of the guide does not extend to a radially inner edge of the pulp lifter; and the first and second walls form at least one inlet opening at the leading edge providing access to the second section and an outlet opening for discharge of slurry from the second section at the radially inner edge and the trailing edge; and the first section of the interior space is at least partially open at the trailing edge of the pulp lifter.

2. The pulp lifter of claim 1, wherein the first end of the guide perpendicular to the inner wall section extending from the radially outer wall section is separated from the leading edge by distance.

3. The pulp lifter of claim 1, wherein proximate to the leading edge includes more than one hole or bolt tube extending from an outer edge to an inner edge, and a radially outer inlet opening of the at least one inlet opening formed between the radially outer wall section and a furthest outer hole or bolt tube of the more than one hole or bolt tube.

4. The pulp lifter of claim 1, further comprises:

a trailing guide between the first and second walls that extends from the leading edge to the radially inner edge forming an outlet opening between the leading edge and the trailing guide at the radially inner edge.

5. The pulp lifter of claim 1, wherein proximate to the leading edge includes more than one hole or bolt tube extending from an outer edge to an inner edge, and an inlet opening of the at least one inlet opening formed between a furthest inner hole or bolt tube of the more than one hole or bolt tube and the radially inner edge.

6. The pulp lifter of claim 1, wherein the guide is substantially linear.

7. The pulp lifter of claim 1, wherein the guide has an outer segment at an acute angle to the radially outer wall section in the direction of the trailing edge.

8. The pulp lifter of claim 7, wherein the acute angle of the outer segment is between 30° and 80° .

9. The pulp lifter of claim 1, wherein the guide has an inner segment at an acute angle to the trailing edge of the pulp lifter in the direction of the radially outer wall section.

10. The pulp lifter of claim 1, wherein a wall thickness at an intersection of the guide and the radially outer wall section is substantially thicker than a wall thickness of the guide.

11. A pulp lifter assembly, for installation in a grinding mill on a downstream side of a grate formed with apertures that allow slurry to pass through the grate from an upstream side of the grate to the downstream side of the grate, the pulp lifter assembly comprising a plurality of mutually adjacent outer pulp lifters each having a leading edge and a trailing edge, each two adjacent outer pulp lifters being respectively a leading pulp lifter and a trailing pulp lifter, and each outer pulp lifter comprising:

a first wall bounding an interior space;

a second wall dividing the interior space into a first region and a second region; and a third wall dividing the second region into a first sub-region and a second sub-region;

wherein the first wall includes:

an inner edge wall, and a radially outer wall; and the second wall includes:

a leading guide that extends substantially from the radially outer wall at a first end of the leading guide to a trailing edge of the inner edge wall at a second end of the leading guide;

wherein the leading guide is configured such that the second end of the leading guide does not extend to the radially inner edge; and the third wall includes:

a trailing guide between the first and second walls that extends from the leading edge to the radially inner edge forming an outlet opening between the leading edge and the trailing guide at the radially inner edge; and the first, second, and third walls form at least one inlet opening at the leading edge providing access to the second section and an outlet opening for discharge of slurry from the second region at the radially inner edge; and the first region of the interior space is at least partially open at the trailing edge of each outer pulp lifter.

12. The pulp lifter assembly of claim 11, wherein the leading guide of the leading pulp lifter at the inner edge wall of the leading guide aligns with the trailing guide of the trailing pulp lifter at the leading edge of the trailing guide.

13. The pulp lifter assembly of claim 11, further comprising:

an inner pulp lifter defining at least one channel for receiving slurry from the outlet opening of the outer pulp lifter and conveying the slurry radially inward relative to the mill.

14. The pulp lifter assembly of claim 13, wherein the at least one channel of the inner pulp lifter includes at least one radial wall, and the at least one radial wall aligns with the trailing guide at a radially edge between at least one outer pulp lifter and the inner pulp lifter.

15. The pulp lifter assembly of claim 13, wherein the at least one channel of the inner pulp lifter includes a radial wall, and the radial wall forms an acute angle to a radially outer edge of the of the inner pulp lifter in the direction of the trailing edge, the guide has an outer segment at an acute angle to the radially outer wall in the direction of the trailing edge, and the acute angle of the radial wall is greater than the acute angle of the guide.

16. The pulp lifter assembly of claim 11, further comprising:

the grate formed with apertures for allowing slurry to pass to the at least one pulp lifter for removal from the mill by the at least one pulp lifter, wherein the grate is aligned to the at least one pulp lifter.

17. A pulp lifter structure for installation in a grinding mill, the pulp lifter structure including:

an outer pulp lifter having a leading edge and a trailing edge with respect to rotation of the mill and comprising:

a first wall bounding an interior space;

a second wall dividing the interior space into first and second regions; and a third wall;

wherein the first wall includes:

an inner edge wall, and a radially outer wall, and the second wall includes a leading guide that extends substantially from the radially outer wall at a first end of the leading guide to a trailing edge of the inner edge wall at a second end of the leading guide, wherein the leading guide is configured such that the second end of the leading guide does not extend to the inner edge wall, the third wall includes a trailing guide between the first and second walls that extends from the leading edge to the radially inner edge forming an outlet opening between the leading edge the trailing guide at the radially inner edge, and the first, second, and third walls form at least one inlet opening at the leading edge providing access to the second section and an outlet opening for discharge of slurry from the second region at the radially inner edge, and the first region of the interior space is at least partially open at the trailing edge of the pulp lifter; and an inner pulp lifter defining at least one channel for receiving slurry from the outlet opening of the outer pulp lifter and conveying the slurry radially inward relative to the mill; and a discharger for receiving slurry from the at least one channel of the inner pulp lifter and discharging the slurry from the inner pulp lifter.

18. The pulp lifter structure of claim 17, wherein the at least one channel of the inner pulp lifter includes a radial wall, the radial wall aligns with the trailing guide at a radially edge between the outer pulp lifter and the inner pulp lifter, and the discharger includes at least one discharger wall, and the discharger wall aligns with the radial wall at a radially edge between the inner pulp lifter and the discharger.

19. The pulp lifter structure of claim 17, wherein:

the leading guide forms an acute angle to the radially outer wall in the direction of the trailing edge;

the at least one channel of the inner pulp lifter includes at least one radial wall, the at least one radial wall forms an acute angle to a radially outer edge of the of the inner pulp lifter in the direction of the trailing edge, and the acute angle of the at least one radial wall is greater than the acute angle of the leading guide, the discharger includes at least one discharger wall, the at least one discharger wall forms an angle to a radially outer edge of the of the discharger in the direction of the trailing edge, and the angle of the at least one discharger wall is greater than the acute angle of the at least one radial wall.

20. The pulp lifter system of claim 17, further comprising:

a plurality of pulp lifter structures radially adjacent to each other forming a circular pattern.

* * * * *